US009022540B2

(12) United States Patent
Oya et al.

(10) Patent No.: US 9,022,540 B2
(45) Date of Patent: May 5, 2015

(54) LIQUID SUPPLY CARTRIDGE, LIQUID SUPPLY SYSTEM, AND LIQUID EJECTION APPARATUS

(71) Applicant: Seiko Epson Corporation, Tokyo (JP)

(72) Inventors: Shun Oya, Matsumoto (JP); Takayuki Shiota, Kitakyusyu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/194,379

(22) Filed: Feb. 28, 2014

(65) Prior Publication Data

US 2014/0240412 A1 Aug. 28, 2014

(30) Foreign Application Priority Data

Feb. 28, 2013 (JP) ..... 2013-038472

(51) Int. Cl.
*B41J 2/17* (2006.01)
*B41J 2/175* (2006.01)

(52) U.S. Cl.
CPC ..... *B41J 2/1753* (2013.01); *B41J 2/17526* (2013.01)

(58) Field of Classification Search
CPC ..... B41J 2/14072; B41J 2/17526; B41J 2/17506; B41J 2/17509; B41J 2/1753
USPC ..... 347/50, 84–87
See application file for complete search history.

(56) References Cited

U.S. PATENT DOCUMENTS

| | | | | |
|---|---|---|---|---|
| 7,971,977 | B2 * | 7/2011 | Nakata et al. | 347/86 |
| 2008/0049069 | A1 | 2/2008 | Inamura et al. | |
| 2008/0049080 | A1 | 2/2008 | Hayashi et al. | |
| 2008/0049081 | A1 | 2/2008 | Hayashi et al. | |

FOREIGN PATENT DOCUMENTS

| | | | |
|---|---|---|---|
| JP | 2008-049566 | A | 3/2008 |
| JP | 2008-074090 | A | 4/2008 |
| JP | 2008-074100 | A | 4/2008 |

* cited by examiner

*Primary Examiner* — Juanita D Jackson
(74) *Attorney, Agent, or Firm* — Stroock & Stroock & Lavan LLP

(57) ABSTRACT

A cartridge configured to be mounted to a liquid ejection apparatus that has an electrical connection portion and an engagement portion, and having an engaging portion for engaging the engagement portion and a plurality of electrodes for connecting to the connection portion. The electrodes have contact portions for contacting the connection portion, with a first group of a plurality of the contact portions constituting a first array whose contact portions are aligned in an X-axis direction intersecting a mounting direction of the cartridge, and a second group of the plurality of the contact portions constituting a second array whose contact portions are aligned in the X-axis direction. The first and second arrays are aligned in a direction intersecting the X-axis direction, and the engaging portion and an area between the first array and the second array are aligned in the X-axis direction.

13 Claims, 53 Drawing Sheets

LIQUID SUPPLY CARTRIDGE, LIQUID SUPPLY SYSTEM, AND LIQUID EJECTION APPARATUS

BACKGROUND

1. Technical Field

The entire disclosure of Japanese Patent Application No.: 2013-038472, filed Feb. 28, 2013 is expressly incorporated by reference herein.

The present invention relates to a cartridge, a liquid supply system, a liquid ejection apparatus, and the like.

2. Related Art

Among cartridges that house a liquid, which is a fluid substance having flowability, cartridges for supplying ink serving as an exemplary liquid to a liquid ejection apparatus such as an ink jet printer are known, for example. Some of these cartridges have a substrate provided with electrodes that are electrically connected to a control circuit of an ink jet printer, and a lever for engaging a latching portion of the ink jet printer. (Refer to, for example, JP-A-2008-74090).

There are calls for the miniaturization of liquid ejection apparatuses such as ink jet printers. For example, miniaturization can be realized by lowering the profile of ink jet printers. Making the cartridges thinner contributes to achieving lower profile ink jet printers. However, JP-A-2008-74090 does not propose a technique for achieving thinner cartridges while securing the reliability of the electrical connection between the electrodes and liquid ejection apparatus.

SUMMARY

The invention may be realized as the following embodiments and application examples.

According to an aspect of the invention, an application example 1 is directed to a cartridge that is configured to be detachably mounted to a liquid ejection apparatus having an electrical connection portion and an engagement portion, and that has a housing portion configured to house a liquid for supplying to the liquid ejection apparatus. The cartridge includes an engaging portion configured to be engaged to the engagement portion of the liquid ejection apparatus, and a plurality of electrodes configured to be electrically connected to the connection portion of the liquid ejection apparatus. The plurality of electrodes each have a contact portion configured to be contacted to the connection portion, with a first group of a plurality of the contact portions constituting a first array in which the contact portions are aligned in a first direction that intersects a mounting direction in which the cartridge is mounted to the liquid ejection apparatus, and a second group of the plurality of the contact portions constituting a second array in which the second group of the plurality of the contact portions are aligned in the first direction. The first array and the second array are aligned in a second direction that intersects the first direction, and the engaging portion and an area between the first array and the second array are aligned in the first direction when the cartridge is mounted on the liquid ejection apparatus.

With the cartridge of this application example, the engaging portion and an area between the first array and the second array are aligned in the first direction, enabling the distance between the plurality of the contact portions and the engaging portion to be shortened. Error in the position of the contact portions relative to the connection portion is thus more readily reduced. By being able to reduce error in the position of the contact portions relative to the connection portion, contact between the connection portion and the contact portions is more readily ensured. The reliability of the electrical connection between the connection portion and the contact portions is thereby more readily secured. Also, because the engaging portion and an area between the first array and the second array are aligned in the first direction, the cartridge is more readily miniaturized in the mounting direction. As a result, according to this cartridge, the cartridge is more readily made thinner in the mounting direction, while securing the reliability of the electrical connection between the connection portion and the contact portions.

An application example 2 is directed to the above cartridge, in which it may be preferable that the first array and the second array are located within a range from one quarter to three quarters of a height of the cartridge, when the cartridge is viewed from a side on which the engaging portion and the plurality of the contact portions are provided, and in a state where the mounting direction is aligned within a vertical direction.

With this application example, the plurality of contact portions are located within a range from one quarter to three quarters of the height of the cartridge. The plurality of contact portions are thereby positioned toward the middle of the height of the cartridge, allowing a rotation moment acting in the height direction of the cartridge to be more readily avoided.

An application example 3 is directed to the above cartridge, in which it may be preferable that the engaging portion is provided on a lever that extends from an outer shell of the cartridge, and that the lever has an elastic force biasing the engaging portion.

With this application example, a biasing force can be imparted to the cartridge by the lever, enabling the fixing force of the cartridge on the liquid ejection apparatus to be increased.

An application example 4 is directed to the above cartridge, in which it may be preferable that the plurality of the contact portions overlap the lever when viewed in the first direction.

With this application example, the plurality of electrodes overlap with the lever when viewed in the first direction, enabling the area in which the plurality of electrodes are provided to be superimposed on the operational area of the lever. The area in which the plurality of electrodes are provided can thereby be secured using the operational area of the lever, when viewed in the first direction. As a result, effective utilization of the area is more readily achieved.

An application example 5 is directed to the above cartridge, in which it may be preferable that, where a side on which the lever joins the outer shell of the cartridge is given as one end of the lever, a gripping portion is provided further at the other end of the lever than the engaging portion, and that the gripping portion projects further in the first direction than the cartridge, when the cartridge is viewed from a side on which the engaging portion and the electrodes are provided.

With this application example, the gripping portion projects more in the first direction than the cartridge, allowing the gripping portion to be more readily enlarged in the first direction. The operability of the lever is thereby more readily improved.

An application example 6 is directed to the above cartridge, in which it may be preferable that the cartridge has an outer wall constituting at least part of the outer shell of the cartridge, and that a disposition portion on which the plurality of electrodes are provided and the lever project from the outer wall.

With this application example, the lever projects from the outer wall, enabling the area between the outer wall and the lever can be used as the operational area of the lever. Also, the plurality of electrodes can be disposed so as to project, in the first direction, from the outer wall in an area alongside the operational area of the lever. The capacity of the accommodation portion is thereby more readily expanded.

An application example 7 is directed to the above cartridge, in which it may be preferable that the plurality of electrodes respectively incline toward an inside of the cartridge in the direction in which the cartridge is mounted to the liquid ejection apparatus.

With this application example, the plurality of electrodes incline toward the inside of the cartridge, in the direction in which the cartridge is mounted to the liquid ejection apparatus. By the plurality of electrodes thus inclining in the mounting direction, the size of the cartridge in the mounting direction is more readily reduced while maintaining the area of the electrodes. The cartridge is thereby more readily miniaturized.

An application example 8 is directed to the above cartridge, in which it may be preferable that each of the plurality of electrodes has a friction area which is an area that the connection portion rubs against in the second direction when mounting the cartridge to the liquid ejection apparatus, and that the engaging portion is located between the plurality of friction areas in the first array and the plurality of friction areas in the second array when viewed in the first direction.

With this application example, the engaging portion is located between the plurality of friction areas in the first array and the plurality of friction areas in the second array when viewed in the first direction. Generally, when mounting the cartridge in the liquid ejection apparatus, the connection portion moves a predetermined distance while rubbing against the surfaces of the plurality of electrodes. Dust and the like adhering to the surface of the plurality of electrodes can thereby be removed. As a result, excellent contact can be secured between the plurality of electrodes and the connection portion. Here, when the friction area is too large, the connection portion may wear down portions other than the plurality of electrodes. There is also a danger of dust produced at this time leading to a faulty connection. Thus, it is important that the engaging portion is disposed so that error also does not occur in the friction areas of the plurality of electrodes. At this time, error in the friction areas relative to the position at which the engaging portion engages the engagement portion can be reduced, the closer the position at which the engaging portion engages the engagement portion is to the friction areas. The precision of the range of the friction area can thereby be enhanced.

An application example 9 is directed to the above cartridge, in which it may be preferable that the engaging portion relative to the plurality of electrodes is located between the first array and the second array in the mounting direction.

With this application example, the position of the engaging portion relative to the plurality of electrodes is between the first array and the second array in the mounting direction, enabling the distance between the plurality of contact portions and the engaging portion can be shortened. Error in the position of the contact portions relative to the connection portion can thus be reduced. By being able to reduce error in the position of the contact portions relative to the connection portion, contact between the connection portion and the contact portions is more readily ensured. The reliability of the electrical connection between the connection portion and the contact portions is thereby more readily secured. Also, because the position of the engaging portion relative to the plurality of electrodes in the mounting direction falls between the first array and the second array in the mounting direction, the cartridge is more readily miniaturized in the mounting direction. As a result, according to this cartridge, the cartridge is more readily made thinner in the mounting direction, while securing the reliability of the electrical connection between the connection portion and the contact portion.

An application example 10 is directed to the above cartridge, in which it may be preferable that the cartridge has a plurality of the housing portions constituted integrally and aligned in the first direction, and that the plurality of housing portions are partitioned from each other, and each configured to independently house the liquid.

With this application example, liquids can be housed independently for each of a plurality of housing portions integrally constituted in the first direction. A plurality of types of liquids that differ from each other can thereby be housed in a single cartridge, for example, allowing for miniaturization of the cartridge to be more readily achieved.

An application example 11 is directed to the above cartridge, in which it may be preferable that a second engaging portion is provided on an opposite side to the engaging portion side across the housing portion, the second engaging portion being configured to be engaged to a second engagement portion of the liquid ejection apparatus.

With this application example, the opposite side to the engaging portion side across the housing portion is more easily regulated by the second engaging portion, enabling rocking in the direction in which the engaging portion and the second engaging portion are connected to be more easily regulated. Error in the position of the contact portions relative to the connection portion is thereby more readily reduced.

An application example 12 is directed to the above cartridge, in which it may be preferable that the cartridge includes a first member to which the housing portion is provided, and a second member to which the engaging portion and the plurality of electrodes are provided, and that the first member and the second member are constituted separately from each other.

With this application example, because the first member and the second member are constituted separately to each other, only the first member need be replaced when replacing the liquid with new liquid, for example. The amount of resources consumed is thereby more readily reduced, for example, allowing resource savings to be more readily achieved.

An application example 13 is directed to a liquid supply system configured to supply a liquid to a liquid ejection apparatus that has an electrical connection portion and an engagement portion. The liquid supply system includes an external tank configured to house the liquid, a tube configured to supply the liquid from the external tank to the liquid ejection apparatus, and an adapter provided with a plurality of electrodes to be electrically connected to the connection portion and an engaging portion to engage the engagement portion, and configured to be detachably mounted to the liquid ejection apparatus. The plurality of electrodes each have a contact portion configured to be contacted to the connection portion of the liquid ejection apparatus, with a first group of a plurality of the contact portions constituting a first array in which the first group of the plurality of the contact portions are aligned in a first direction that intersects a mounting direction in which the adapter is mounted to the liquid ejection apparatus, and a second group of the a plurality of the remaining contact portions constituting a second array in which the contact portions are aligned in the first direction. The first array and the second array are aligned in a second direction that intersects the first direction, and the engaging portion and a range of an area between the first array and the second array are aligned in the first direction when the adapter is mounted on the liquid ejection apparatus.

With the liquid supply system of this application example, the position, in the adapter, of the engaging portion relative to the plurality of electrodes is within a range, in the mounting direction, of the area in which the plurality of electrodes are provided, enabling the distance between the plurality of contact portions and the engaging portion to be shortened. Error in the position of the contact portions relative to the connection portion is thus more readily reduced. Also, because the position, in the mounting direction, of the engaging portion relative to the plurality of electrodes falls within a range, in the mounting direction, of the area in which the plurality of electrodes are formed, the adapter is more readily miniaturized in the mounting direction.

An application example 14 is direction to a liquid ejection apparatus that is configured to eject a liquid and includes a holder configured to have a cartridge detachably mounted thereto, the cartridge having a housing portion configured to house the liquid for supplying the liquid ejection apparatus. An electrical connection portion and an engagement portion are provided to the holder, and the cartridge includes a lever extending from an outer shell of the cartridge, an engaging portion provided on the lever, the engaging portion being configured to be engaged to the engagement portion of the holder, and a plurality of electrodes configured to be electrically connected to the connection portion of the holder. The plurality of electrodes each have a contact portion to contact the connection portion, with a first group of a plurality of the contact portions constituting a first array in which the first group of the plurality of the contact portions are aligned in a first direction that intersects a mounting direction in which the cartridge is mounted to the holder, and a second group of the plurality of the contact portions constituting a second array in which the second group of the plurality of the contact portions are aligned in the first direction. The first array and the second array are aligned in a second direction that intersects the first direction, and the engaging portion and the plurality of electrodes are aligned in the first direction. The lever has an elastic force that biases the engaging portion, and, where a side on which the lever joins the outer shell of the cartridge is given as one end of the lever, a gripping portion is provided further at the other end of the lever than the engaging portion, with the gripping portion projecting further in the first direction than the cartridge, when the cartridge is viewed from a side on which the engaging portion and the electrodes are provided. The holder has a wallboard that opposes a side of the cartridge in the first direction, with the wallboard being provided with a notch portion where a part of the wallboard is cut away, the part of the wallboard including an area that overlaps with the gripping portion when viewed in the first direction.

The liquid ejection apparatus of this application example includes a holder to which a cartridge having a housing portion capable of housing a liquid is to be detachably mounted. The cartridge has a lever extending from the outer shell of the cartridge, an engaging portion provided on the lever for engaging an engagement portion of the holder, and a plurality of electrodes for electrically connecting to the connection portion of the holder. With this holder, the gripping portion provided on the lever of the cartridge projects more in the first direction than the cartridge, allowing the gripping portion to be more readily enlarged in the first direction. The operability of the lever is thereby more readily improved. The wallboard of the holder is provided with a notch portion where a part of the wallboard is cut away, the part of the wallboard including an area that overlaps with the gripping portion when viewed in the first direction. The holder is thus more readily miniaturized while maintaining the operability of the lever. As described above, miniaturization is more readily achieved with this liquid ejection apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
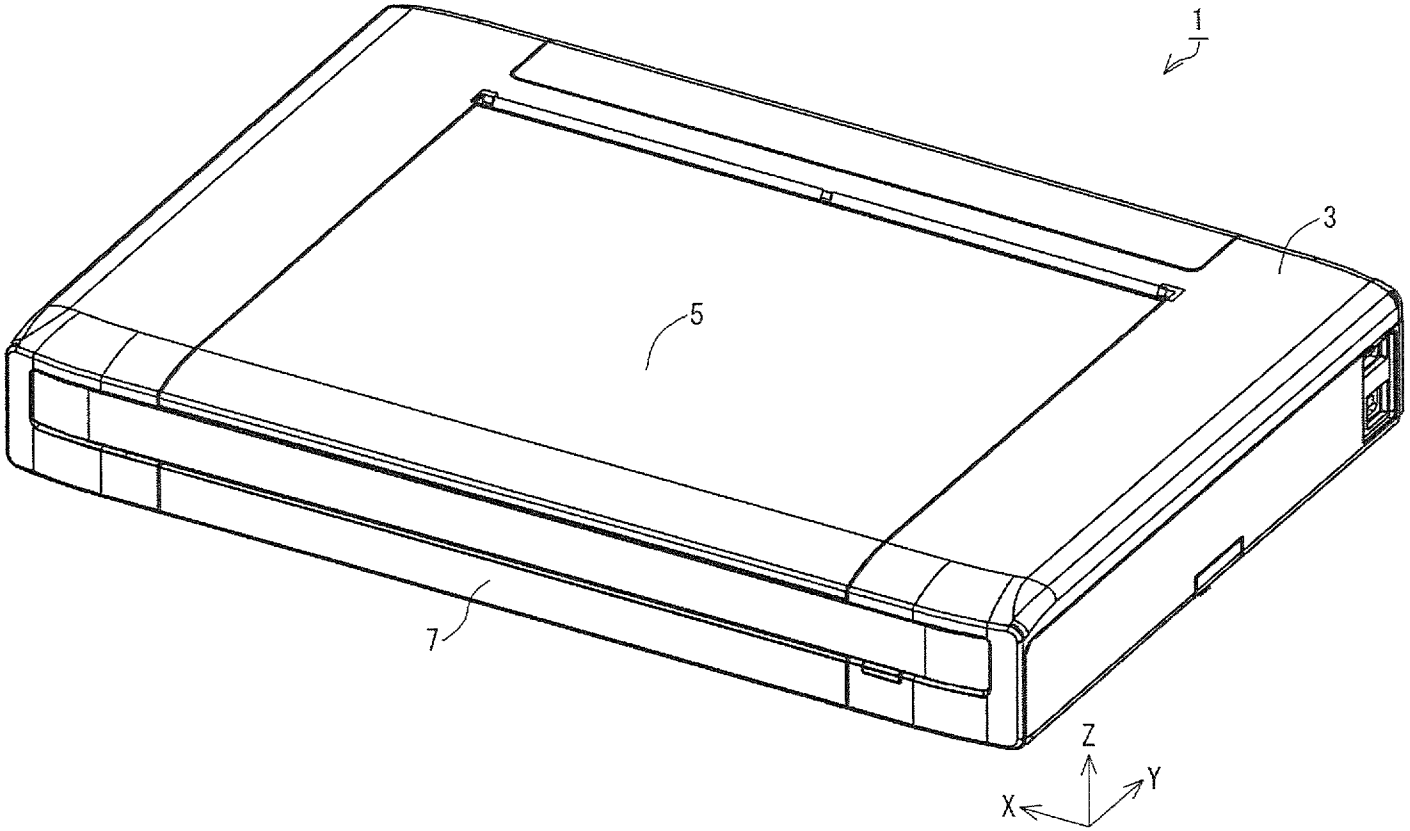
FIG. 1 is a perspective view showing a printer according to an embodiment.

Using an ink jet printer (hereinafter, "printer"), which is an exemplary liquid ejection apparatus, as an example, embodiments will be described with reference to the drawings. Note that, in the drawings, constituent elements and members may be shown in different scales, so that each constituent element is large enough to be recognizable.

A printer 1 according to the present embodiment has a casing 3, a feed cover 5 and a discharge cover 7, as shown in FIG. 1. The casing 3, the feed cover 5 and the discharge cover 7 constitute an outer shell of the printer 1. Note that XYZ axes whose coordinate axes are orthogonal to each other are given in FIG. 1. The XYZ axes are also given as needed in subsequent diagrams. The respective arrows of the XYZ axes are pointing in the positive direction, and the opposite direction to the direction of the arrows indicates the negative direction. In a state where the printer 1 is used, the printer 1 is disposed on the horizontal planar surface defined by the X-axis direction and the Y-axis direction. When the printer 1 is in this usage state, the Z-axis direction is orthogonal to the horizontal planar surface, and the negative Z-axis direction is vertically downward.

Figure 2:
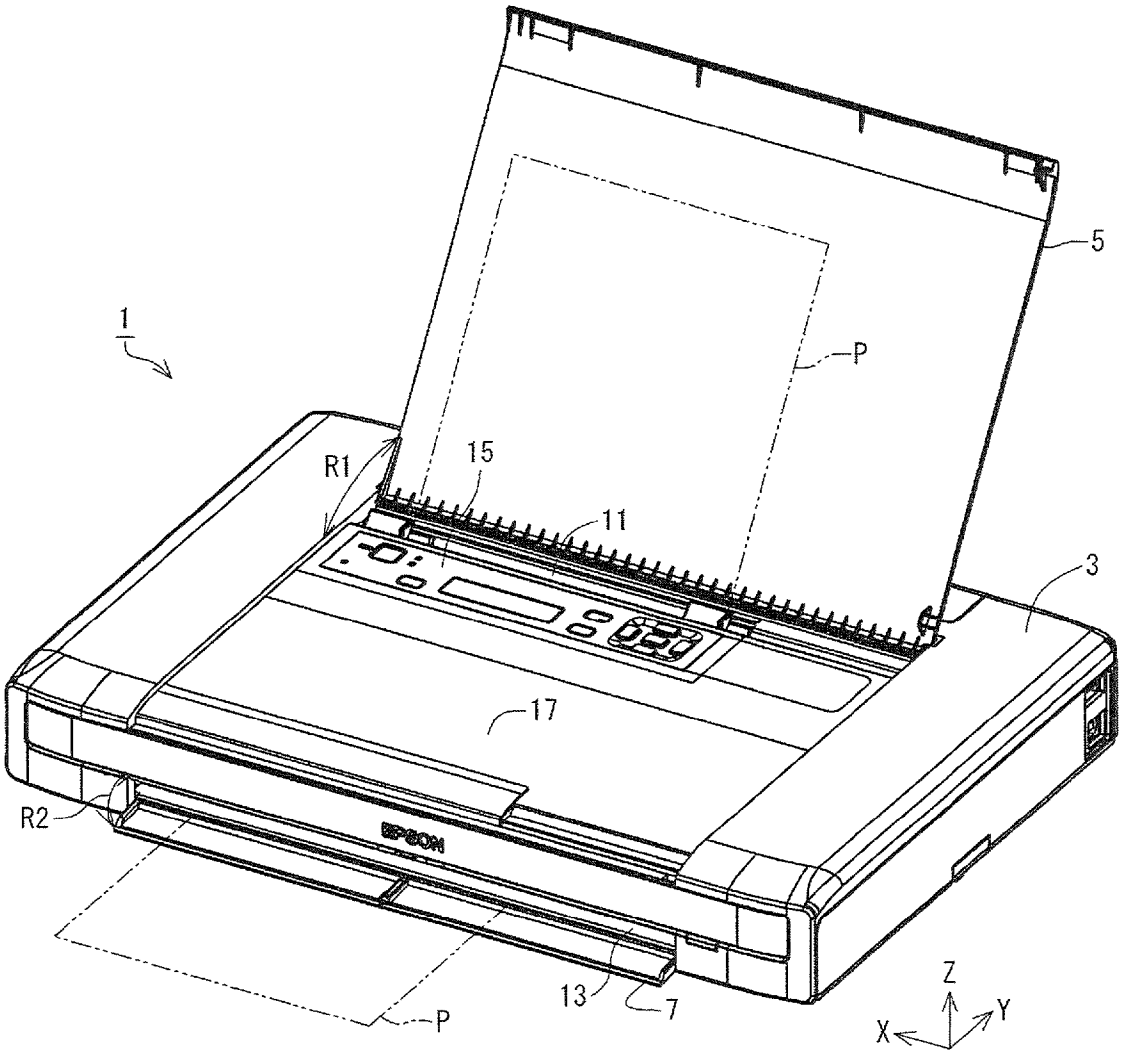
FIG. 2 is a perspective view showing the printer according to the embodiment.

The feed cover 5 is, as shown in FIG. 2, configured to be turnable in an R1 direction in the diagram relative to the casing 3. The feed cover 5 is thereby configured to be openable and closable relative to the casing 3. When the feed cover 5 is in a state of being open relative to the casing 3 (hereinafter, "open state"), recording media P such as recording paper can be introduced into the printer 1 from a feed portion 11. Also, the discharge cover 7 is configured to be rotatable in an R2 direction in the diagram relative to the casing 3. The discharge cover 7 is thereby configured to be openable and closable relative to the casing 3. When the discharge cover 7 is in an open state relative to the casing 3, recording media P can be discharged outside the printer 1 from the discharge unit 13. Note that, in FIG. 2, the feed cover 5 and the discharge cover 7 are shown in the open state. On the other hand, in FIG. 1, the feed cover 5 and the discharge cover 7 are shown in the closed state.

Figure 3:
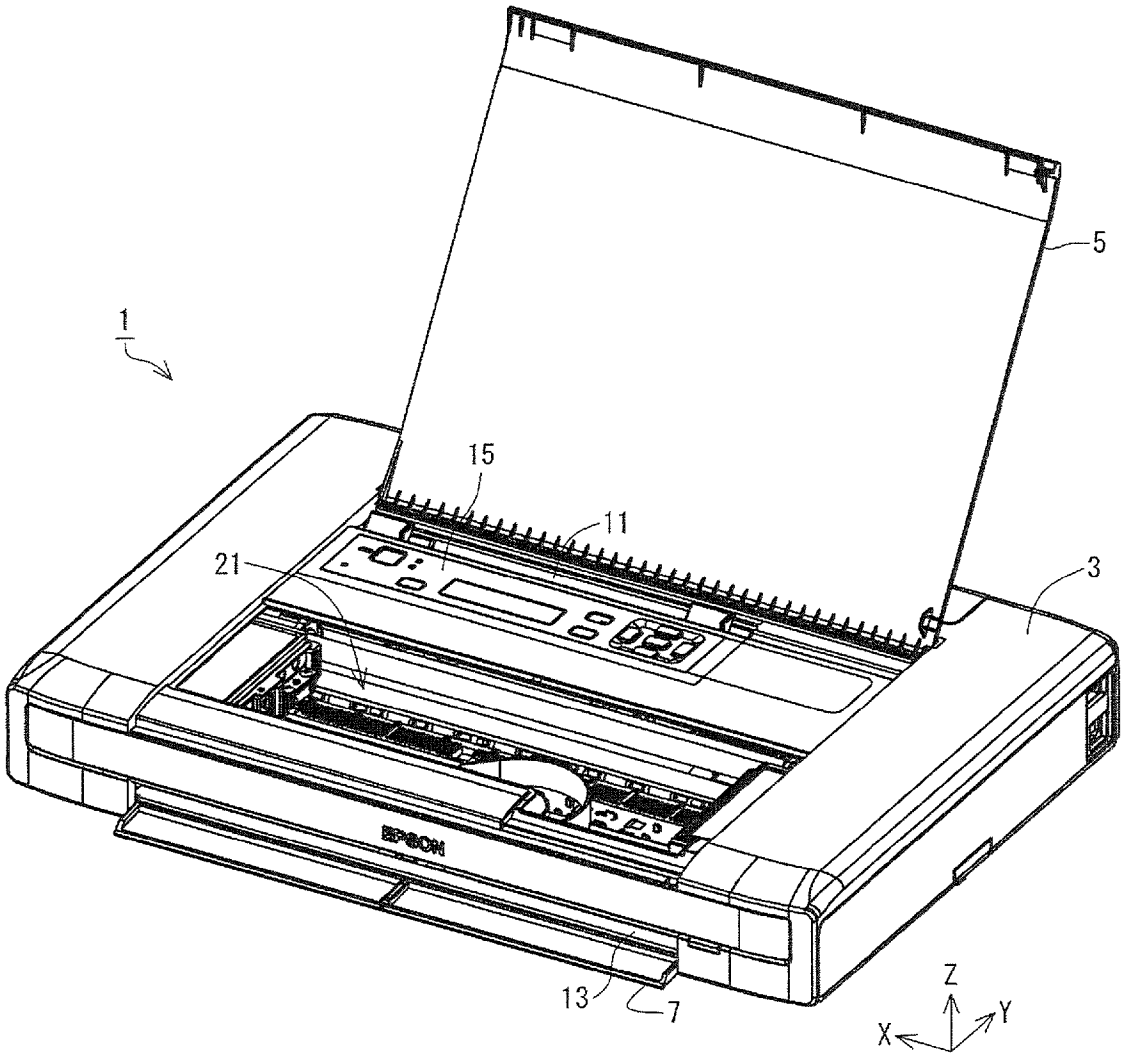
FIG. 3 is a perspective view showing the printer according to the embodiment.

The printer 1 has an operation panel 15 and a protective cover 17, as shown in FIG. 2. A power button, other operation buttons and the like are provided on the operation panel 15. The operator of the printer 1 is able to operate the printer 1 via the power button and other operation buttons when the feed cover 5 is open relative to the casing 3. The protective cover 17 is configured to be openable and closable relative to the casing 3. The protective cover 17 can change from the closed state shown in FIG. 2 to an open state, as shown in FIG. 3. When the protective cover 17 is open, part of an apparatus main body 21 of the printer 1 is exposed.

Figure 4:
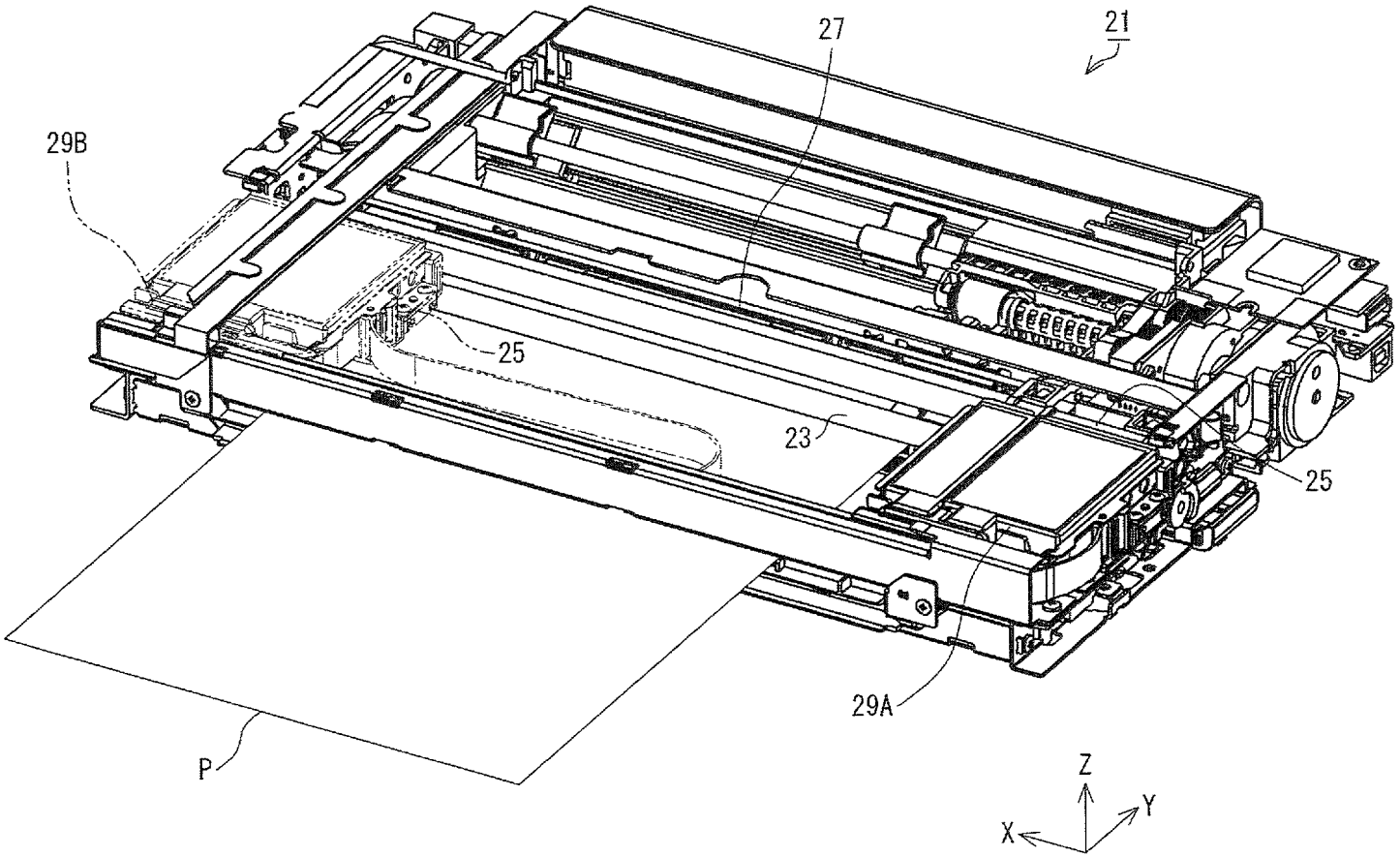
FIG. 4 is a perspective view showing an apparatus main body of the printer according to the embodiment.

The apparatus main body 21 has a conveyance roller 23 and a carriage 25, as shown in FIG. 4. Also, the apparatus main body 21 has a media conveyance mechanism (not shown) and a carriage conveyance mechanism (not shown). The media conveyance mechanism conveys the recording media P in the Y-axis direction by driving the conveyance roller 23 with power from a motor (not shown). The carriage conveyance mechanism conveys the carriage 25 in the X-axis direction by transmitting power from a motor (not shown) to the carriage 25 through a timing belt 27. The carriage conveyance mechanism enables the carriage 25 to reciprocate between a first standby position 29A and a second standby position 29B in the X-axis direction. In the present embodiment, the carriage 25 is movable between the first standby position 29A and the second standby position 29B.

Figure 5:
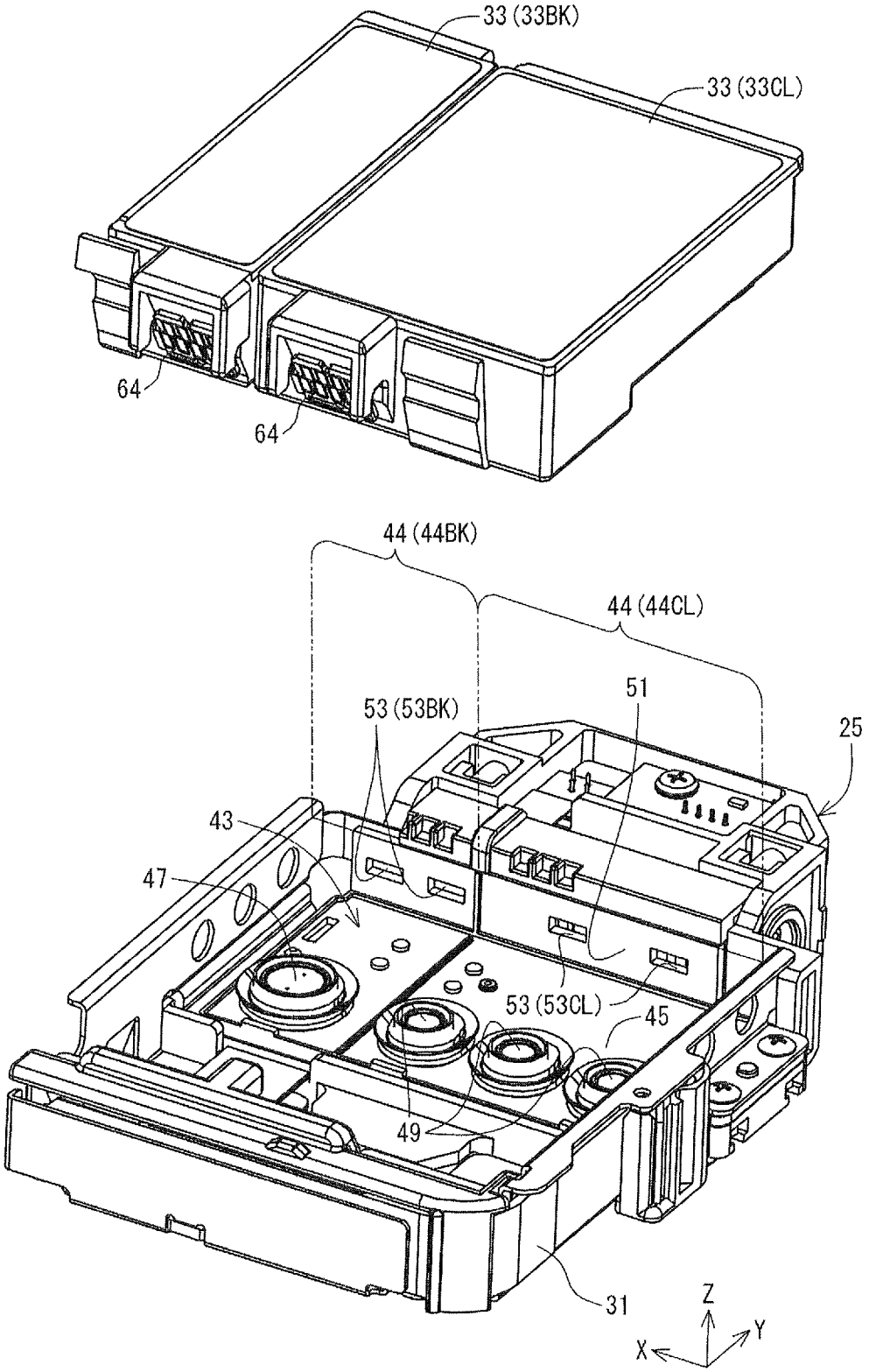
FIG. 5 is a perspective view showing a carriage and cartridges according to the embodiment.

The carriage 25 has a holder 31, as shown in FIG. 5. The holder 31 is capable of mounting a plurality of cartridges 33. In the present embodiment, the holder 31 is capable of mounting two cartridges 33 consisting of a cartridge 33BK and a cartridge 33CL. Each cartridge 33 houses ink, which is an exemplary liquid. The cartridges 33 are configured to be detachable from the holder 31. Note that the cartridge 33BK houses black ink, and the cartridge 33CL houses color ink. In the present embodiment, three types of ink, namely, yellow, magenta and cyan, are employed as color ink.

Figure 6:
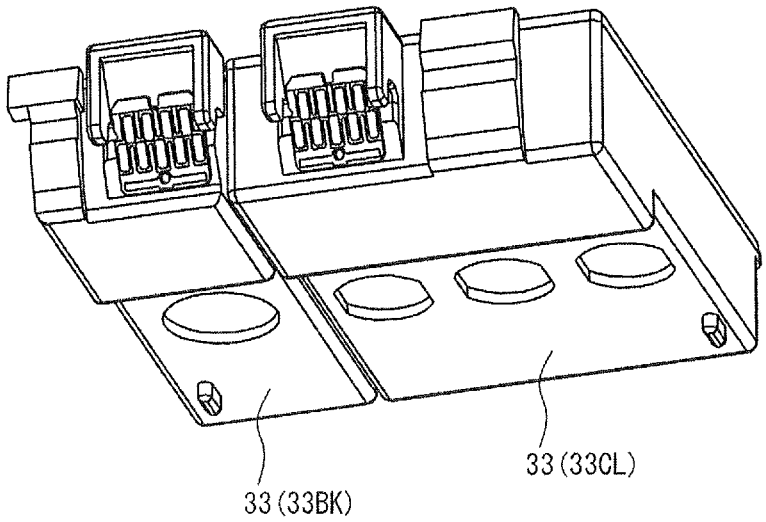
FIG. 6 is a perspective view showing the carriage and the cartridges according to the embodiment.
Figure 6:
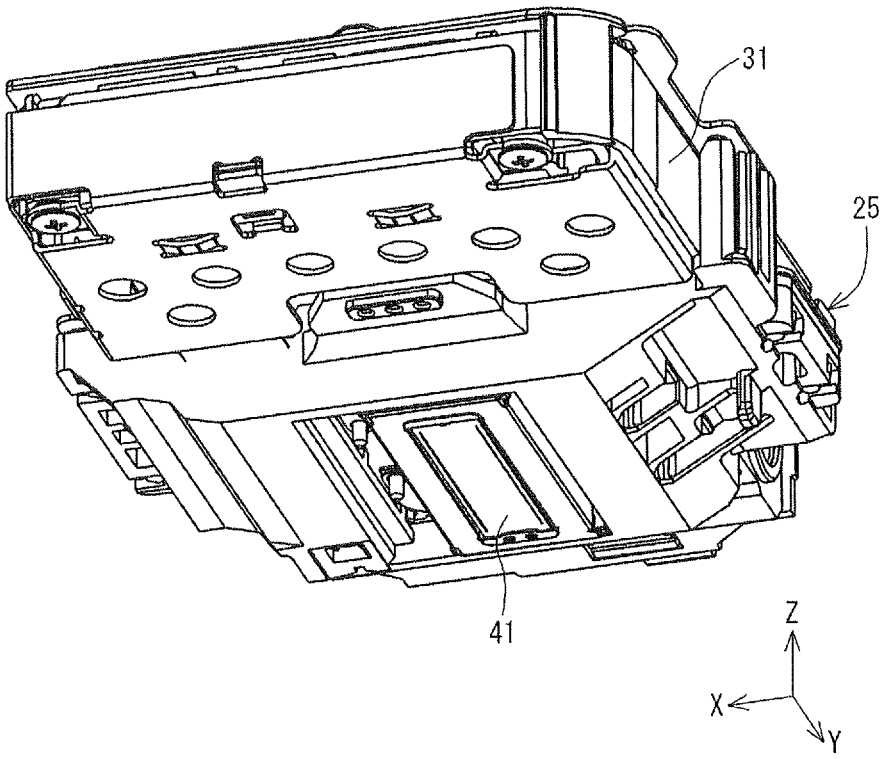

A print head 41 is provided in the holder 31, as shown in FIG. 6, on the opposite side to the cartridge 33 side in the Z-axis direction. In other words, the print head 41 is mounted on the carriage 25. Ink is supplied to the print head 41 from each cartridge 33. The print head 41 ejects ink supplied from the cartridges 33 as ink droplets from nozzles (not shown). As mentioned above, the print head 41 is mounted on the carriage 25. The print head 41 can thus be conveyed in the X-axis direction by the carriage conveyance mechanism via the carriage 25. Printing is performed on the recording media P by ejecting ink droplets from the print head 41 while changing the position of the print head 41 relative to the recording media P, using the media conveyance mechanism and the carriage conveyance mechanism.

Note that, with the printer 1, the direction in which the print head 41 is conveyed via the carriage 25 is defined as the X-axis direction, and the direction in which the recording media P is conveyed is defined as the Y-axis direction. The direction that is orthogonal to both the X-axis direction and the Y-axis direction is the Z-axis direction. When the printer 1 is in the usage state, the X-axis direction and the Y-axis direction are both the horizontal direction and the Z-axis direction is the vertical direction. However, in the following description, the Z-axis direction may be described as a direction that is different from (intersects) the vertical direction.

The holder 31 has a recessed portion 43, as shown in FIG. 5. The cartridges 33 are mounted inside the recessed portion 43 of the holder 31. In the present embodiment, the cartridge 33BK and the cartridge 33CL can be mounted inside the recessed portion 43. In the present embodiment, the two cartridges 33 for mounting inside the recessed portion 43 are mounted in the holder 31 with a gap between the cartridges. Mounting positions 44 respectively corresponding to the cartridge 33BK and the cartridge 33CL for mounting inside the recessed portion 43 are defined within the recessed portion 43. The two mounting positions 44 are aligned in the X-axis direction within the recessed portion 43. In other words, the cartridge 33BK and the cartridge 33CL are mounted inside the recessed portion 43 in a state of being aligned with each other in the X-axis direction. Hereinafter, when separately identifying the two mounting positions 44, the mounting position 44 corresponding to the cartridge 33BK will be denoted as a mounting position 44BK, and the mounting position 44 corresponding to the cartridge 33CL will similarly be denoted as a mounting position 44CL.

Within the recessed portion 43, an inlet portion 47 and three inlet portions 49 are provided on a bottom 45 of the holder 31. The inlet portion 47 is provided in the mounting position 44BK, and the three inlet portions 49 are provided in the mounting position 44CL. The inlet portion 47 thus corresponds to the cartridge 33BK, and the three inlet portions 49 similarly correspond to the cartridge 33CL. The inlet portion 47 and the three inlet portions 49 are aligned in the X-axis direction.

The holder 31 is provided with a plurality of engaging holes 53 in a side wall 51. In the present embodiment, two engaging holes 53 are provided every mounting position 44. In the present embodiment, the four engaging holes 53 are thus provided in the holder 31. The four engaging holes 53 are aligned in the X-axis direction. Hereinafter, when separately identifying the four engaging holes 53 in each of the mounting positions 44, the engaging holes 53 corresponding to the mounting position 44BK will be denoted as engaging holes 53BK, and the engaging holes 53 corresponding to the mounting position 44CL will be denoted as engaging holes 53CL.

Figure 7:
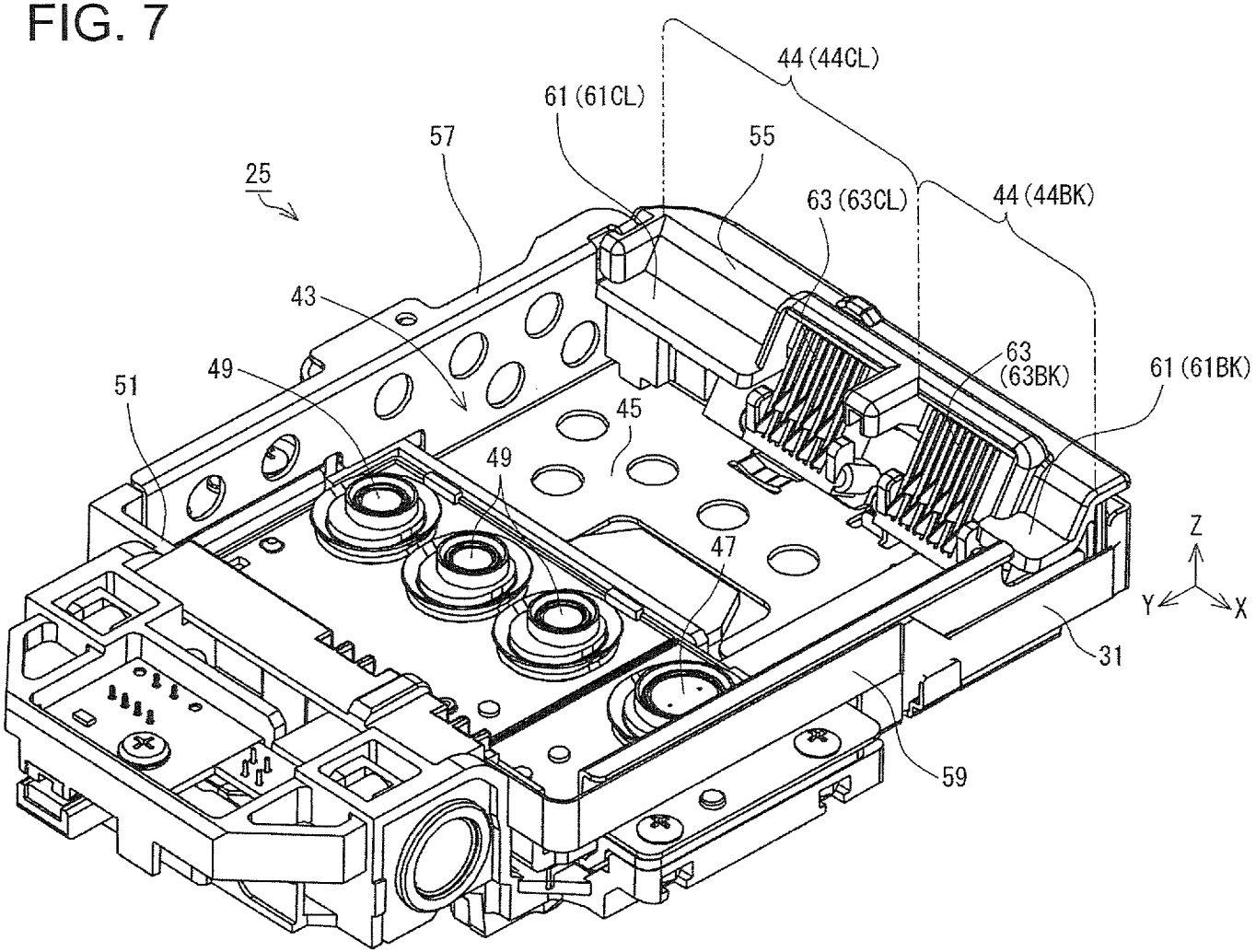
FIG. 7 is a perspective view showing the carriage according to the embodiment.

The holder 31 has, as shown in FIG. 7, a side wall 55 on the opposite side (negative Y-axis direction) to the side wall 51 across the inlet portion 47 and the inlet portions 49 in the Y-axis direction. Also, a side wall 57 and a side wall 59 are provided in positions facing each other in the X-axis direction across the inlet portion 47 and the inlet portions 49. The side wall 57 is located further in the negative X-axis direction than the inlet portion 47 and the inlet portions 49. The side wall 59 is located further in the positive X-axis direction than the inlet portion 47 and the inlet portions 49. The side wall 51, the side wall 55, the side wall 57 and the side wall 59 each project in the positive Z-axis direction from the bottom 45. The bottom 45 is surrounded by the side wall 51, the side wall 55, the side wall 57, and the side wall 59. The recessed portion 43 is thereby partitioned off.

An engagement portion 61 is provided on the side wall 55 every mounting position 44. The two engagement portions 61 are respectively provided on the inlet portion 47 and 49 side (positive Y-axis direction) of the side wall 55. The two engagement portions 61 respectively project toward the inlet portions 47 and 49 from the side wall 55. Hereinafter, when separately identifying the two engagement portions 61, the engagement portion 61 corresponding to the mounting position 44BK will be denoted as an engagement portion 61BK, and the engagement portion 61 corresponding to the mounting position 44CL will be denoted as an engagement portion 61CL. Also, two contact mechanisms 63 are provided on the side wall 55 between the two engagement portions 61. One of the two contact mechanisms 63 is provided in the mounting position 44BK, and the other of the two contact mechanisms 63 is provided in the mounting position 44CL. Hereinafter, when separately identifying the two contact mechanisms 63 in each of the mounting positions 44, the contact mechanism 63 corresponding to the mounting position 44BK will be denoted as a contact mechanism 63BK, and the contact mechanism 63 corresponding to the mounting position 44CL will be denoted as a contact mechanism 63CL.

Here, circuit substrates 64 are provided on the cartridges 33, as shown in FIG. 5. Electrical circuits are provided on the circuit substrates 64. The contact mechanisms 63 are configured to be electrically connectable to the electrical circuits provided on the circuit substrates 64 of the cartridges 33. In a state where the cartridges 33 are mounted in the holder 31, the electrical circuits provided on the circuit substrates 64 of the cartridges 33 are electrically connected to a control circuit (not shown) of the printer 1 through the contact mechanisms 63. Various information is thereby sent between the electrical circuits provided on the circuit substrates 64 of the cartridges 33 and the control circuit of the printer 1.

Figure 8:
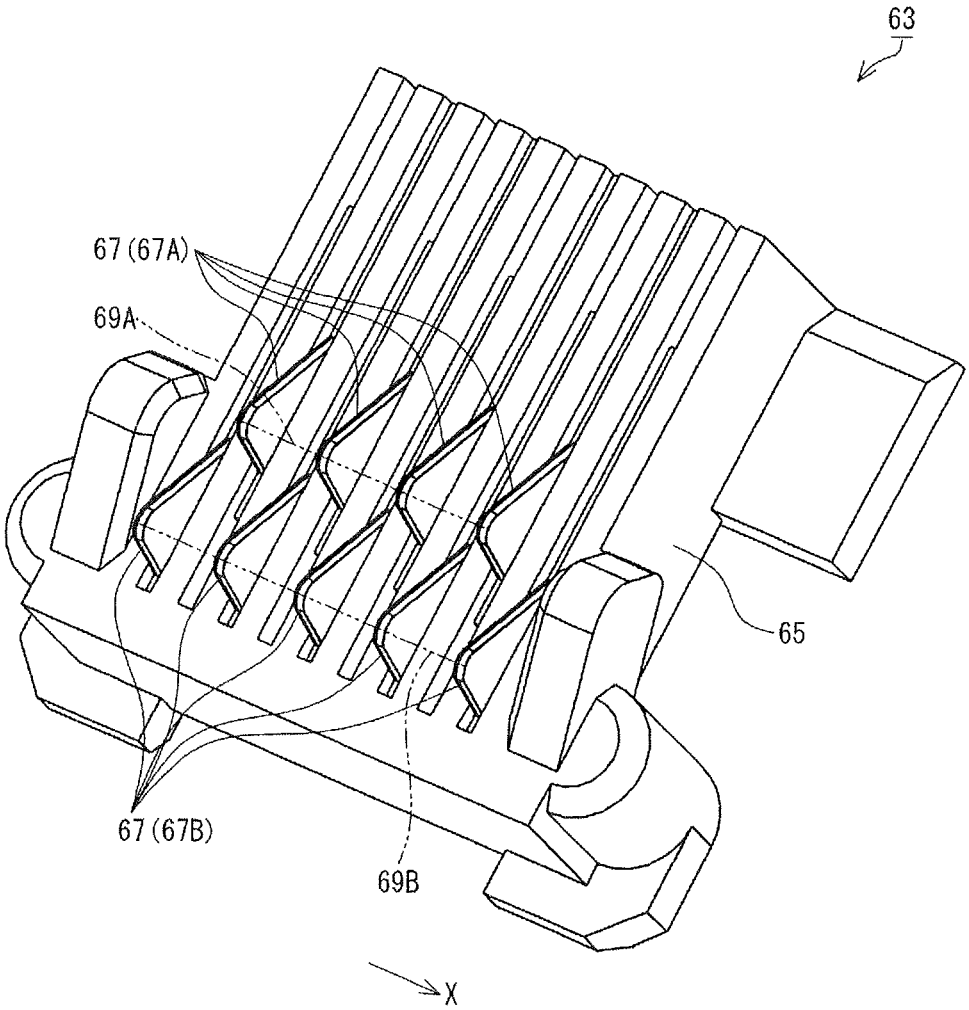
FIG. 8 is a perspective view showing a contact mechanism according to the embodiment.

The contact mechanisms 63 have a terminal block 65 and a plurality of terminals 67 held in the terminal block 65, as shown in FIG. 8. The plurality of terminals 67 respectively have electrical conductivity and elasticity. The plurality of terminals 67 are respectively electrical connection portions. The electrical circuits provided on the circuit substrates 64 of the cartridges 33 are electrically connected to the control circuit (not shown) of the printer 1 through the terminals 67 serving as electrical connection portions. The plurality of terminals 67 are respectively displaced toward the inside of the terminal block when an external force is exerted toward the terminal block 65. The plurality of terminals 67 respectively produce a biasing force in a direction pushing the circuit substrates 64 of the cartridges 33 back (direction including components of the positive Z-axis direction and the positive Y-axis direction), in a state where the cartridges 33 are mounted in the holder 31. That is, a biasing force caused by a reaction force is produced by the plurality of terminals 67 being pushed into the terminal block 65 side by the cartridges 33.

The plurality of terminals 67 include a plurality of terminals 67A aligned in the X-axis direction, and a plurality of terminals 67B aligned in the X-axis direction. The terminals 67A differ in position from the terminals 67B in the Z-axis direction, with the plurality of terminals 67A constituting a first terminal sequence 69A, and the plurality of terminals 67B constituting a second terminal sequence 69B. The first terminal sequence 69A differs in position from the second terminal sequence 69B in the Z-axis direction. In the present embodiment, the first terminal sequence 69A is located further in the positive Z-axis direction than the second terminal sequence 69B.

Figure 9:
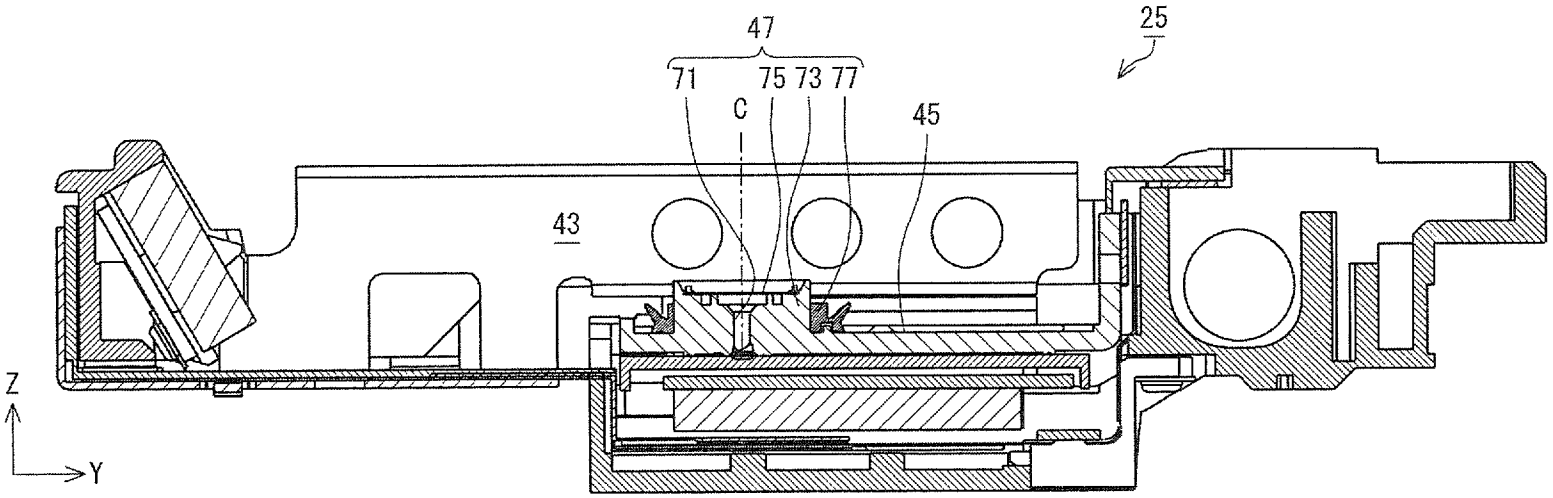
FIG. 9 is a cross-sectional view showing a carriage according to the embodiment.

The inlet portion 47 is provided on the bottom 45 of the holder 31, as shown in FIG. 9, which is a cross-sectional view of the carriage 25. Note that the cross-section shown in FIG. 9 cuts the carriage 25 in a YZ plane that passes through the inlet portion 47. The inlet portion 47 includes a channel 71, a bank portion 73, a filter 75 and packing 77. The channel 71 is a passage for ink supplied from the cartridge 33, and is provided as an opening that passes through the bottom 45. The bank portion 73 is provided on the bottom 45, and projects in a raised manner from the bottom 45 in the positive Z-axis direction. When looking at the bottom 45 in plan view, the bank portion 73 annularly surrounds the channel 71 on the inside the recessed portion 43. The bank portion 73 is thus tubular in shape.

In the present embodiment, the direction in which the tubular bank portion 73 extends, that is, the direction in which the channel 71 extends, is the Z-axis direction. In other words, a central axis C of the channel 71 extends in the Z-axis direction. Note that the central axis C extends in the mounting direction in which the cartridges 33 are mounted in the holder 31. When mounting the cartridges 33 in the holder 31, the cartridges 33 are displaced in the direction in which the central axis C extends.

The filter 75 is provided on the inside of the bank portion 73, and covers the opening on the recessed portion 43 side of the channel 71 from the recessed portion 43 side. The packing 77 is provided on the bottom 45, and surrounds the bank portion 73 on the inside of the recessed portion 43. The packing 77 is constituted by a material having elasticity such as rubber or elastomer, for example. Note that the inlet portions 49 have a similar configuration to the inlet portion 47. That is, similarly to the inlet portion 47, the inlet portions 49 have a channel 71, a bank portion 73, a filter 75, and a packing 77. Hereinafter, constituent elements of the inlet portions 49 that are the same as the inlet portion 47 will thus be given the same reference numerals and a detailed description thereof will be omitted.

Figure 10:
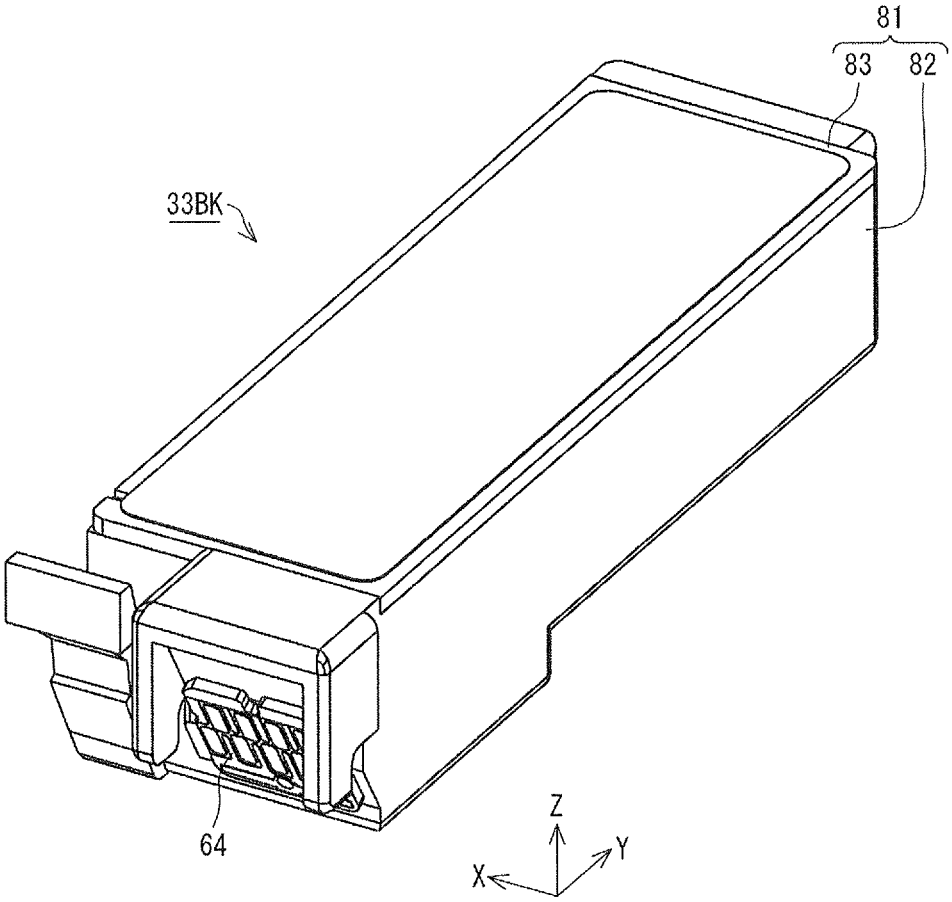
FIG. 10 is a perspective view showing a cartridge according to the embodiment.
Figure 11:
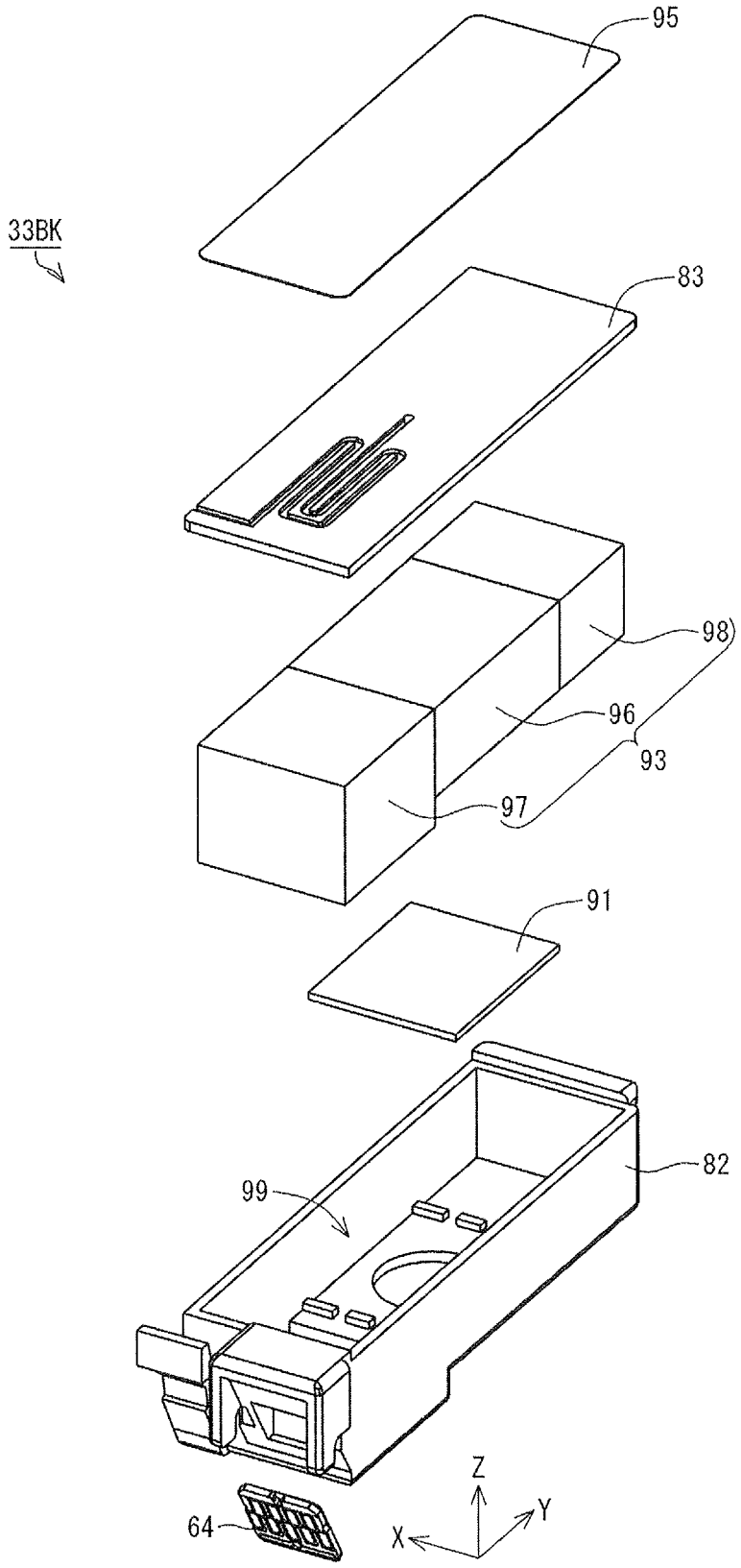
FIG. 11 is an exploded perspective view showing a cartridge according to the embodiment.

The cartridge 33BK has a casing 81, as shown in FIG. 10. The casing 81 constitutes an outer shell of the cartridge 33BK. The casing 81 includes a first casing 82 and a second casing 83. In the present embodiment, the outer shell of the cartridge 33BK is constituted by the first casing 82 and the second casing 83. Also, the cartridge 33BK has a filter 91, a holding member 93, and a sheet member 95, as shown in FIG. 11. The first casing 82 is shaped like a container and has a recessed portion 99. The filter 91 and the holding member 93 are housed inside the recessed portion 99. The second casing 83 blocks off the recessed portion 99 from the positive Z-axis direction, in a state where the filter 91 and the holding member 93 are housed in the recessed portion 99 of the first casing 82. Ink is housed in the recessed portion 99 of the cartridge 33BK. The recessed portion 99 is thus a housing portion for housing ink.

Figure 12:
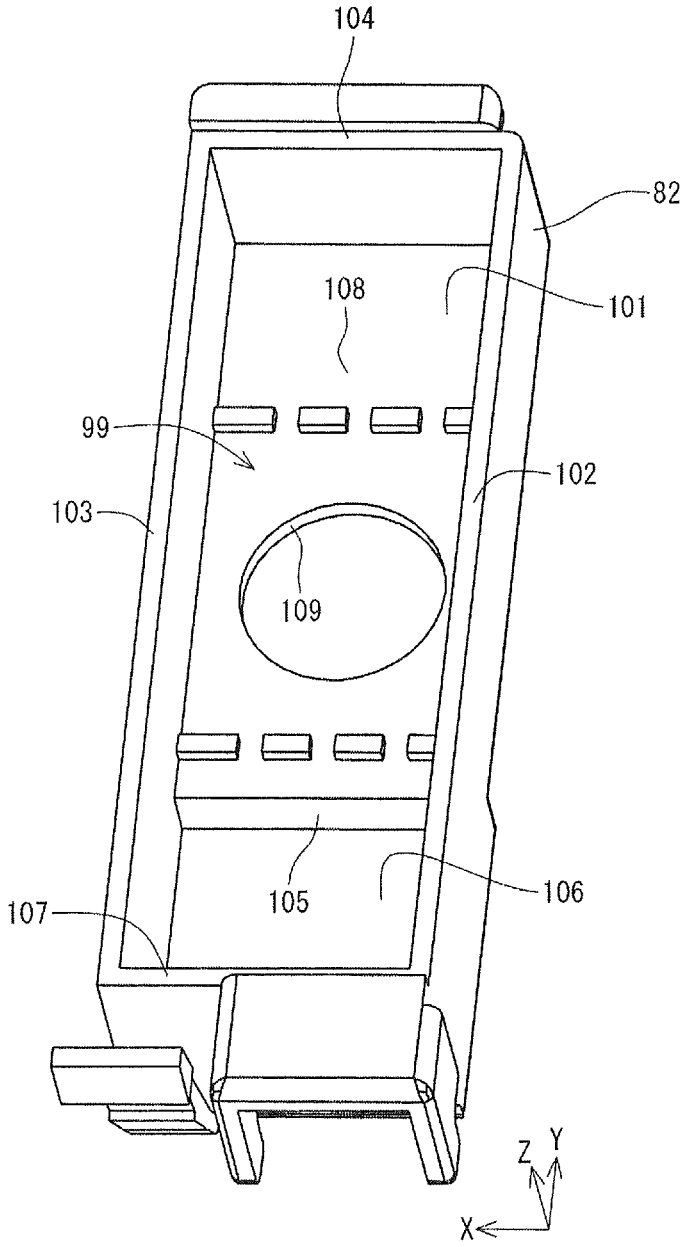
FIG. 12 is a perspective view showing the first casing according to the embodiment.

The first casing 82 has a first wall 101, a second wall 102, a third wall 103, a fourth wall 104, a fifth wall 105, a sixth wall 106 and a seventh wall 107, as shown in FIG. 12. The second wall 102 to the fourth wall 104 respectively intersect the first wall 101. The second wall 102 to the fourth wall 104 respectively project from the first wall 101 in the positive Z-axis direction, that is, from the first wall 101 toward the second casing 83 (FIG. 11) side. The second wall 102 and the third wall 103 are provided in positions facing each other across the first wall 101 in the X-axis direction. The second wall 102 and the third wall 103 oppose each other. The fourth wall 104 intersects the second wall 102. Also, the fourth wall 104 intersects the third wall 103 on the opposite side to the second wall 102 side.

The fifth wall 105 is provided on the opposite side of the first wall 101 to the fourth wall 104 side. The fourth wall 104 and the fifth wall 105 are provided in positions facing each other across the first wall 101 in the Y-axis direction. The fifth wall 105 projects from the first wall 101 in the negative Z-axis direction, that is, from the first wall 101 toward the opposite side to the second casing 83 (FIG. 11) side. Within the recessed portion 99, the fifth wall 105 drops down from the first wall 101 in the negative Z-axis direction. The sixth wall 106 is provided on the opposite side of the fifth wall 105 to the first wall 101 side. The first wall 101 and the sixth wall 106 are aligned with each other in the Y-axis direction.

The sixth wall 106 extends from the fifth wall 105 in the negative Y-axis direction. The sixth wall 106 is located further in the negative Z-axis direction than the first wall 101, that is, further on the opposite side to the second casing 83 (FIG. 11) side than the first wall 101. A difference in levels is provided between the first wall 101 and the sixth wall 106. The first wall 101 and the sixth wall 106 are connected by the fifth wall 105. Note that the second wall 102 and the third wall 103 respectively intersect both the fifth wall 105 and the sixth wall 106.

The seventh wall 107 is provided on the opposite side of the sixth wall 106 to the fifth wall 105 side. The seventh wall 107 projects from the sixth wall 106 in the positive Z-axis direction, that is, from the sixth wall 106 toward to the second casing 83 (FIG. 11) side. The seventh wall 107 is provided in a position facing the fourth wall 104 across the first wall 101, the fifth wall 105 and the sixth wall 106 in the Y-axis direction. The fourth wall 104 and the seventh wall 107 oppose each other. Also, the second wall 102 and the third wall 103 respectively intersect the seventh wall 107. Note that, in the present embodiment, the seventh wall 107 corresponds to the outer wall.

With the above configuration, the first wall 101, the fifth wall 105 and the sixth wall 106 are surrounded by the second wall 102, the third wall 103, the fourth wall 104 and the seventh wall 107. The second wall 102 to the fourth wall 104 project from the first wall 101 in the positive Z-axis direction. Also, the seventh wall 107 projects from the sixth wall 106 in the positive Z-axis direction. The first casing 82 is thus constituted in a recessed shape by the second wall 102, the third wall 103, the fourth wall 104 and the seventh wall 107, with the first wall 101 and the sixth wall 106 as a bottom 108.

The recessed portion 99 is constituted by the first wall 101 to the seventh wall 107. The recessed portion 99 is configured so as to be recessed in the negative Z-axis direction. The recessed portion 99 is open in the positive Z-axis direction, that is, toward the second casing 83 side. The first wall 101 is provided with a supply hole 109 that passes through the first wall 101. The supply hole 109 passes through from the inside of the recessed portion 99 to the outside of the casing 81. Ink housed in the recessed portion 99 is ejected outside the cartridges 33 from the supply hole 109.

Note that the surfaces of the first wall 101 to the seventh wall 107 on the inside of recessed portion 99 are respectively generally planar surfaces. Also, the surfaces of the first wall 101 to the seventh wall 107 on the outside of the recessed portion 99 are respectively generally planar surfaces. "Generally planar surface" includes a surface that is completely flat and a surface that is partially uneven. In other words, a generally planar surface includes a surface or wall constituting the outer shell of the cartridges 33 that can be gripped even if part of the surface has slight unevenness. Outer shapes of the first wall 101 and the fourth wall 104 to the seventh wall 107 in plan view are respectively all quadrilaterals (rectangles). The second wall 102 and the third wall 103 respectively have outer shapes that depend on the difference in levels between the first wall 101 and the sixth wall 106. However, the invention is not limited to above configuration, and curved surfaces can also be respectively employed as the surfaces of the first wall 101 to the seventh wall 107 on the inside of the recessed portion 99 and the surfaces of the first wall 101 to the seventh wall 107 on the outside of the recessed portion 99.

Figure 13:
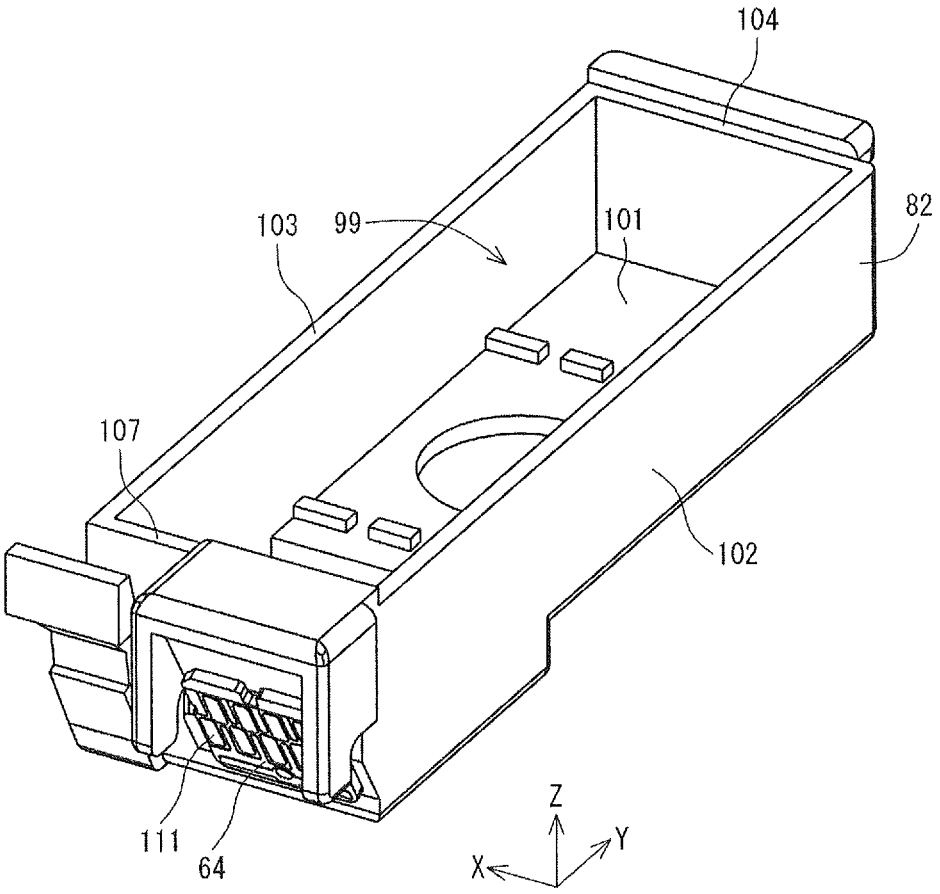
FIG. 13 is a perspective view showing the first casing and a circuit substrate according to the embodiment.

The aforementioned circuit substrate 64 is, as shown in FIG. 13, provided on the opposite side of the seventh wall 107 to the recessed portion 99 side, that is, on the outside of the recessed portion 99. A plurality of electrodes 111 are provided on the surface of the circuit substrate 64 on the opposite side to the surface on the recessed portion 99 side. In the present embodiment, electrodes 111 corresponding in number to the number of terminals 67 provided in the contact mechanism 63 (FIG. 8) are provided on the circuit substrate 64. In the present embodiment, the plurality of electrodes 111 respectively correspond to the plurality of terminals 67. However, the number of the electrodes 111 is not limited thereto, and may be more or less than the number of terminals 67. The plurality of electrodes 111 respectively incline relative to the Z-axis direction, as shown in FIG. 13. The respective electrodes 111 incline relative to each of the XZ plane, the YZ plane and the XY plane. In the present embodiment, the inclination of the respective electrodes 111 is realized by inclining the circuit substrate 64 relative to each of the XZ plane, the YZ plane, and the XY plane.

Figure 14:
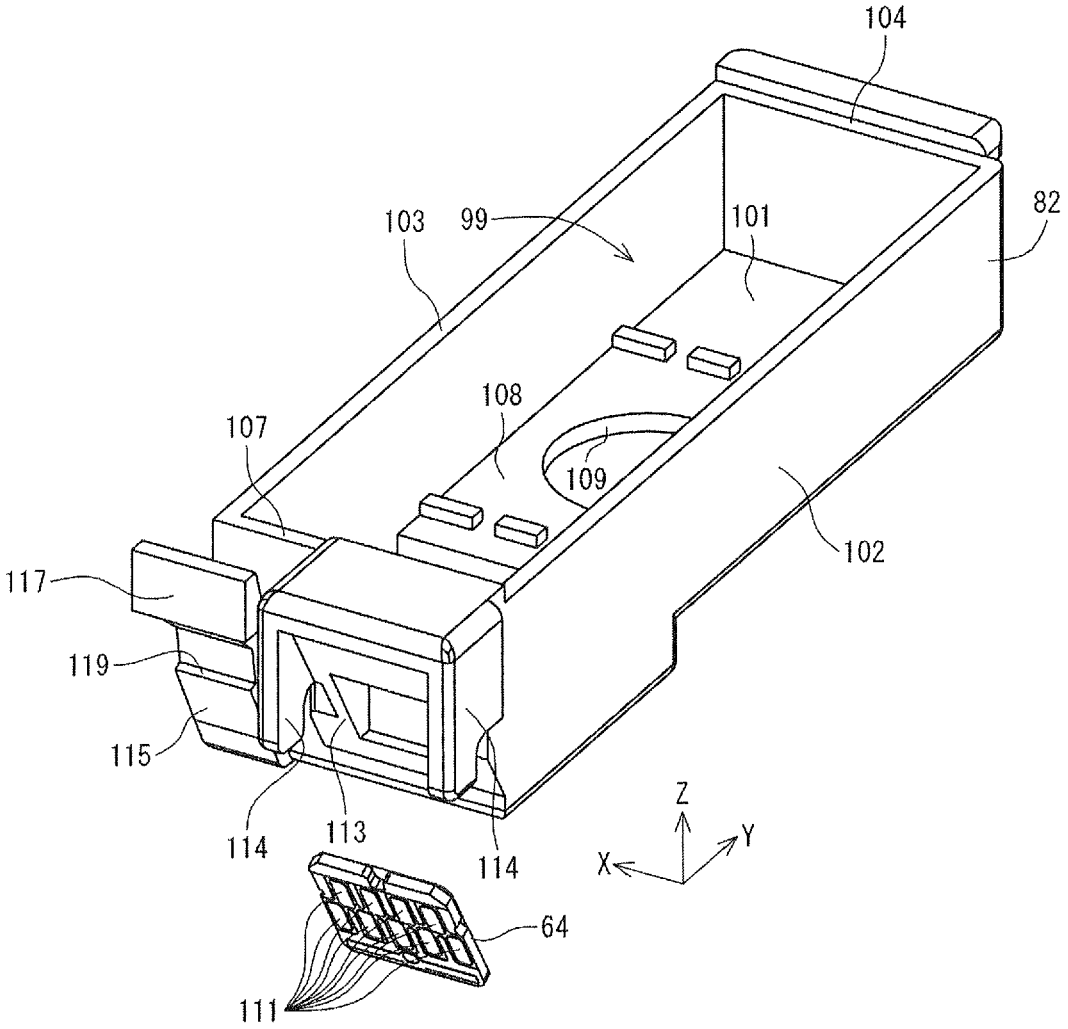
FIG. 14 is an exploded perspective view showing the first casing and the circuit substrate according to the embodiment.

A substrate installation portion 113 is provided on the seventh wall 107 on the outside of the recessed portion 99, as shown in FIG. 14. The substrate installation portion 113 projects from the seventh wall 107 in the opposite direction to the recessed portion 99 side, that is, away from the recessed portion 99. Also, a cover 114 that covers the substrate installation portion 113 is provided on the seventh wall 107. The cover 114 projects from the seventh wall 107 in the opposite direction to the recessed portion 99 side, that is, away from the recessed portion 99. The cover 114 surrounds the substrate installation portion 113 from three directions, namely, the positive Z-axis direction, the positive X-axis direction and the negative X-axis direction of the substrate installation portion 113. The substrate installation portion 113 inclines relative to the XZ plane, the YZ plane and the XY plane. In the present embodiment, the inclination of the circuit substrate 64 is realized by the inclination of the substrate installation portion 113. That is, in the present embodiment, the inclination of the plurality of electrodes ill is realized by the inclination of the substrate installation portion 113.

The substrate installation portion 113 inclines so as to approach the recessed portion 99 side in the depth direction of the recessed portion 99, from the opening of the recessed portion 99 toward the bottom 108 side, that is, in the negative Z-axis direction. From another viewpoint, the substrate installation portion 113 inclines so as to approach the recessed portion 99 side, that is, toward the inside of the cartridge 33, as the cartridge 33 approaches the bottom 45 (FIG. 9), in the mounting direction in which the cartridge 33 is mounted in the holder 31. The substrate installation portion 113 thus faces in the negative Z-axis direction and the negative Y-axis direction. This configuration results in the plurality of electrodes 111 inclining toward the inside of the cartridge 33, as the cartridge 33 approaches the bottom 45 (FIG. 9), in the mounting direction in which the cartridge 33 is mounted in the holder 31.

In the present embodiment, the plurality of electrodes 111 incline toward the inside of the cartridge 33, in the direction in which the cartridge 33 is mounted in the holder 31. As a result of the plurality of electrodes 111 inclining relative to the mounting direction, the dimensions of the cartridge 33 in the mounting direction (Z-axis direction in the present embodiment) is thus more readily reduced, while maintaining the area of the electrodes 111. The cartridge 33 is thereby more readily miniaturized. Note that, in the present embodiment, a configuration in which the plurality of electrodes 111 are provided on the circuit substrate 64 is employed. However, a configuration in which the circuit substrate 64 is omitted, and the plurality of electrodes 111 are provided directly on the substrate installation portion 113 can also be employed. This configuration enables the number of component to be reduced and a reduction in the size of the cartridge 33 to be achieved.

Figure 15:
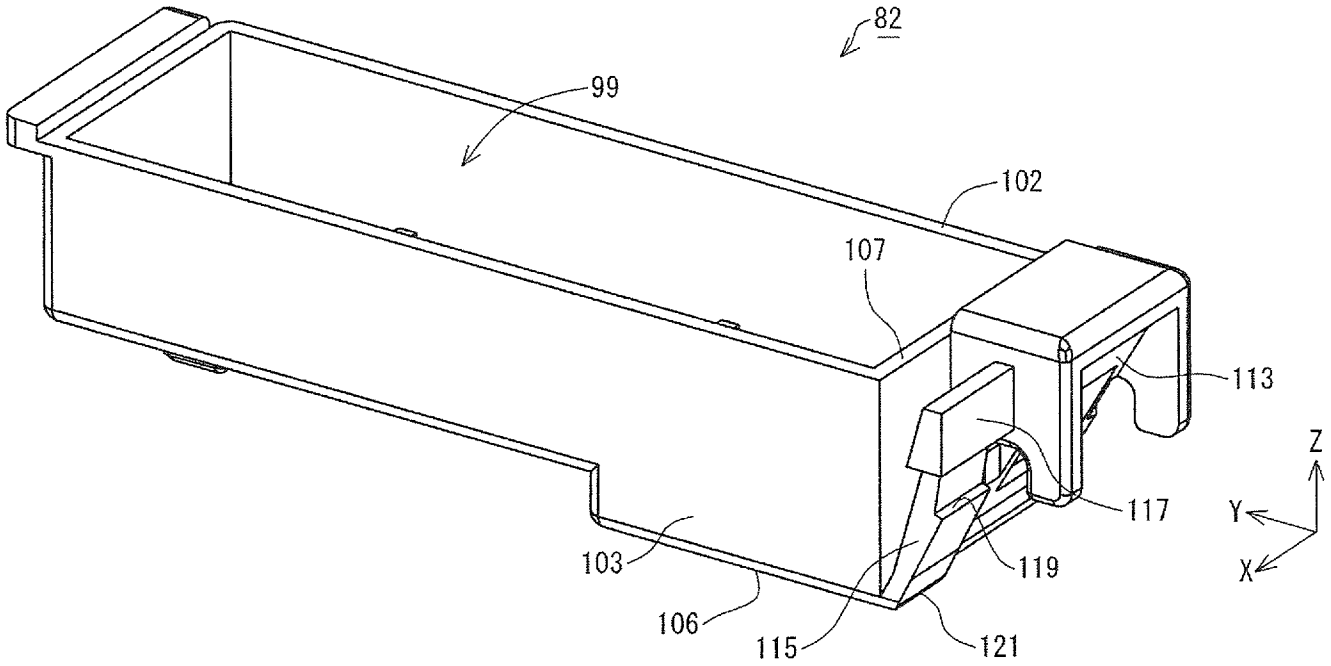
FIG. 15 is a perspective view showing the first casing according to the embodiment.

A lever 115 is provided, as shown in FIG. 14, on the opposite side of the seventh wall 107 to the recessed portion 99 side, that is, on the outside of the recessed portion 99. The lever 115 is integrally formed within the first casing 82, and projects from the first casing 82. The lever 115 has elasticity and is able to bend (elastically deform) so as to approach the seventh wall 107. The lever 115 has a gripping portion 117 and an engaging portion 119. In the present embodiment, the lever 115 projects from the seventh wall 107, as shown in FIG. 15. The lever 115 and the seventh wall 107 are constituted integrally with each other via a joining portion 121 that joins the lever 115 and the seventh wall 107. The lever 115 extends in the positive Z-axis direction with a gap between the lever 115 and the seventh wall 107.

The gripping portion 117 is provided at the other end of the lever 115 on the opposite side to the joining portion 121 side. The engaging portion 119 is located between the joining portion 121 and the gripping portion 117 of the lever 115. The engaging portion 119 projects from the lever 115 toward the opposite side to the seventh wall 107 side, that is, from the seventh wall 107 in the negative Y-axis direction. Due to the engaging portion 119, the lever 115 has a step. The cartridge 33 is fixed to the holder 31 by the engagement portion 61 (FIG. 7) of the holder 31 engaging this step. Note that, in the present embodiment, the lever 115 projects from the seventh wall 107. However, the configuration of the lever 115 was not limited thereto, and a configuration in which the lever 115 projects from the sixth wall 106 or the third wall 103, for example, can also be employed.

Figure 16:
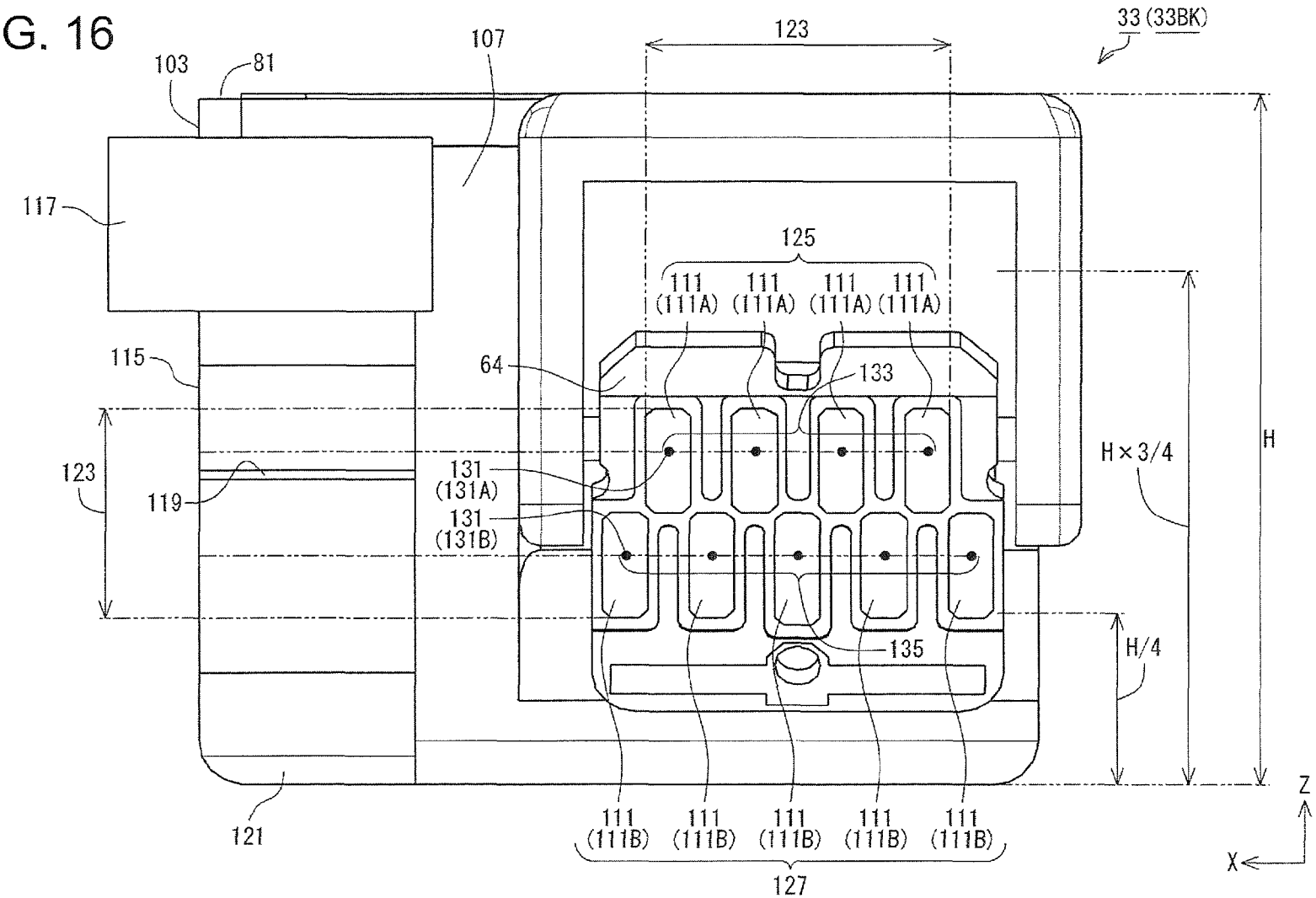
FIG. 16 is a front view showing a cartridge according to the embodiment.

The lever 115 is aligned with the circuit substrate 64 in the X-axis direction when the seventh wall 107 is seen in plan view, as shown in FIG. 16. The lever 115 is located further in the positive X-axis direction than the circuit substrate 64. The engaging portion 119 is located within the range of an electrode area 123 in the Z-axis direction. From another viewpoint, the engaging portion 119 is located within the range of the electrode area 123 in the mounting direction in which the cartridge 33 is mounted in the holder 31. The electrode area 123 is the area in which all the electrodes 111 are provided, and encompasses all the electrodes 111 with the shortest circumferential length. Because the engaging portion 119 is located within the range of the electrode area 123 in the mounting direction, the distance between the electrode area 123 and the engaging portion 119 in the mounting direction can be shortened. Error in the position of the electrodes 111 relative to the terminals 67 can thus be reduced. The reliability of the electrical connection between the terminal 67 and the electrodes 111 is thereby more readily secured. Also, because the position of the engaging portion 119 relative to the plurality of electrodes 111 falls within the range of the electrode area 123 in the mounting direction, the distance between the plurality of electrodes 111 and the engaging portion 119 in the mounting direction can be shortened. The cartridge 33 is thus more readily miniaturized in the mounting direction. As a result, according to the present embodiment, the cartridge 33 is more readily made thinner in the mounting direction, while securing the reliability of the electrical connection between the terminal 67 and the electrodes 111.

The gripping portion 117 is provided across an area straddling the third wall 103 in the X-axis direction. The gripping portion 117 extends from the circuit substrate 64 side of the third wall 103, past the third wall 103, to the opposite side to the circuit substrate 64 side of the third wall 103. In other words, the gripping portion 117 protrudes beyond the casing 81 in the X-axis direction. The main body of the lever 115 including the engaging portion 119 and the joining portion 121 falls within an area that overlaps with the casing 81 in the X-axis direction. The gripping portion 117 is thus wider than the engaging portion 119 in the X-axis direction. In the present embodiment, because the gripping portion 117 projects from the casing 81 in the X-axis direction, the gripping portion 117 is more readily made larger in the X-axis direction. The operability of the lever 115 is thereby more readily improved.

In the present embodiment, a plurality of all of the electrodes 111 constitute a first electrode sequence 125, as shown in FIG. 16. Also, the remaining plurality of electrodes 111 constitute a second electrode sequence 127. In the present embodiment, four electrodes 111 belong to the first electrode sequence 125, and five electrodes 111 belong to the second electrode sequence 127. Hereinafter, when separately identifying the electrodes 111 belonging to the first electrode sequence 125 and the electrodes 111 belonging to the second electrode sequence 127, the electrodes 111 belonging to the first electrode sequence 125 will be denoted as electrodes 111A, and the electrodes 111 belonging to the second electrode sequence 127 will be denoted as electrodes 111B.

Figure 17:
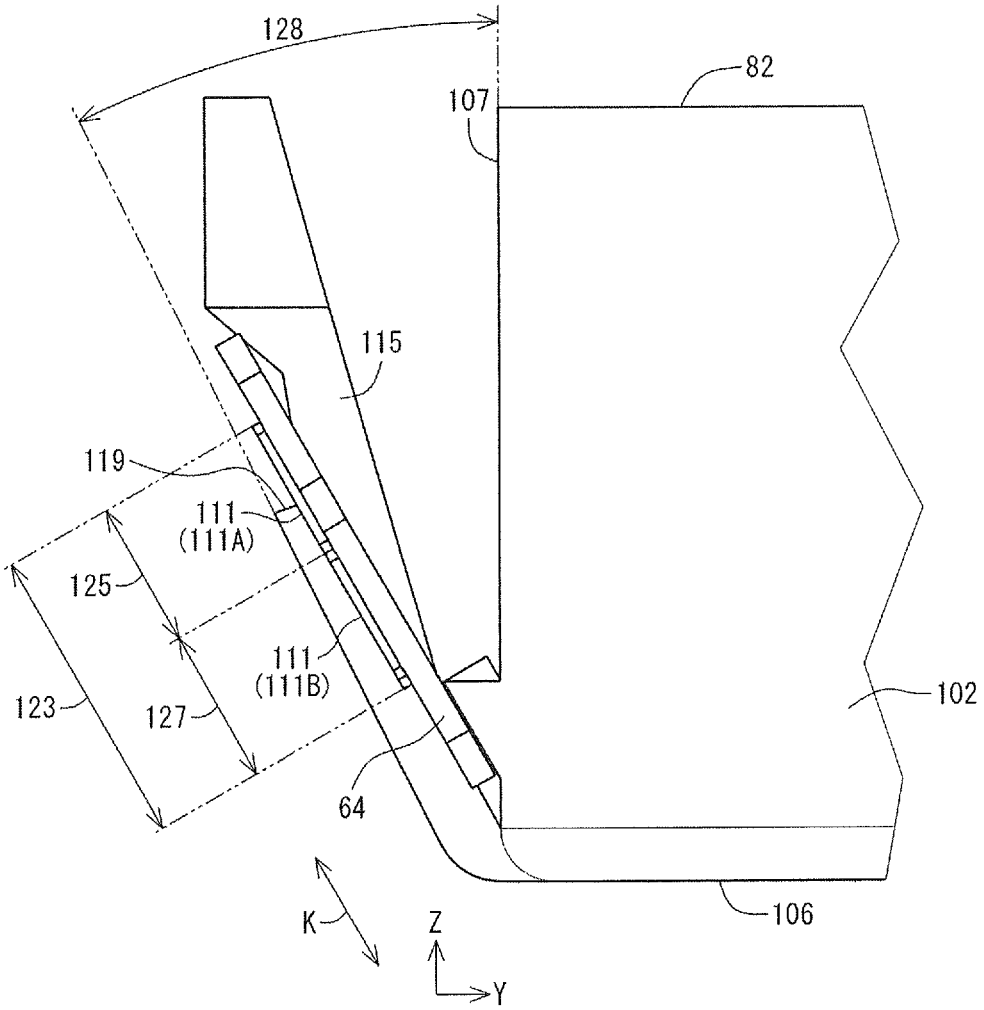
FIG. 17 is a side view showing the first casing and the circuit substrate according to the embodiment.

The first electrode sequence 125 and the second electrode sequence 127 are aligned in an inclination direction K serving as a second direction, as shown in FIG. 17. The inclination direction K is the direction in which the electrodes 111 incline. Note that, in FIG. 17, the substrate installation portion 113 (FIG. 14) is omitted in order to show the configuration in an easily understandable manner. In the present embodiment, as shown in FIG. 17, the plurality of electrodes 111 overlap with the lever 115 when seen in the X-axis direction which serves as the first direction, that is, when the second wall 102 or the third wall 103 is seen in plan view. A state where the second wall 102 is seen in plan view is shown in FIG. 17.

In the present embodiment, because the plurality of electrodes 111 overlap with the lever 115, the electrode area 123 can be superimposed on an operational area 128 of the lever 115. The electrode area 123 can thereby be secured using the operational area 128 of the lever 115. As a result, effective utilization of the area is more readily achieved. Also, when the plurality of electrodes 111 overlap with the lever 115, the plurality of electrodes 111 and the circuit substrate 64 are more readily protected by the lever 115. The plurality of electrodes 111 or the circuit substrate 64 knocking against something in the X-axis direction is more readily avoided because of the lever 115. Also, foreign substances such as dust or dirt adhering to the plurality of electrodes ill or the circuit substrate 64 in the X-axis direction is more readily avoided because of the lever 115.

In the present embodiment, the substrate installation portion 113 and the lever 115 respectively project from the seventh wall 107 in the opposite direction to the recessed portion 99 side, that is, away from the recessed portion 99 (FIG. 15). The plurality of electrodes 111 can thereby be disposed so as to project from the seventh wall 107 away from the recessed portion 99, in the area aligned with the operational area 128 of the lever 115 in the X-axis direction. Because the capacity of the recessed portion 99 is thereby more readily expanded, the amount of ink housed is more readily increased.

The plurality of electrodes 111 each have a contact portion 131, as shown in FIG. 16. The contact portions 131 are areas that contact the terminals 67 of the contact mechanism 63 (FIG. 8), in a state where the cartridge 33 is mounted in the holder 31. Hereinafter, when separately identifying the plurality of contact portions 131 between the electrodes 111A and the electrodes 111B, the contact portions 131 of the electrodes 111A will be denoted as contact portions 131A, and the contact portions 131 of the electrodes 111B will be denoted as contact portions 131B. The plurality (four in the present embodiment) of contact portions 131A belonging to the first electrode sequence 125 are arrayed in the X-axis direction. The plurality of contact portions 131A belonging to the first electrode sequence 125 constitute a first array 133.

Also, the plurality (five in the present embodiment) of contact portions 131B belonging to the second electrode sequence 127 are arrayed in the X-axis direction. The plurality of contact portions 131B belonging to the second electrode sequence 127 constitute a second array 135. The first array 133 and the second array 135 are aligned in the inclination direction K (FIG. 17).

In the present embodiment, all the contact portions 131 are located within a range from one quarter to three quarters of the height of the cartridge 33 in the Z-axis direction, as shown in FIG. 16. When the height of the cartridges 33 in the Z-axis direction is H, the position of the respective contact portions 131 in the Z-axis direction is higher than H/4 and lower than 3H/4. The engaging portion 119 is located between the first array 133 and the second array 135 in the mounting direction in which the cartridge 33 is mounted in the holder 31 (coincides with Z-axis direction in the present embodiment).

Figure 18:
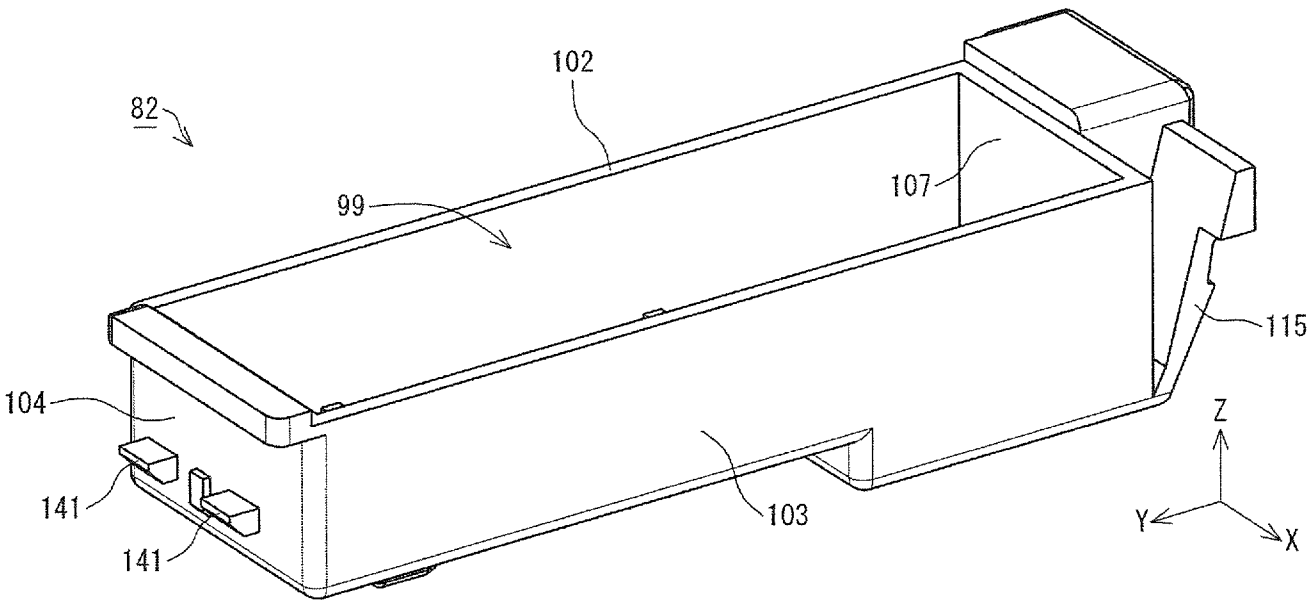
FIG. 18 is a perspective view showing the first casing according to the embodiment.

Two second engaging portions 141 are provided on the fourth wall 104 of the first casing 82, as shown in FIG. 18. The two second engaging portions 141 are provided on the opposite side of the fourth wall 104 to the recessed portion 99 side, that is, on the outside of the recessed portion 99. The two second engaging portions 141 project from the fourth wall 104 in the opposite direction to the recessed portion 99 side, that is, from the fourth wall 104 in the positive Y-axis direction. The two second engaging portions 141 can also be described as projecting from the fourth wall 104 away from the recessed portion 99.

Figure 19:
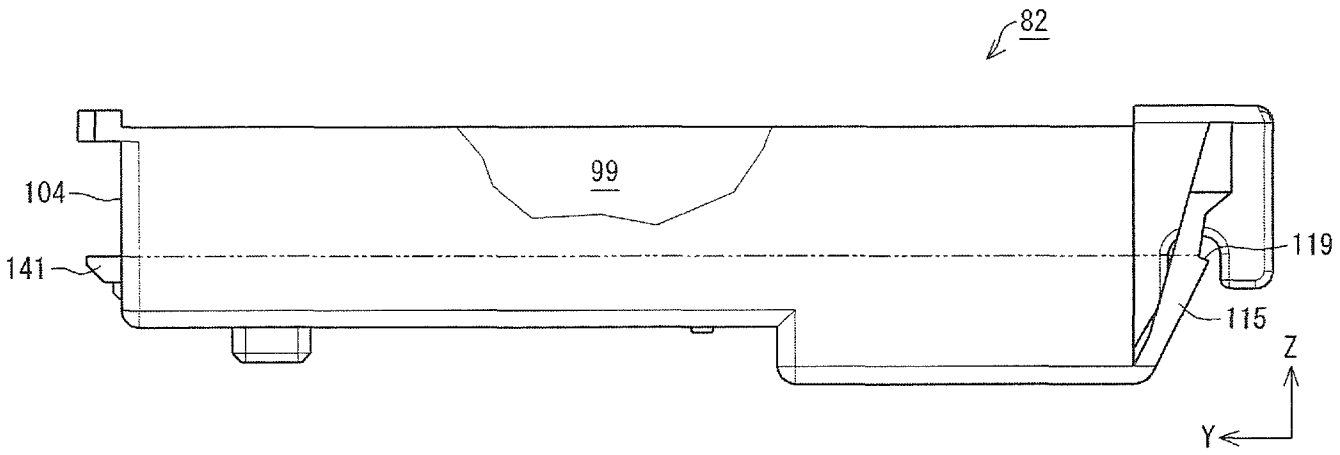
FIG. 19 is a side view showing the first casing according to the embodiment.

These two second engaging portions 141 fit into the two engaging holes 53BK (FIG. 5) of the holder 31, in a state where the cartridge 33BK is mounted in the holder 31. The position of the cartridge 33BK relative to the holder 31 in the Z-axis direction is fixed by the second engaging portions 141 engaging the engaging holes 53BK. The second engaging portions 141 and the engaging portion 119 are provided on opposite sides to each other across the recessed portion 99 in the Y-axis direction, as shown in FIG. 19. The second engaging portions 141 and the engaging portion 119 are provided at approximately the same height positions to each other, in the mounting direction in which the cartridge 33 is mounted in the holder 31 (coincides with Z-axis direction in the present embodiment). In other words, the engaging portion 119 and the second engaging portions 141 are provided at approximately the same height position to each other in the mounting direction.

Figure 20:
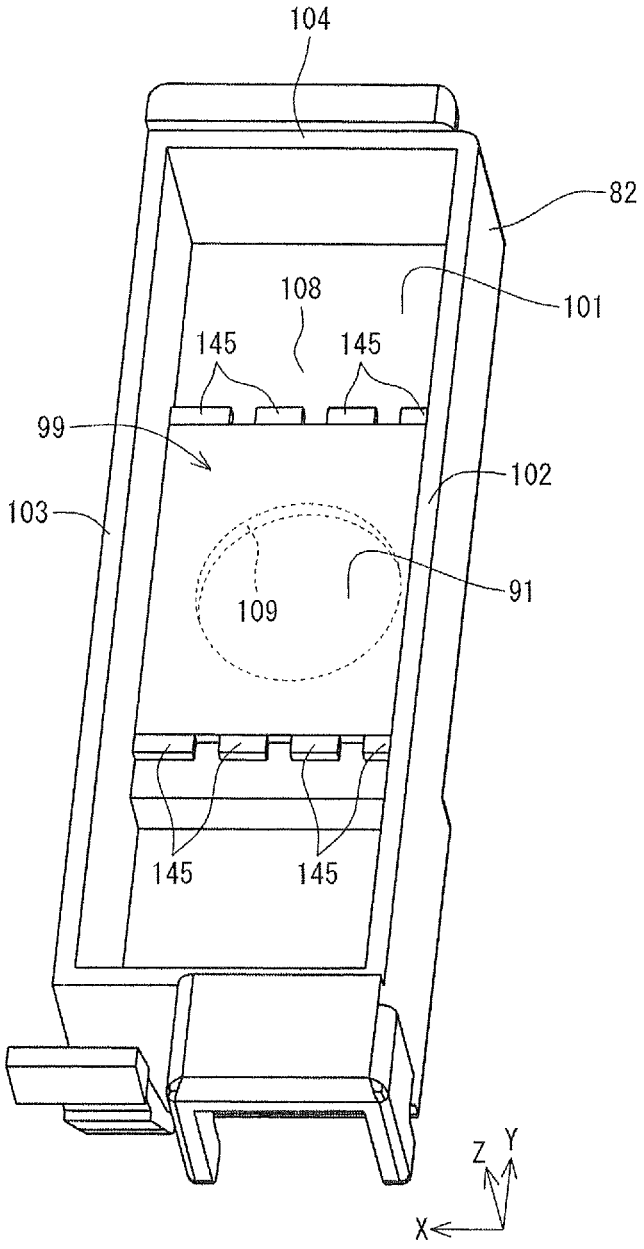
FIG. 20 is a perspective view showing the first casing and a filter according to the embodiment.

The filter 91 is housed inside the recessed portion 99 of the first casing 82, as shown in FIG. 20. The filter 91 is tabular in shape. The filter 91 is provided in a position overlapping with the supply hole 109, and is placed on the bottom 108 of the recessed portion 99. The filter 91 covers the supply hole 109 from the inside of the recessed portion 99. A plurality of raised portions 145 that rise from the bottom 108 in the positive Z-axis direction are provided on the first wall 101. The position of the filter 91 in the Y-axis direction is regulated by the plurality of raised portions 145. Also, the position of the filter 91 in the X-axis direction is regulated by the second wall 102 and the third wall 103. The filter 91 has the quality of absorbing ink and holding the absorbed ink. Note that a material such as felt or a nonwoven fabric, for example, can be employed for the filter 91.

Figure 21:
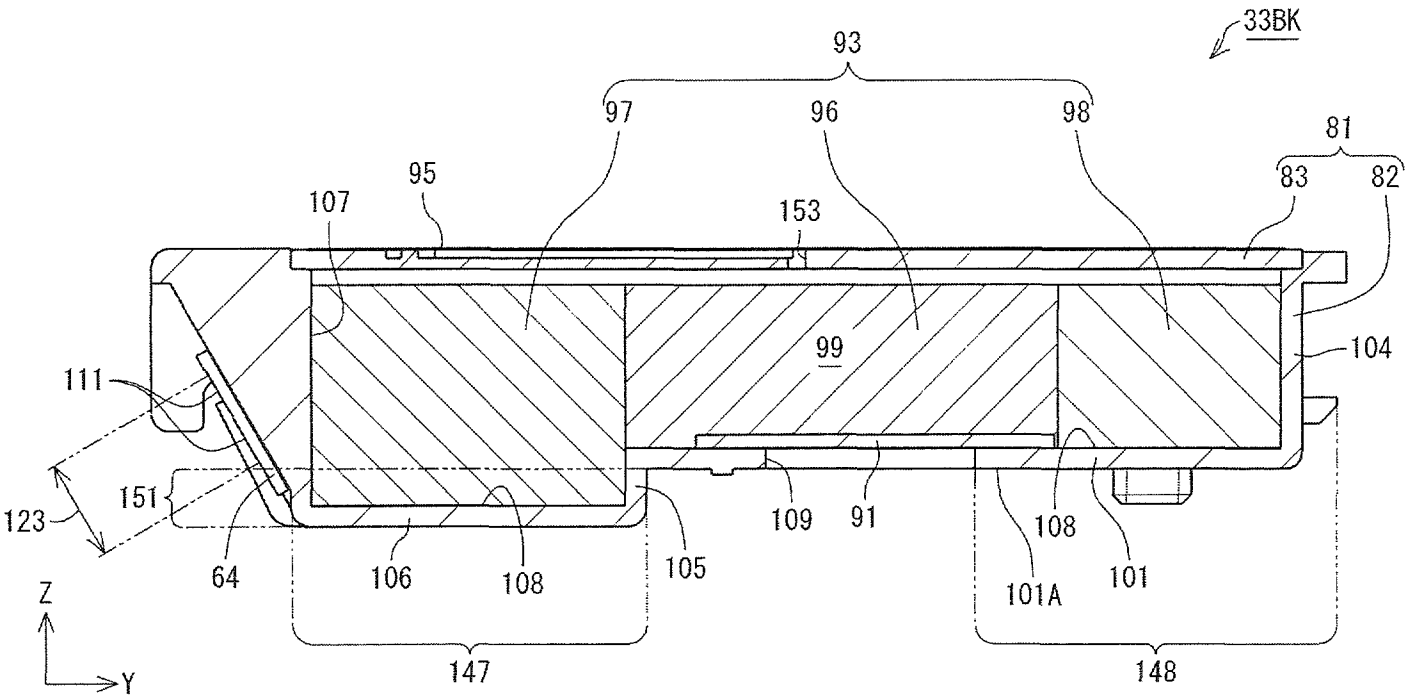
FIG. 21 is a cross-sectional view showing a cartridge according to the embodiment.

The holding member 93 is housed inside the recessed portion 99 of the first casing 82, as shown in FIG. 21. The holding member 93 includes a first holding member 96, a second holding member 97, and a third holding member 98. The first holding member 96 is provided in an area overlapping with the first wall 101. The first holding member 96 is provided at a position overlapping with the supply hole 109. The first holding member 96 covers the filter 91 from the opposite side to the first wall 101 side of the filter 91. The first holding member 96 thus covers the supply hole 109 from the opposite side to the first wall 101 side of the filter 91. That is, the first holding member 96 covers the supply hole 109 across the filter 91 from the recessed portion 99 side. Note that, in FIG. 21, a cross-section of the cartridge 33BK cut in a YZ plane that passes through the supply hole 109 is shown.

The second holding member 97 is provided further in the negative Y-axis direction than the first holding member 96, that is, closer to the seventh wall 107 than is the first holding member 96. The second holding member 97 is located between the first holding member 96 and the seventh wall 107. The second holding member 97 is provided in an area overlapping with the sixth wall 106. Here, in the present embodiment, the sixth wall 106 projects further in the negative Z-axis direction than the first wall 101, that is, further away from the recessed portion 99 side than the first wall 101. The area in the cartridge 33 where the sixth wall 106 projects further in the negative Z-axis direction than the first wall 101 is called a projecting region 151. The projecting region 151 spans the width of the first casing 82 in the X-axis direction. The bottom 108 in the projecting region 151 projects further in the negative Z-axis direction than the bottom 108 in the first wall 101. The second holding member 97 extends to within the projecting region 151. That is, the second holding member 97 is placed on the bottom 108 of the sixth wall 106.

Note that an area in the cartridge 33 that includes the fifth wall 105 and the seventh wall 107 and extends from the fifth wall 105 to the seventh wall 107 side in the Y-axis direction is defined as a first side portion 147, as shown in FIG. 21. Also, the area in the cartridge 33 on the fourth wall 104 side of the supply hole 109 in the Y-axis direction is defined as a second side portion 148. The projecting region 151 is included in the first side portion 147. The sixth wall 106, which is the end of the first side portion 147 in the Z-axis direction, is thus located lower in the Z-axis direction than a surface 101A of the first wall 101, which is the end of the second side portion 148 in the Z-axis direction. The electrodes 111 are provided on the first side portion 147 which projects lower than the lower end of the second side portion 148. The cartridge 33 is thereby more readily made thinner in the second side portion 148, while securing an area for disposing the electrodes 111. Also, in the present embodiment, because the lever 115 is provided on the first side portion 147, an area for disposing the lever 115 is more readily secured. Note that the surface 101A corresponds to a first surface.

The third holding member 98 is provided further in the positive Y-axis direction than the first holding member 96, that is, closer to the fourth wall 104 than is the first holding member 96. The third holding member 98 is provided in a position facing the second holding member 97 across the first holding member 96. The third holding member 98 is located between the first holding member 96 and the fourth wall 104. The third holding member 98 is provided in an area overlapping with the first wall 101, further in the positive Y-axis direction than the first holding member 96. In other words, the first holding member 96 is located between the second holding member 97 and the third holding member 98. The second holding member 97, the first holding member 96 and the third holding member 98 are thus aligned in the Y-axis direction. The second holding member 97 abuts the first holding member 96. Because an ink channel is thereby secured between the second holding member 97 and the first holding member 96, ink flows more readily from the second holding member 97 to the first holding member 96. Also, the first holding member 96 abuts the third holding member 98. Because an ink channel is thereby secured between the third holding member 98 and the first holding member 96, ink flows more readily from the third holding member 98 to the first holding member 96.

A material such as felt or a nonwoven fabric, for example, can be employed for the holding member 93. In the present embodiment, a nonwoven fabric is employed as the material of the holding member 93. In the first holding member 96, a nonwoven fabric having a fiber diameter of 4 deniers and a density of 0.11 g/cm$^3$ is employed. In the second holding member 97, a nonwoven fabric having a fiber diameter of 4 deniers and a density of 0.055 g/cm$^3$ is employed. In the third holding member 98, a nonwoven fabric having a fiber diameter of 4 deniers and a density of 0.055 g/cm$^3$ is employed.

In the present embodiment, the relationship between the density of the first holding member 96 and the density of the second holding member 97 is expressed by the following inequation (1).

$$\text{density of first holding member 96} > \text{density of second holding member 97} \quad (1)$$

Also, the relationship between the density of the second holding member 97 and the density of the third holding member 98 is expressed by the following equation (2).

$$\text{density of second holding member 97} = \text{density of third holding member 98} \quad (2)$$

The relationship between the density of the first holding member 96 and the density of the third holding member 98 is thus expressed by the following inequation (3).

$$\text{density of first holding member 96} > \text{density of third holding member 98} \quad (3)$$

The relationship expressed by the above inequation (1) results in ink within the projecting region 151 being more readily guided to the supply hole 109 via the second holding member 97 and the first holding member 96, despite the projecting region 151 being located vertically lower than the surface 101A. Also, the relationship expressed by the above inequation (3) results in ink that is located on the second side portion 148 side of the supply hole 109 being more readily guided to the supply hole 109 via the third holding member 98 and the first holding member 96.

In the present embodiment, the first holding member 96 and the third holding member 98 are formed in a state of being connected to each other by integral molding. The first holding member 96 to the third holding member 98 can be respectively formed by pultrusion molding a bundle of fibers that form the material of the nonwoven fabric with a metal mold. According to the present embodiment, the first holding member 96 and the third holding member 98 are formed in a state of being connected to each other, by implementing pultrusion molding of the third holding member 98 following pultrusion molding of the first holding member 96. At this time, the relationship expressed by the above inequation (3) can be realized by reducing the density of the bunch of fibers used as the material in pultrusion molding of the third holding member 98 to less than the density of the bunch of fibers used in forming the first holding member 96.

In the present embodiment, forming the first holding member 96 and the third holding member 98 by integral molding reduces the likelihood of gaps occurring between the first holding member 96 and the third holding member 98. The likelihood of the ink channel from the first holding member 96 to the third holding member 98 being disrupted is thereby reduced. Ink located on the second side portion 148 side of the supply hole 109 is thus much more readily guided to the supply hole 109 via the third holding member 98 and the first holding member 96.

Note that, in the present embodiment, the relationship between the capacity of the first holding member 96 and the capacity of the second holding member 97 is expressed by the following inequation (4).

$$\text{capacity of first holding member 96} < \text{capacity of second holding member 97} \quad (4)$$

Also, in the present embodiment, the relationship between the volume of ink that is held by the first holding member 96 and the volume of ink that is held by the second holding member 97 in a state where ink is housed in the recessed portion 99 is expressed by the following inequation (5).

$$\text{ink volume of first holding member 96} > \text{ink volume of second holding member 97} \quad (5)$$

The relationship expressed by the above inequation (5) results in ink that is located on the first side portion 147 side of the supply hole 109 being more readily guided to the supply hole 109 via the second holding member 97 and the first holding member 96.

Note that, in the present embodiment, the circuit substrate 64 straddles the position of the surface 101A of the first wall 101 on the opposite side to the recessed portion 99 side in the Z-axis direction, as shown in FIG. 21. In other words, the circuit substrate 64 extends from higher than the surface 101A to lower than the surface 101A in the Z-axis direction. The circuit substrate 64 thus extends from higher than the surface 101A to lower than the surface 101A, when seen from the electrode area 123 side, in a state where the surface 101A of the first wall 101 on the opposite side to the recessed portion 99 side faces vertically downward. An area that extends to lower than the surface 101A can thereby be utilized as at least part of electrode area 123. Effective utilization of the area is thereby achieved.

In the present embodiment, the projecting region 151 spans an area that straddles the electrode area 123 in the X-axis direction. Thus, for example, even if ink travels from the supply hole 109 along the first wall 101 toward the electrodes 111 side, ink reaching the electrodes 111 is more readily avoided because of the projecting region 151. Note that, in the present embodiment, the projecting region 151 spans the width of the first casing 82 in the X-axis direction. Ink travelling from the supply hole 109 is thus more readily avoided across the width of the cartridge 33 in the X-axis direction.

The second casing 83 covers the recessed portion 99 from further in the positive Z-axis direction than the holding member 93, that is, from further on the opposite side to the bottom 108 side than the holding member 93, as shown in FIG. 21. The recessed portion 99 is blocked off by the second casing 83. An air communication hole 153 that passes through between the inside of the recessed portion 99 and the outside of the casing 81 is provided in the second casing 83. The sheet member 95 is provided on the positive Z-axis direction side of the second casing 83, that is, on the opposite side of the second casing 83 to the recessed portion 99 side. The air communication hole 153 is blocked off by the sheet member 95.

Figure 22:
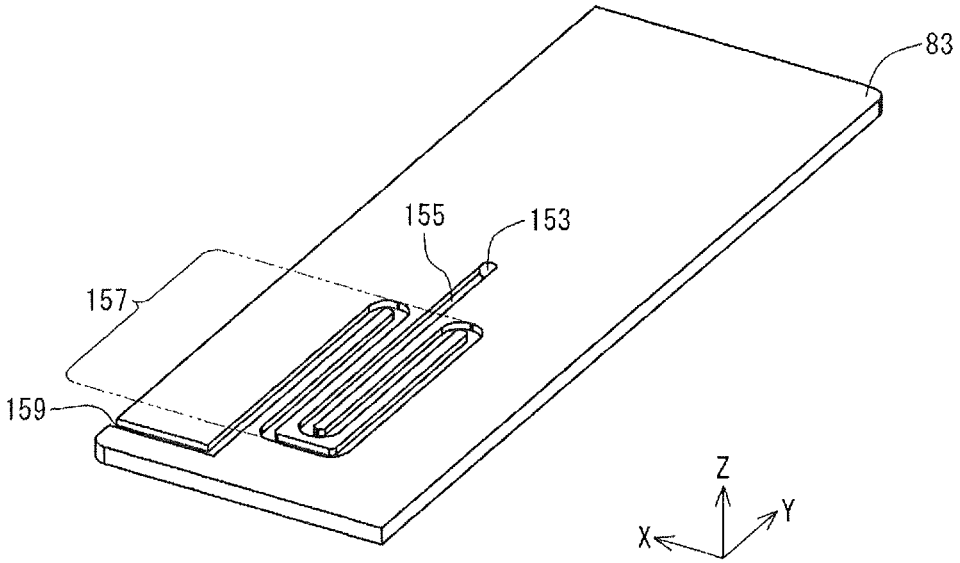
FIG. 22 is a perspective view showing a second casing according to the embodiment.
Figure 23:
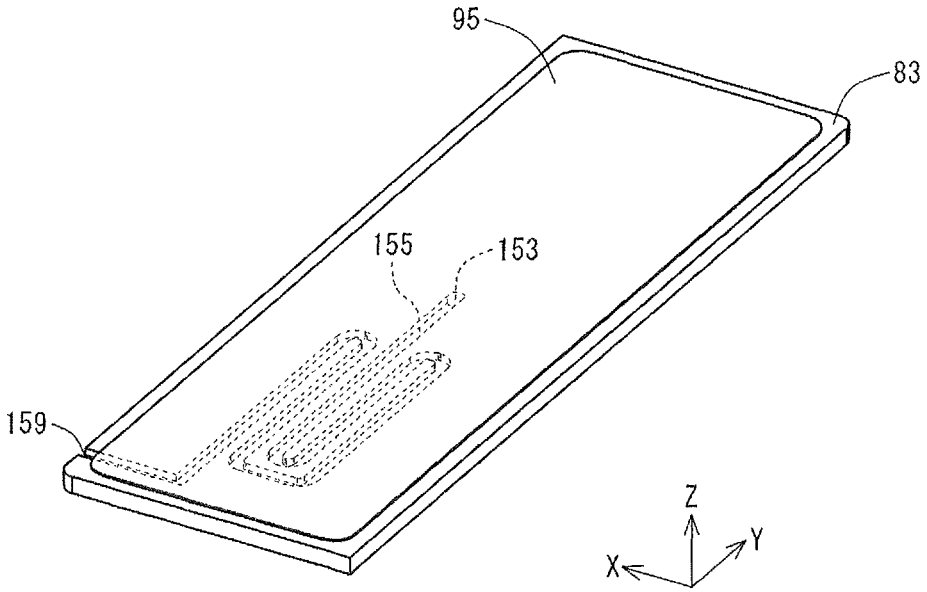
FIG. 23 is a perspective view showing the second casing and a sheet member according to the embodiment.

A communication passage 155 is provided, as shown in FIG. 22, on the opposite side of the second casing 83 to the recessed portion 99 side. The communication passage 155 is constituted as a groove provided in the second casing 83. The groove serving as the communication passage 155 has a snaking portion 157. The groove serving as the communication passage 155 arrives at an end portion 159 after snaking through the snaking portion 157 with the air communication hole 153 as the starting point. The end portion 159 reaches to the side wall of the second casing 83, and is constituted as an opening that opens toward the outside in the side wall. The opening serving as the end portion 159 is connected to the air communication hole 153 by the communication passage 155. The air communication hole 153 and the communication passage 155, excluding the opening serving as the end portion 159, are blocked off by the sheet member 95 from the positive Z-axis direction, as shown in FIG. 23. The above configuration results in the inside of the recessed portion 99 of the cartridge 33BK being open to the atmosphere through the communication passage 155 and the air communication hole 153.

The cartridge 33CL will now be described. The cartridge 33CL includes the same configuration as the cartridge 33BK. In the following description of the cartridge 33CL, constituent elements that are the same as the cartridge 33BK will be given the same reference numerals and a detailed description thereof will be omitted.

Figure 24:
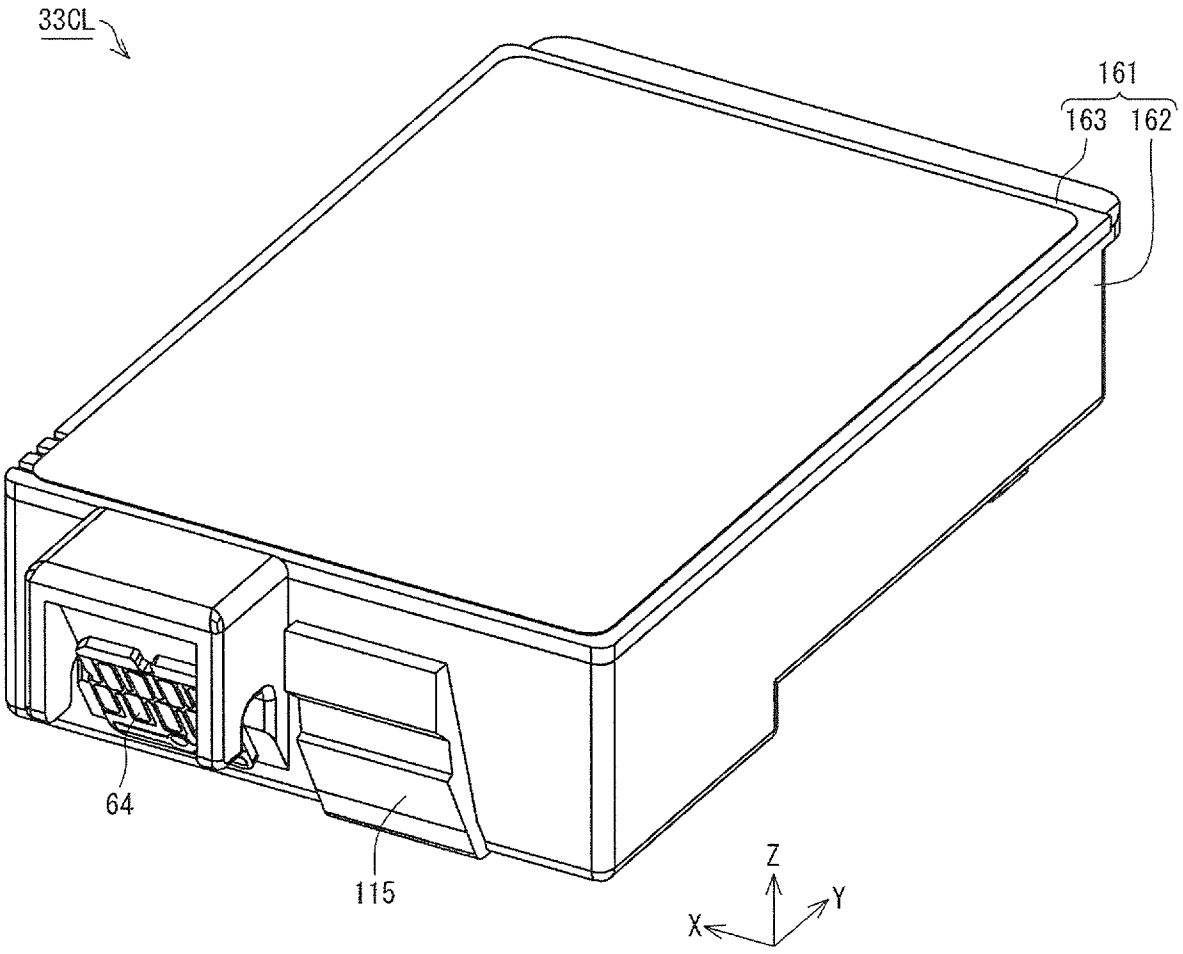
FIG. 24 is a perspective view showing a cartridge according to the embodiment.
Figure 25:
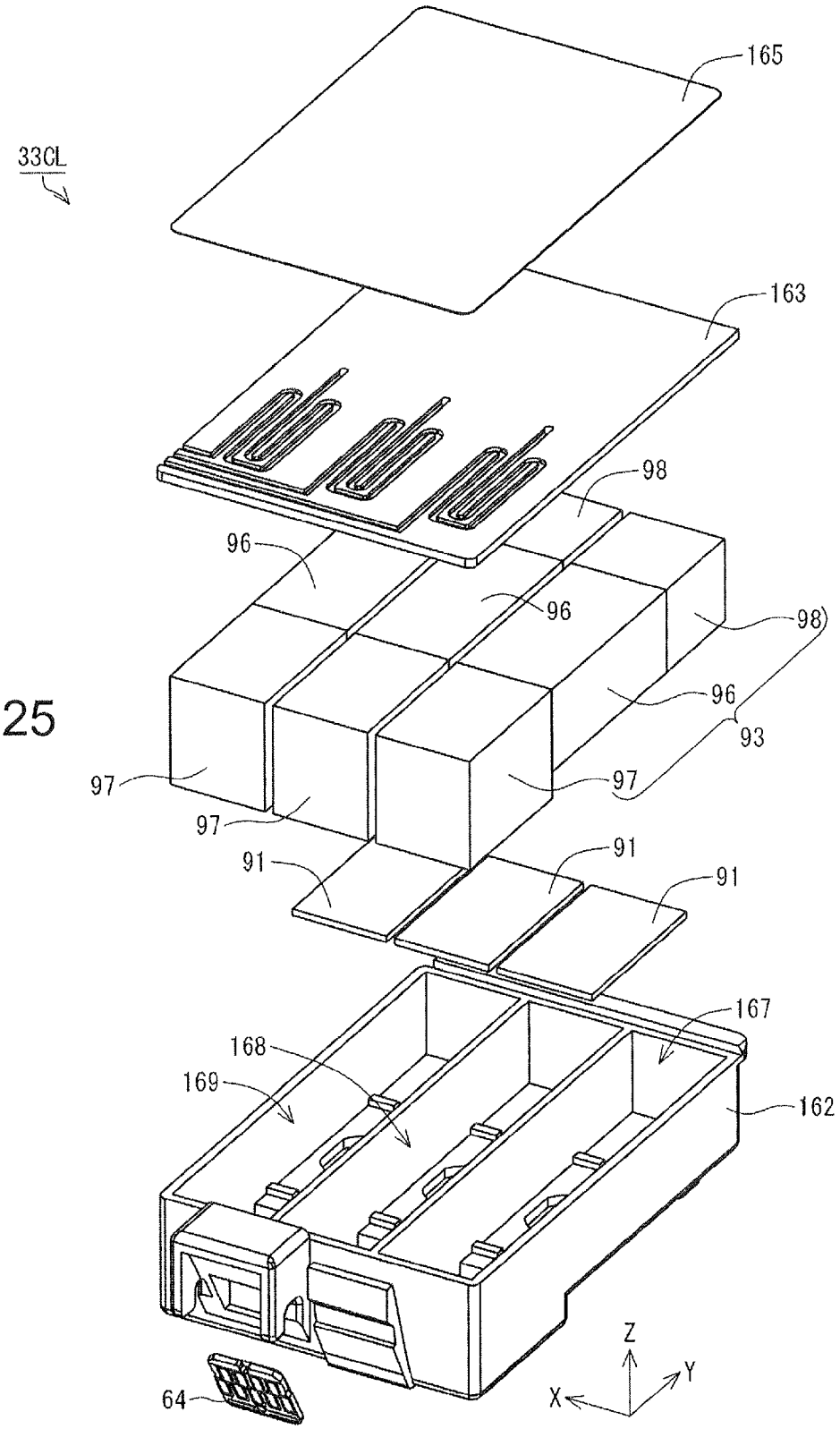
FIG. 25 is an exploded perspective view showing the cartridge according to the embodiment.

The cartridge 33CL has a casing 161, as shown in FIG. 24. Also, the cartridge 33CL has one circuit substrate 64. The casing 161 constitutes an outer shell of the cartridge 33CL. The casing 161 includes a first casing 162 and a second casing 163. In the present embodiment, the outer shell of the cartridge 33CL is constituted by the first casing 162 and the second casing 163. One lever 115 is provided on the first casing 162. Also, the cartridge 33CL has three filters 91, three holding members 93, and a sheet member 165, as shown in FIG. 25. The first casing 162 is shaped like a container, and has a recessed portion 167, a recessed portion 168 and a recessed portion 169.

The three filters 91 are respectively housed inside the recessed portion 167, the recessed portion 168, and the recessed portion 169. The three holding members 93 are also respectively housed inside the recessed portion 167, the recessed portion 168, and the recessed portion 169. The second casing 163 blocks off the recessed portion 167, the recessed portion 168 and the recessed portion 169 from the positive Z-axis direction, in a state where the filters 91 and the holding members 93 are respectively housed inside the recessed portion 167, the recessed portion 168, and the recessed portion 169. In the cartridge 33CL, ink is housed inside each of the recessed portion 167, the recessed portion 168, and the recessed portion 169. The recessed portion 167, the recessed portion 168 and the recessed portion 169 are thus respectively housing portions that house ink.

Figure 26:
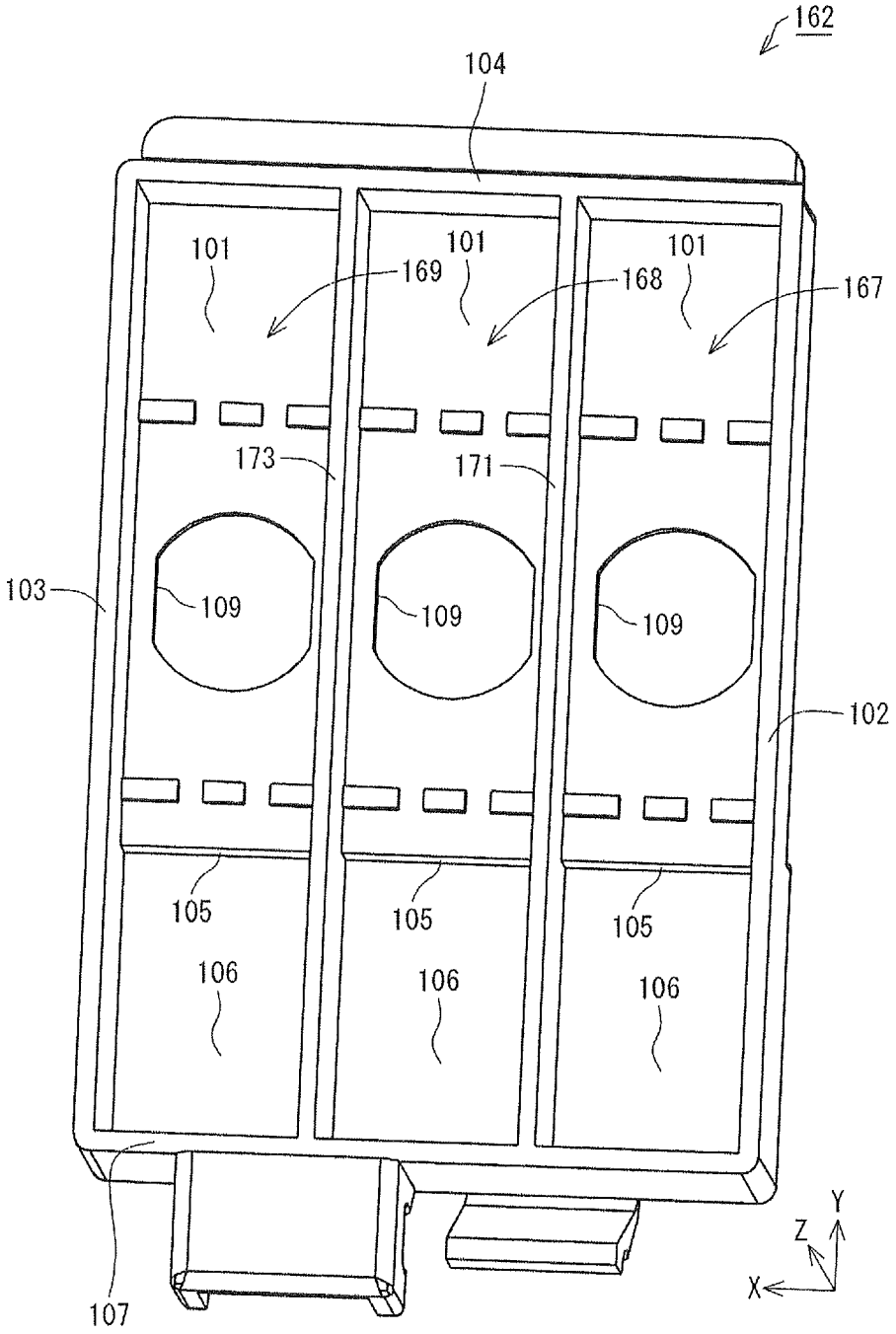
FIG. 26 is a perspective view showing the first casing according to the embodiment.

The first casing 162 has a first wall 101, a second wall 102, a third wall 103, a fourth wall 104, a fifth wall 105, a sixth wall 106 and a seventh wall 107, as shown in FIG. 26. A detailed description of the first wall 101 to the seventh wall 107, which are respectively similar to the first wall 101 to the seventh wall 107 of the cartridge 33BK, will be omitted. Also, three supply holes 109 are provided in the first casing 162. The three supply holes 109 are respectively provided in the recessed portion 167, the recessed portion 168, and the recessed portion 169. The first casing 162 has a partition wall 171 and a partition wall 173. The partition wall 171 and the partition wall 173 respectively project from the first wall 101 in the positive Z-axis direction, that is, from the first wall 101 toward the second casing 163 (FIG. 25) side.

The partition wall 171 opposes the second wall 102 with a gap between the partition wall 171 and the second wall 102 in the X-axis direction. In the X-axis direction, the partition wall 173 is located between the partition wall 171 and the third wall 103. The partition wall 173 opposes the third wall 103 with a gap between the partition wall 173 and the third wall 103 in the X-axis direction. Also, the partition wall 171 and the partition wall 173 oppose each other with a gap therebetween in the X-axis direction. The partition wall 171 and the partition wall 173 respectively intersect each of the fourth wall 104, the fifth wall 105, the sixth wall 106, and the seventh wall 107. The partition wall 171 and the partition wall 173 respectively extend from the fourth wall 104 to the seventh wall 107 in the Y-axis direction.

The recessed portion 167, the recessed portion 168 and the recessed portion 169 are partitioned by the partition wall 171 and the partition wall 173. The recessed portion 167, the recessed portion 168 and the recessed portion 169 are thus respectively constituted independently so as to be capable of housing ink. Different types of ink can thereby be housed in each of the recessed portion 167, the recessed portion 168, and the recessed portion 169. In the present embodiment, three types of ink of the different colors yellow, magenta and cyan are respectively housed in the recessed portion 167, the recessed portion 168, and the recessed portion 169.

Figure 27:
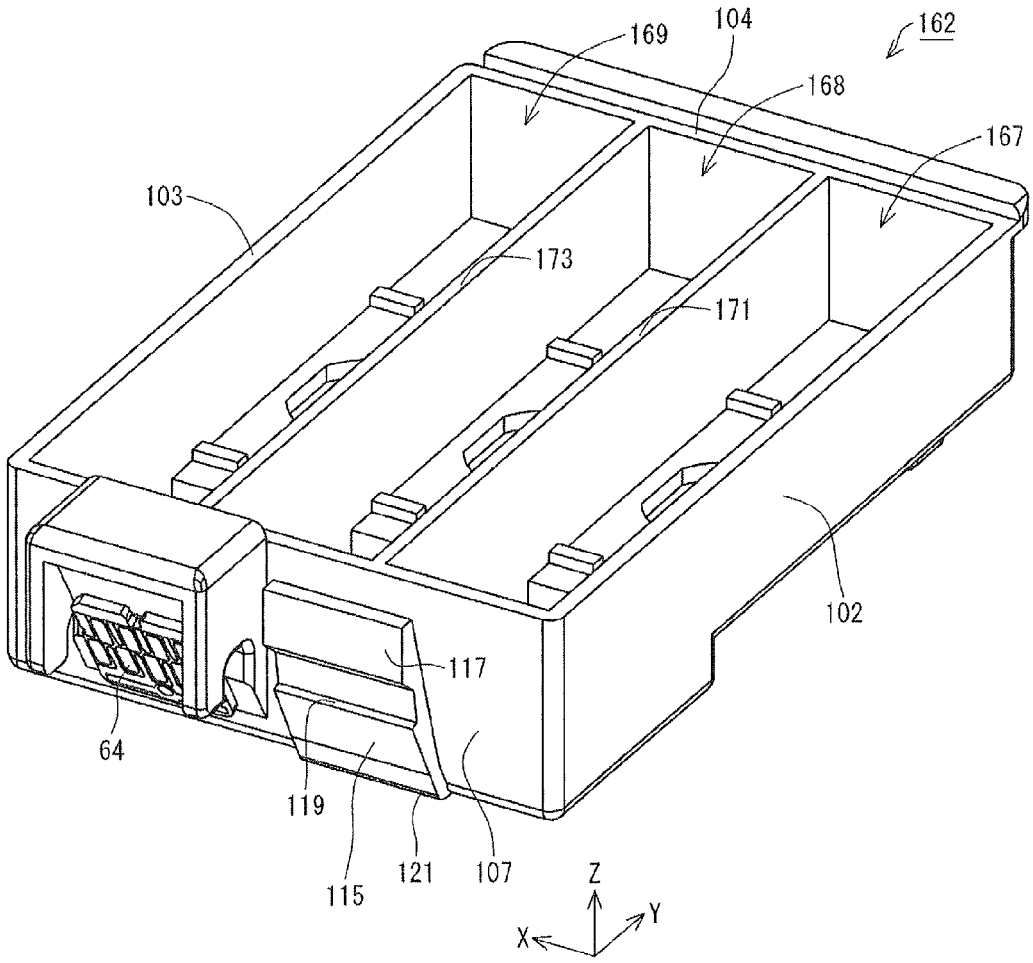
FIG. 27 is a side view showing the first casing and the circuit substrate according to the embodiment.
Figure 28:
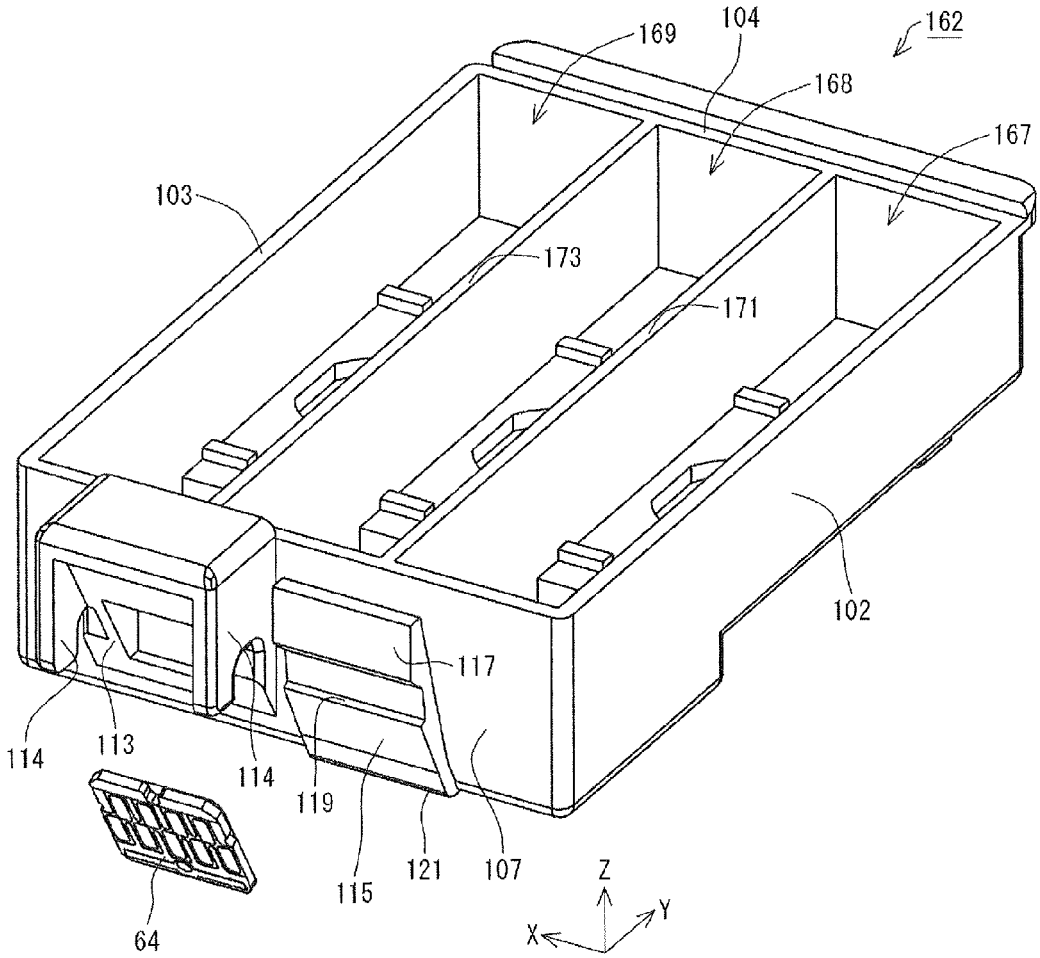
FIG. 28 an exploded perspective view showing the first casing and the circuit substrate according to the embodiment.

In the cartridge 33CL, the circuit substrate 64 and the lever 115 are similarly provided on the opposite side of the seventh wall 107 to the fourth wall 104 side, that is, on the outside of the recessed portions 167 to 169, as shown in FIG. 27. In the cartridge 33CL, the lever 115 is located further in the negative X-axis direction than the circuit substrates 64. In other words, in the cartridge 33CL, the order in which the circuit substrate 64 and the lever 115 are arranged in the X-axis direction is the reverse of the cartridge 33BK. In the cartridge 33CL, a plurality of electrodes 111 of the circuit substrate 64 respectively incline in the Z-axis direction, similarly to the cartridge 33BK. Also, a substrate installation portion 113 is provided on the seventh wall 107 on the outside of the recessed portions 167 to 169, as shown in FIG. 28. A detailed description of the substrate installation portion 113 of the cartridge 33CL, which has a similar configuration to the substrate installation portion 113 of the cartridge 33BK, will be omitted.

Figure 29:
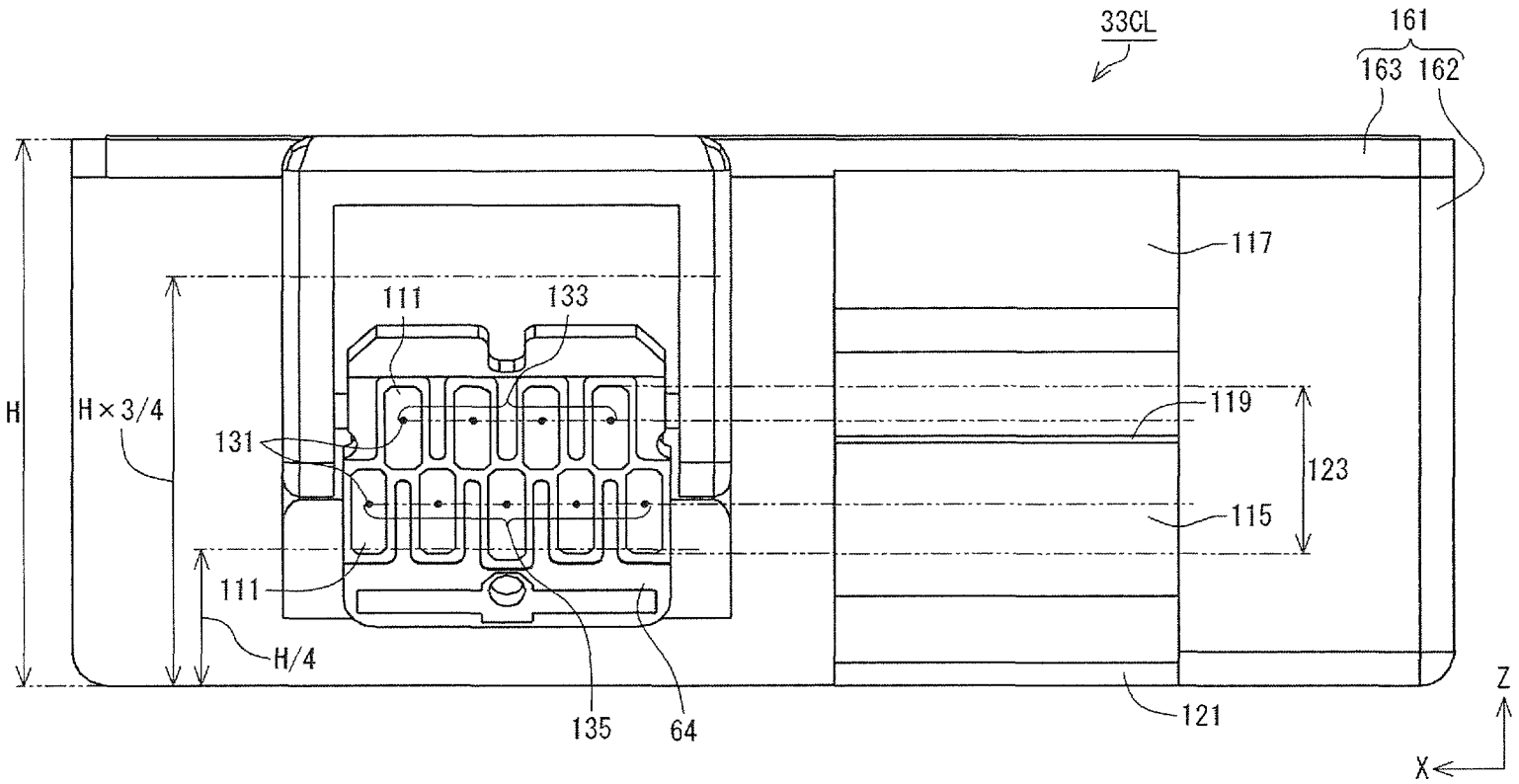
FIG. 29 is a front view showing a cartridge according to the embodiment.

In the cartridge 33CL, the width a main body of the lever 115 including an engaging portion 119 and a joining portion 121 and the width of a gripping portion 117 are set to the same dimensions in the X-axis direction, as shown in FIG. 29. Also, in the cartridge 33CL, the lever 115, including the gripping portion 117, falls within an area overlapping with the casing 161 in the X-axis direction. Note that the cartridge 33CL can also be configured (similarly to the cartridge 33BK) such that the gripping portion 117 is wider than the engaging portion 119 in the X-axis direction. Furthermore, the cartridge 33CL can also be configured (similarly to the cartridge 33BK) such that the gripping portion 117 protrudes from the casing 161 in the X-axis direction.

The engaging portion 119 of the lever 115 in the cartridge 33CL is located within the range of the electrode area 123 in the Z-axis direction. From another viewpoint, the engaging portion 119 is located within a range of the electrode area 123 in the mounting direction in which the cartridge 33 is mounted in the holder 31. In the cartridge 33CL, all the contact portions 131 are also located within a range from one quarter to three quarters of the height of the cartridges 33 in the Z-axis direction, similarly to the cartridge 33BK. In the cartridge 33CL, the engaging portion 119 is located between a first array 133 and a second array 135 in the mounting direction in which the cartridge 33 is mounted in the holder 31 (coincides with Z-axis direction in the present embodiment).

Figure 30:
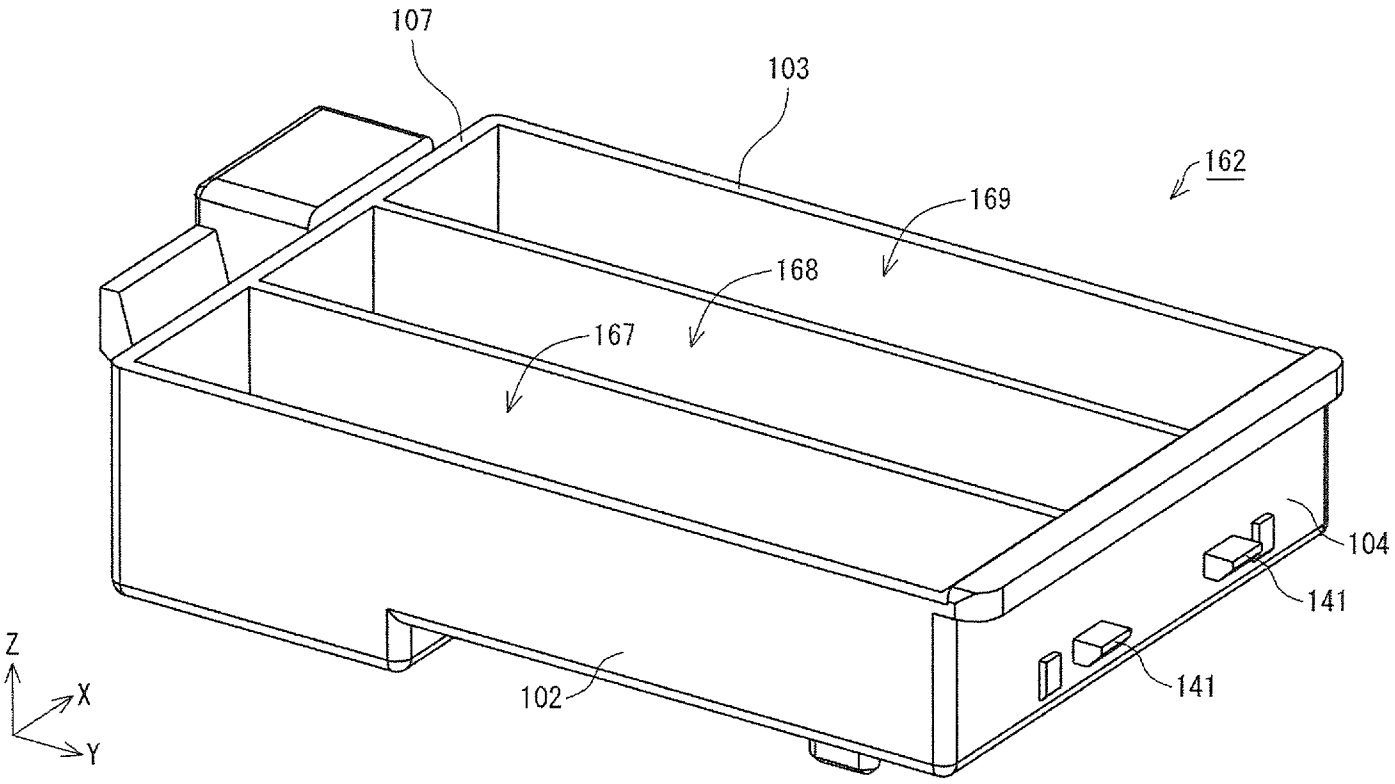
FIG. 30 is a perspective view showing the first casing according to the embodiment.

Two second engaging portions 141 are provided on the fourth wall 104 of the first casing 162, as shown in FIG. 30. The two second engaging portions 141 are provided on the opposite side of the fourth wall 104 to recessed portions 167 to 169 side, that is, on the outside of the recessed portions 167 to 169. The two second engaging portions 141 projects from the fourth wall 104 in the opposite direction to the recessed portions 167 to 169 side, that is, from the fourth wall 104 in the positive Y-axis direction. The two second engaging portions 141 can also be described as projecting from the fourth wall 104 away from the recessed portions 167 to 169.

Figure 31:
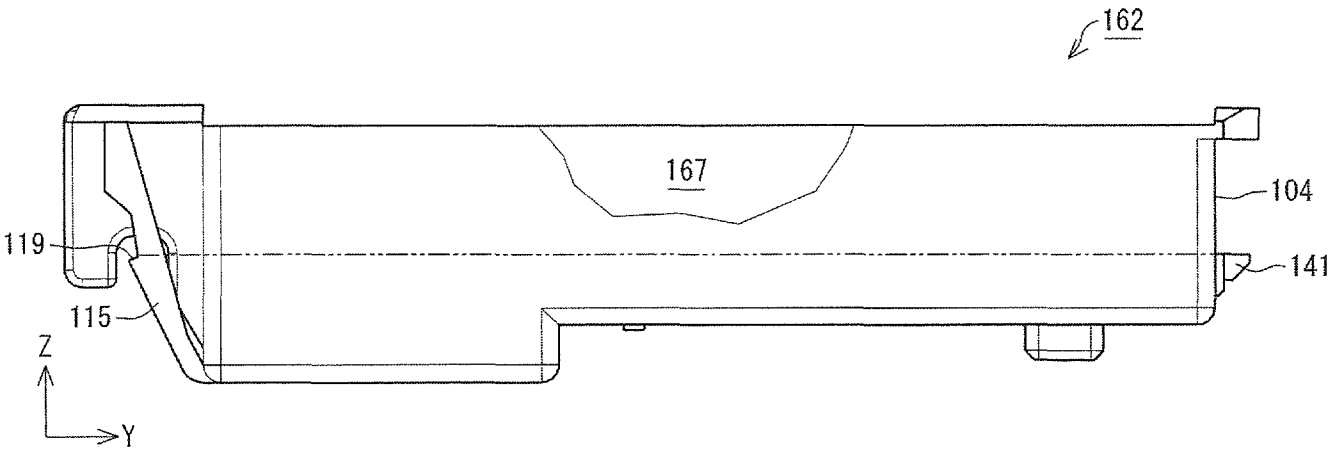
FIG. 31 is a side view showing the first casing according to the embodiment.

These two second engaging portions 141 fit into the two engaging holes 53CL (FIG. 5) in the holder 31, in a state where the cartridge 33CL is mounted in the holder 31. As a result of the second engaging portions 141 engaging the engaging holes 53CL, the position of the cartridge 33CL relative to the holder 31 in the Z-axis direction is fixed. The second engaging portions 141 and the engaging portion 119 are provided on opposite sides to each other across the recessed portion 167 (the recessed portion 168, the recessed portion 169) in the Y-axis direction, as shown in FIG. 31. The second engaging portions 141 are provided at approximately the same height as the engaging portion 119, in the mounting direction in which the cartridge 33CL is mounted in the holder 31 (coincides with Z-axis direction in the present embodiment).

A detailed description of the filters 91 and the holding members 93 of the cartridge 33CL, which are respectively similar to the filter 91 and the holding member 93 of the cartridge 33BK in terms of material, function and disposition, will be omitted. Also, the holding members 93 of the cartridge 33CL similarly satisfy the relationships expressed by the aforementioned equations and inequations (1) to (5).

Figure 32:
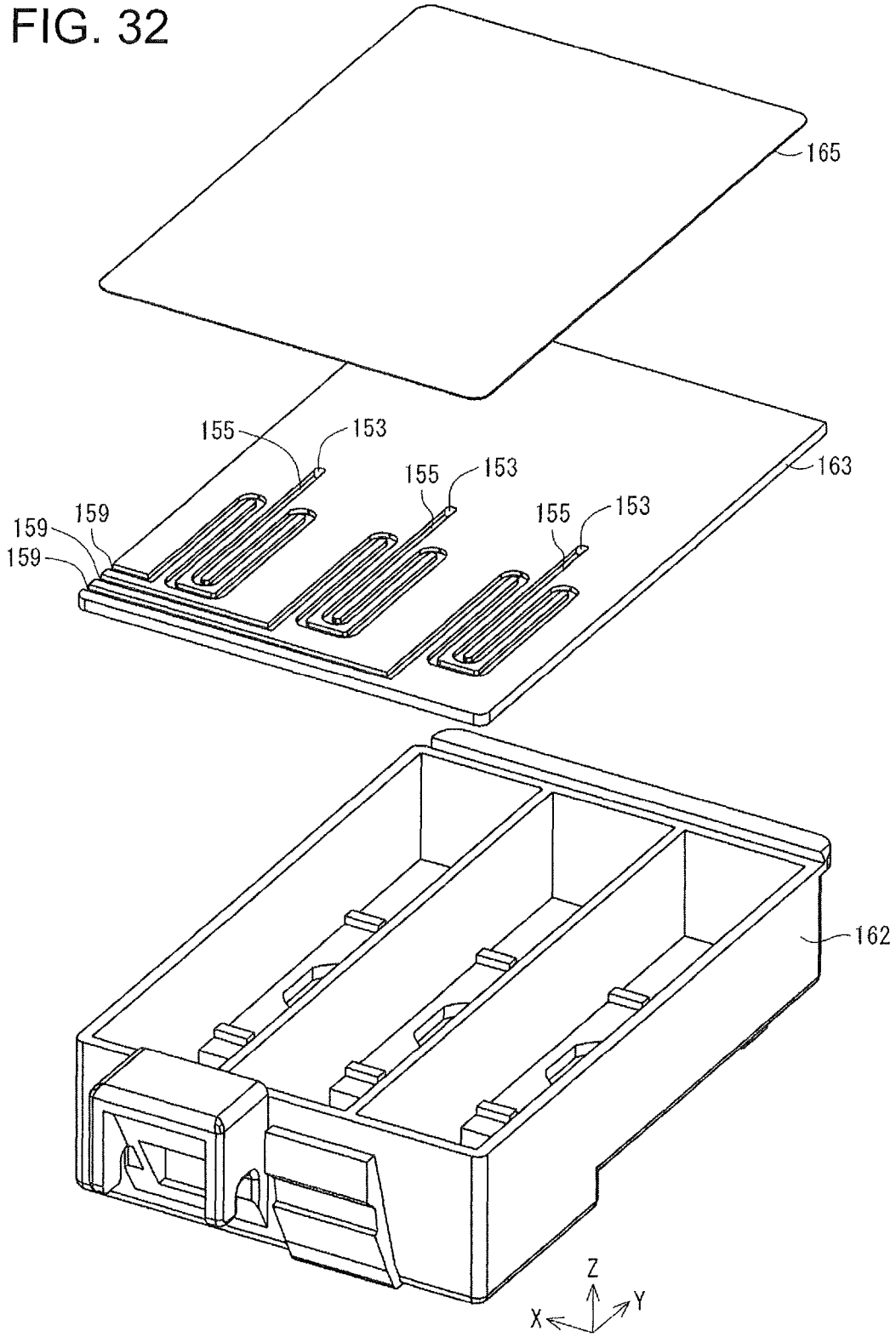
FIG. 32 an exploded perspective view showing the first casing, the second casing, and a sheet member according to the embodiment.

The second casing 163 is large enough to cover the recessed portions 167 to 169, when the XY plane is seen in plan view, as shown in FIG. 32. The second casing 163 thus covers the recessed portions 167 to 169 from the positive Z-axis direction of the recessed portions 167 to 169, that is, from further on the opposite side to the bottom 108 side than the holding member 93. The recessed portions 167 to 169 are blocked off by the second casing 163. An air communication hole 153 and a communication passage 155 are provided in the second casing 163, in correspondence with each of the recessed portions 167 to 169. In other words, three air communication holes 153 and three communication passage 155 are provided in the second casing 163.

An air communication hole 153 and a communication passage 155 that is connected to this air communication holes 153 are respectively provided in correspondence with the recessed portions 167 to 169. In other words, a set of an air communication hole 153 and a communication passage 155 is provided in correspondence with the recessed portion 167. Similarly, a set of an air communication hole 153 and a communication passage 155 is provided in correspondence with the recessed portion 168, and a set of the air communication hole 153 and the communication passage 155 is provided in corresponding with the recessed portion 169. A detailed description of the air communication hole 153 and the communication passage 155 of the cartridge 33CL, which have a similar configuration to the air communication hole 153 and the communication passage 155 of the cartridge 33BK, will be omitted.

The sheet member 165 is provided on the opposite side of the second casing 163 to the first casing 162 side, that is, further in the positive Z-axis direction than the second casing 163. The three air communication holes 153 and the three communication passages 155, excluding openings serving as end portions 159, are blocked off by the sheet member 165 from the positive Z-axis direction. The above configuration results in the inside of each of the recessed portions 167 to 169 of the cartridge 33CL being open to the atmosphere via the communication passages 155 and the air communication holes 153. The above configuration enables similar effects to the cartridge 33BK to also be obtained with the cartridge 33CL. Furthermore, with the cartridge 33CL, a plurality of types of ink of different colors can be housed in one first casing 162, allowing miniaturization of the cartridges 33 to be more readily achieved.

Figure 33:
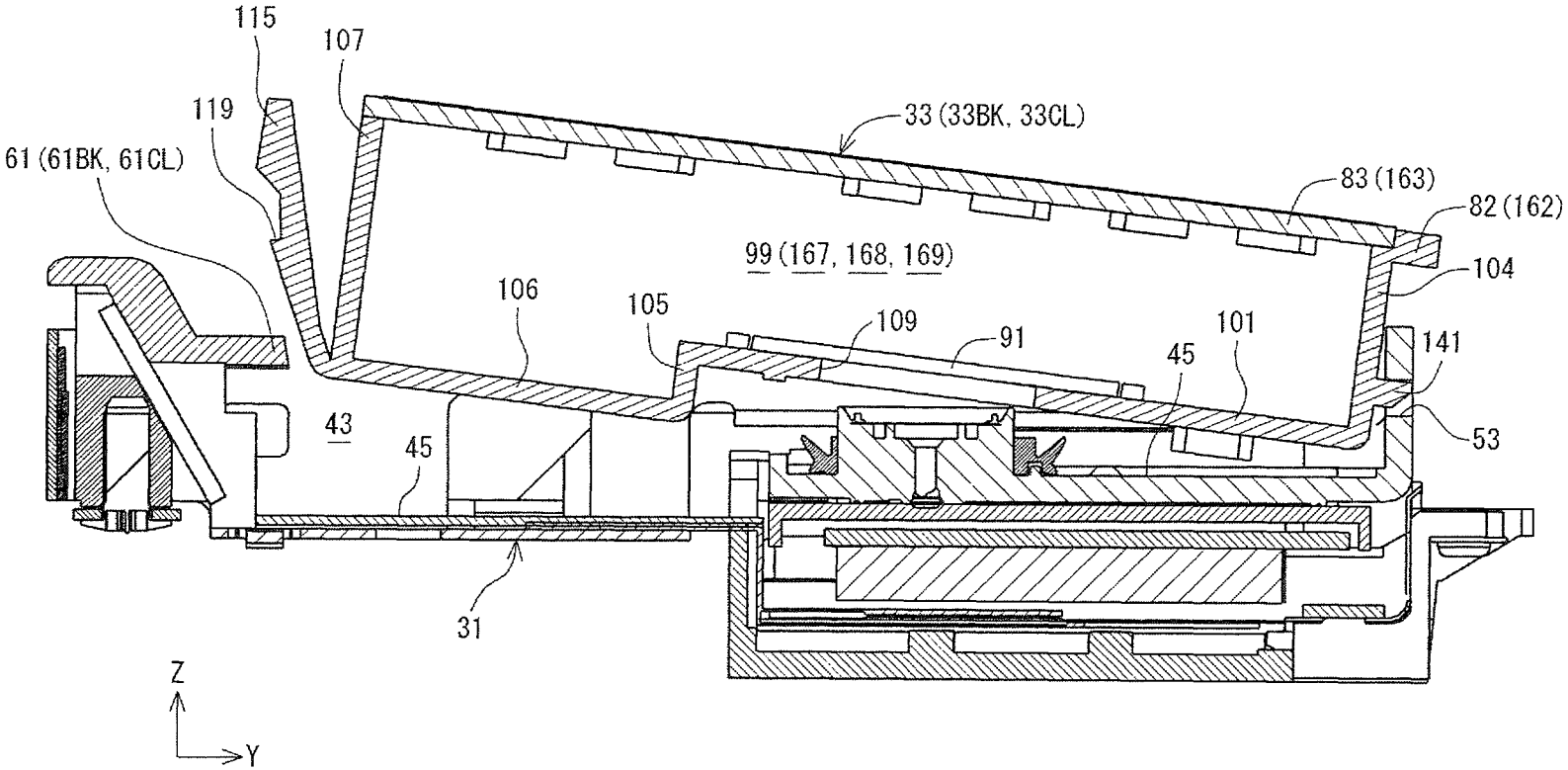
FIG. 33 illustrates a method of mounting a cartridge in a holder according to the embodiment.

The method of mounting the cartridges 33 in the holder 31 will now be described. In the present embodiment, the method of mounting the cartridge 33BK is the same as the method of mounting the cartridge 33CL. The method of mounting a cartridge 33 will thus be described below. With the mounting method according to the present embodiment, first the cartridge 33 is inserted into the holder 31 in a state where the cartridge 33 is tilted relative to the holder 31, as shown in FIG. 33. At this time, the first wall 101 of the cartridge 33 is tilted relative to the bottom 45 of the holder 31. At this time, the first wall 101 is tilted so as to approach the bottom 45 as the position of the first wall 101 approaches the fourth wall 104 side from the seventh wall 107 side. The second engaging portions 141 are inserted into the engaging holes 53, while the cartridge 33 is being moved closer to the bottom 45, in a state where the cartridge 33 is tilted relative to the holder 31. Note that a state where the engaging portion 119 of the cartridge 33 is positioned more in the positive Z-axis direction than the engagement portion 61 of the holder 31 is shown in FIG. 33.

Figure 34:
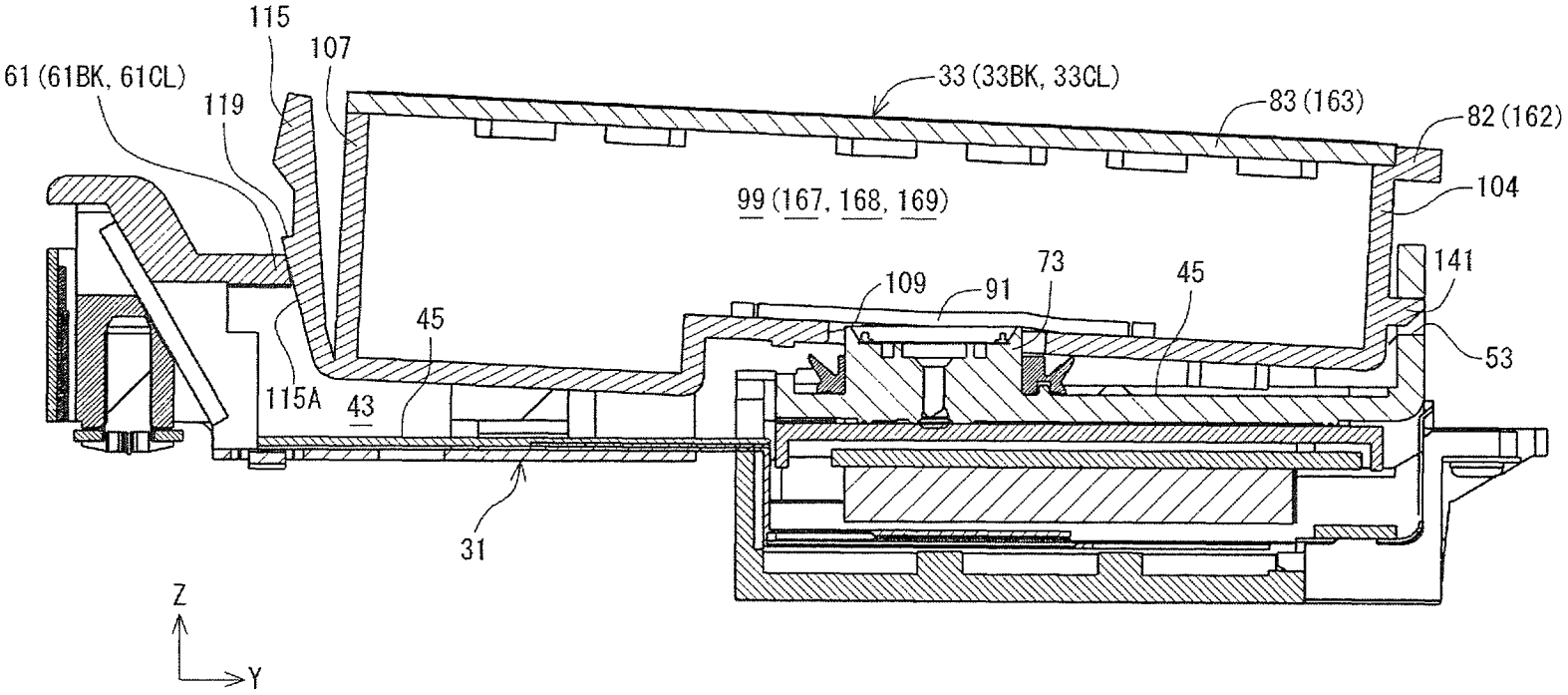
FIG. 34 illustrates a method of mounting a cartridge in a holder according to the embodiment.

Next, the cartridge 33 is rotated (turned) from the state shown in FIG. 33 with the second engaging portions 141 inserted in the engaging holes 53 as the turning fulcrum, so as to move the lever 115 closer to the bottom 45, that is, so as to push the seventh wall 107 side into the recessed portion 43 of the holder 31. This results in a guidance portion 115A of the lever 115 being guided by the engagement portion 61, as shown in FIG. 34. At this time, the lever 115 bends so as to approach the seventh wall 107. The cartridge 33 is thereby biased in the positive Y-axis direction by a reaction force from the lever 115. When the cartridge 33 is turned with the second engaging portions 141 as the turning fulcrum, the cartridge 33 is displaced in the Z-axis direction (mounting direction). When the cartridge 33 is displaced in the Z-axis direction, the bank portion 73 of the inlet portion 47 (inlet portions 49) is inserted into the supply hole 109 toward the inside of the cartridge 33. Note that, in FIG. 34, a state where the filter 91 is distorted in the positive Z-axis direction by the bank portion 73 inserted in the supply hole 109 toward the inside of the cartridge 33 is shown.

Figure 35:
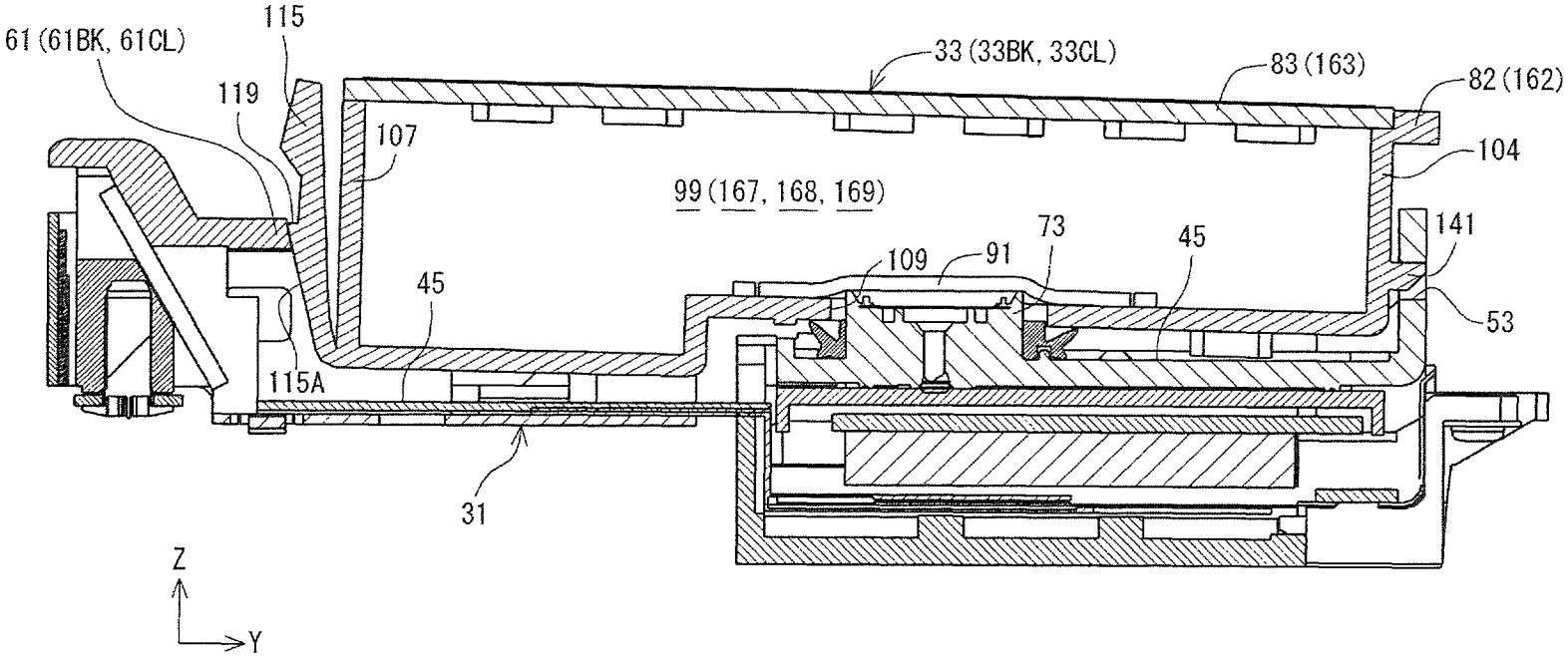
FIG. 35 illustrates a method of mounting a cartridge in a holder according to the embodiment.

When the cartridge 33 is turned further from the state shown in FIG. 34 so as to move the seventh wall 107 of the cartridge 33 closer to the bottom 45, the engaging portion 119 is pushed further in the negative Z-axis direction. This results in the lever 115 bending further toward the seventh wall 107, as shown in FIG. 35. At this time, the bank portion 73 is inserted further into the supply hole 109 toward the inside of the cartridge 33.

Figure 36:
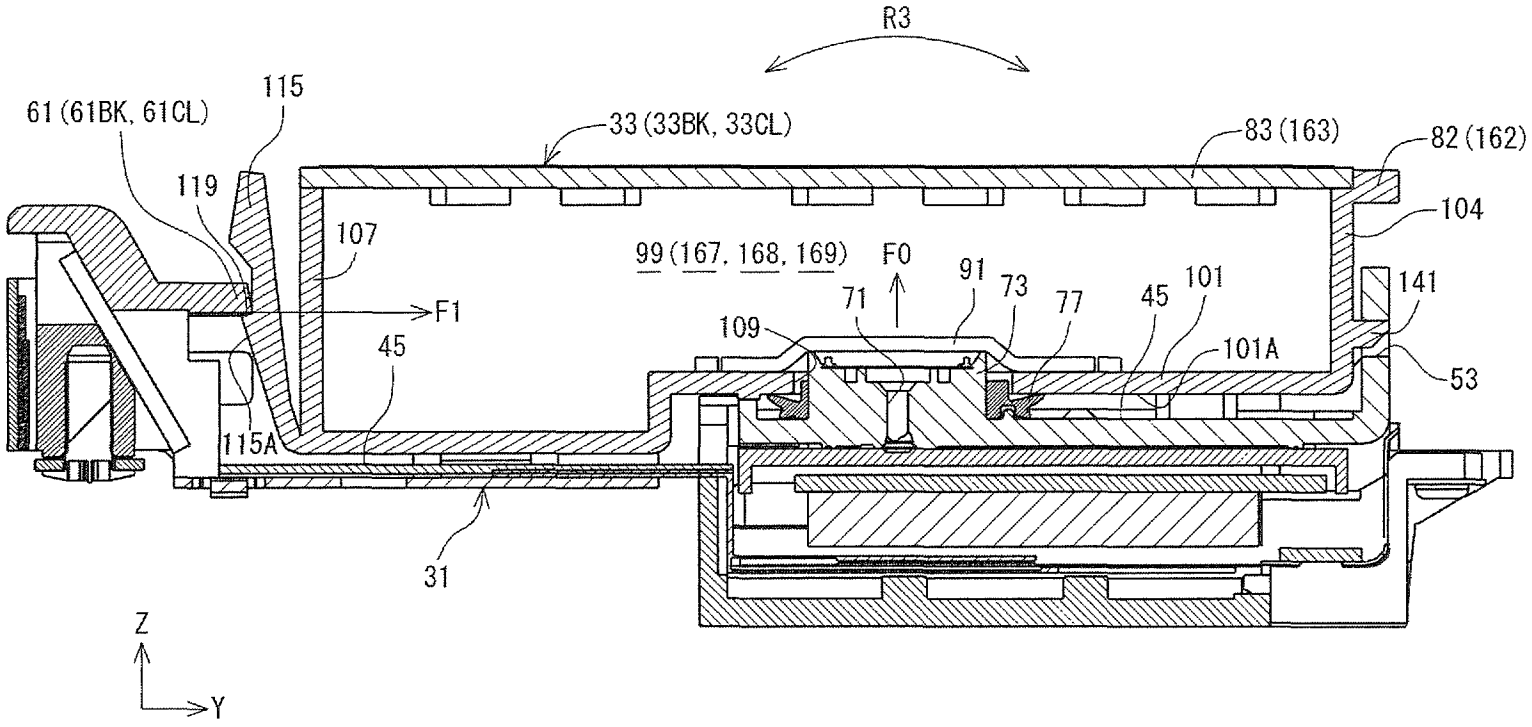
FIG. 36 illustrates the method of mounting a cartridge in a holder according to the embodiment.

When the cartridge 33 is turned further from the state shown in FIG. 35 so as to move the seventh wall 107 of the cartridge 33 closer to the bottom 45, the engaging portion 119 is pushed further in the negative Z-axis direction. Then when the engaging portion 119 is displaced further in the negative Z-axis direction than the engagement portion 61, the bending of the lever 115 is reduced and the engaging portion 119 engages the engagement portion 61, as shown in FIG. 36. The mounting of the cartridge 33 in the holder 31 is completed by the engaging portion 119 engaging the engagement portion 61. When the engaging portion 119 engages the engagement portion 61, the position of the cartridge 33 in the Z-axis direction is regulated.

When the engaging portion 119 has engaged the engagement portion 61, a reaction force F1 from the lever 115 caused by the bending of the lever 115 is biased in the positive Y-axis direction, as shown in FIG. 36. The fixing force of the cartridge 33 on the holder 31 is thereby increased. Also, in the present embodiment, the engaging portion 119 and the second engaging portions 141 are provided on opposite sides to each other across the recessed portion 99 (recessed portion 167, recessed portion 168, recessed portion 169). The positions on opposite sides in the Z-axis direction across the recessed portion (recessed portion 167, recessed portion 168, recessed portion 169) can thereby be regulated. Rocking in the direction in which the engaging portion 119 and the second engaging portions 141 are connected, that is, rocking in an R3 direction shown in FIG. 36, is thus more easily regulated. As a result, error in the position of the contact portions 131 relative to the terminal 67 can be reduced.

When mounting of the cartridge 33 to the holder 31 is completed, the packing 77 abuts the surface 101A of the cartridge 33. At this time, the packing 77 abuts the surface 101A in a bent state. The packing 77 abuts the surface 101A in a state of surrounding the circumference of the supply hole 109 from the outside of the supply hole 109. When ink is supplied to the channel 71 from the cartridge 33, ink that spills to the outside of the area surrounded by the bank portion 73 is dammed by the packing 77. Leaking of ink housed in the cartridge 33 into the holder 31 in a state where the cartridge 33 is mounted in the holder 31 is thereby more readily avoided. Note that, in a state where the cartridge 33 is mounted in the holder 31, a reaction force F0 from the packing 77 that is a reaction force received by the surface 101A from the packing 77 is exerted in the Z-axis direction and acts in the positive Z-axis direction. A reaction force exerted in the negative Z-axis direction against the reaction force F0 respectively acts on the engaging portion 119 and the second engaging portions 141. The fixing force of the cartridge 33 on the holder 31 is further increased by the action of these forces.

Figure 37:
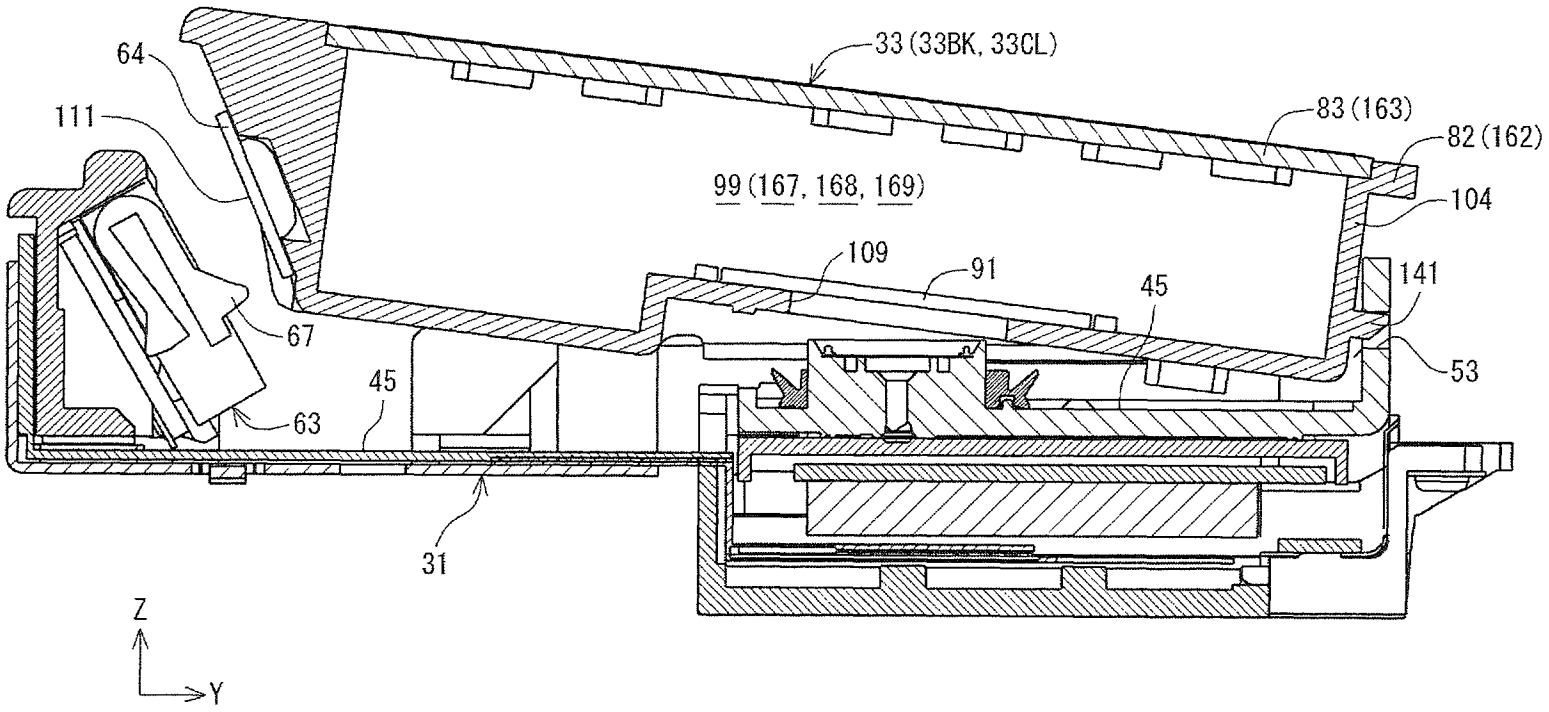
FIG. 37 illustrates the connection between the circuit substrate and the contact mechanism according to the embodiment.
Figure 38:
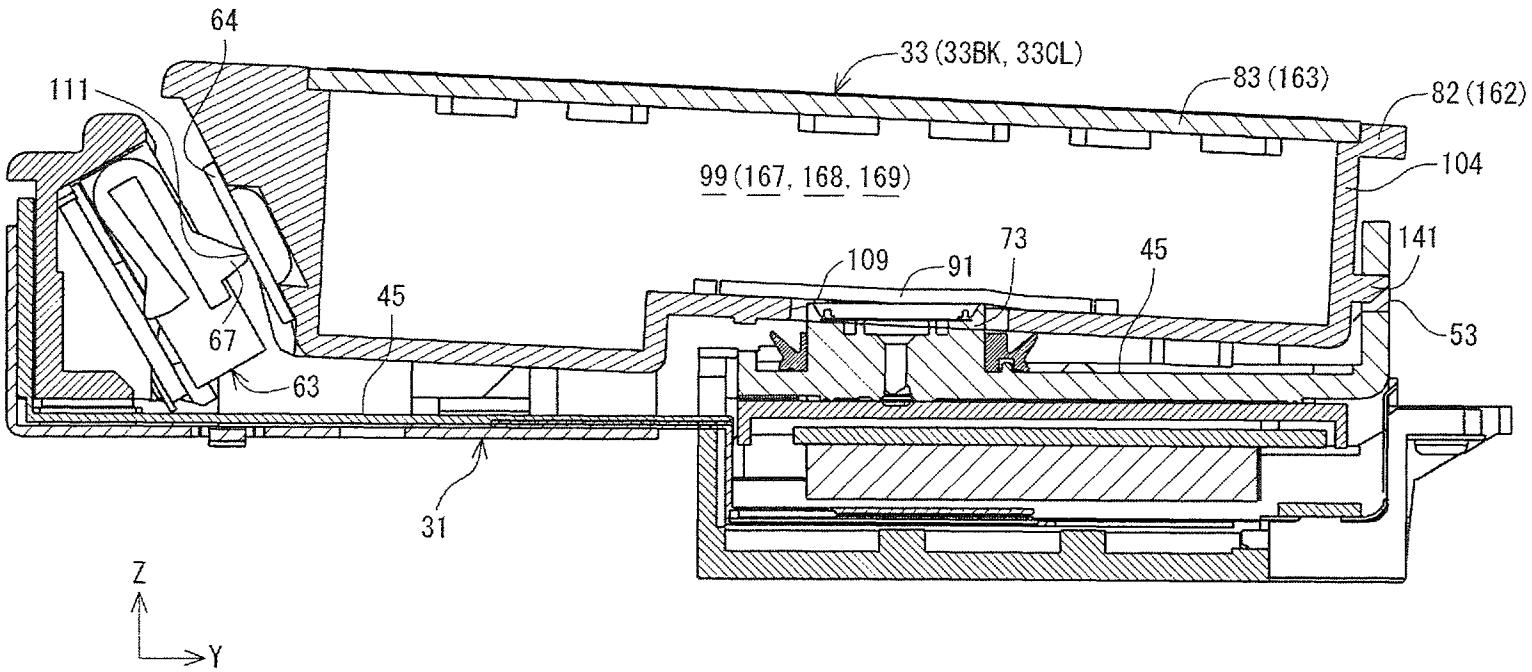
FIG. 38 illustrates the connection between the circuit substrate and the contact mechanism according to the embodiment.

Note that, in a state where the engaging portion 119 of the cartridge 33 is positioned more in the positive Z-axis direction than the engagement portion 61 of the holder 31 (state shown in FIG. 33), the electrodes 111 of the circuit substrate 64 are at a distance from the terminals 67 of the contact mechanism 63, as shown in FIG. 37. The turning position of the cartridge 33 relative to the holder 31 shown in FIG. 37 corresponds to the turning position of the cartridge 33 relative to the holder 31 shown in FIG. 33. When the cartridge 33 is turned from the state shown in FIG. 33 with the second engaging portions 141 as the fulcrum, and changes to the state shown in FIG. 34, the electrodes 111 of the circuit substrate 64 come in contact with the terminals 67 of the contact mechanism 63, as shown in FIG. 38. At this time, the terminals 67 contact the electrodes 111 further in the positive Z-axis direction than the contact portions 131 (FIG. 16). The turning position of the cartridge 33 relative to the holder 31 shown in FIG. 38 corresponds to the turning position of the cartridge 33 relative to the holder 31 shown in FIG. 34.

Figure 39:
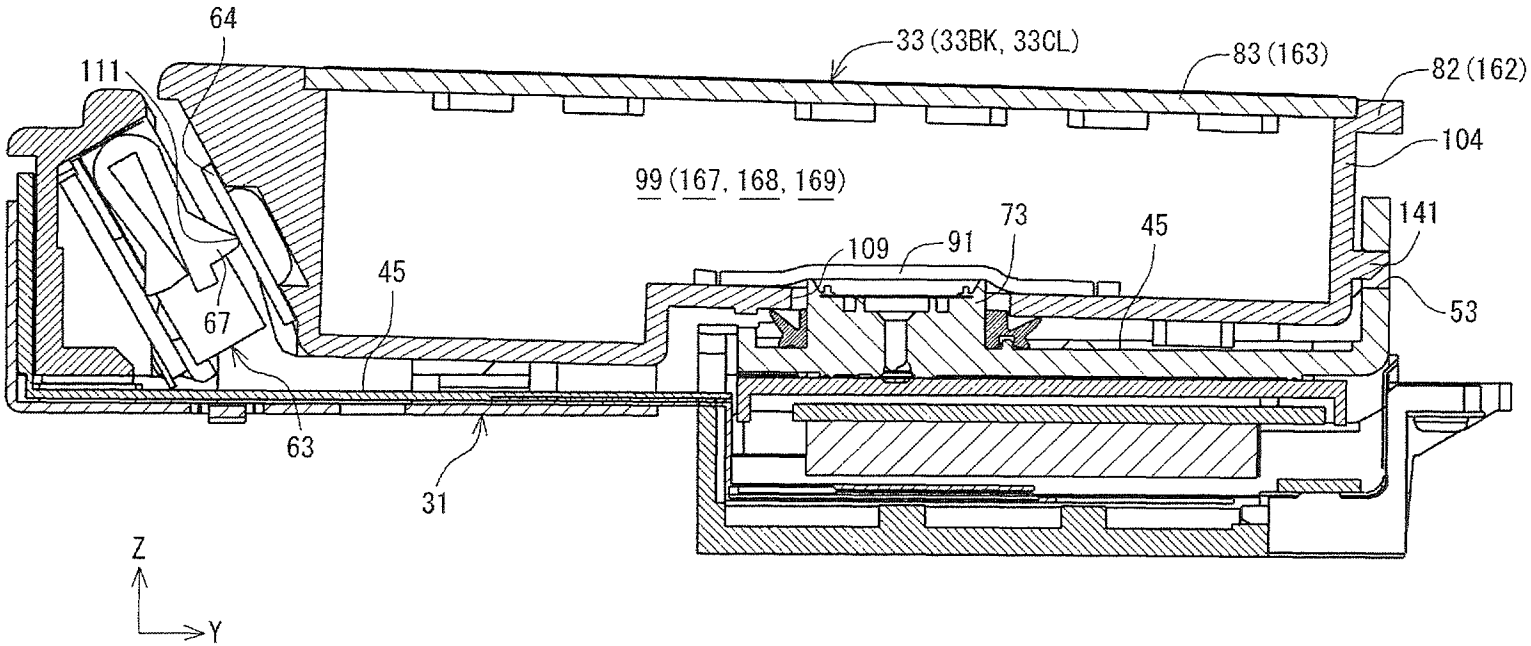
FIG. 39 illustrates the connection between the circuit substrate and the contact mechanism according to the embodiment.

When the cartridge 33 is turned from the state shown in FIG. 34 with the second engaging portions 141 as the fulcrum, and changes to the state shown in FIG. 35, the terminals 67 bend due to the force from the electrodes 111, as shown in FIG. 39. At this time, the terminals 67 have approached the contact portions 131 (FIG. 16), compared with the state shown in FIG. 38. In other words, in the process of changing from the state shown in FIG. 38 to the state shown in FIG. 39, the terminals 67 rub against the electrodes 111 and bend. The turning position of the cartridge 33 relative to the holder 31 shown in FIG. 39 corresponds to the turning position of the cartridge 33 relative to the holder 31 shown in FIG. 35.

Figure 40:
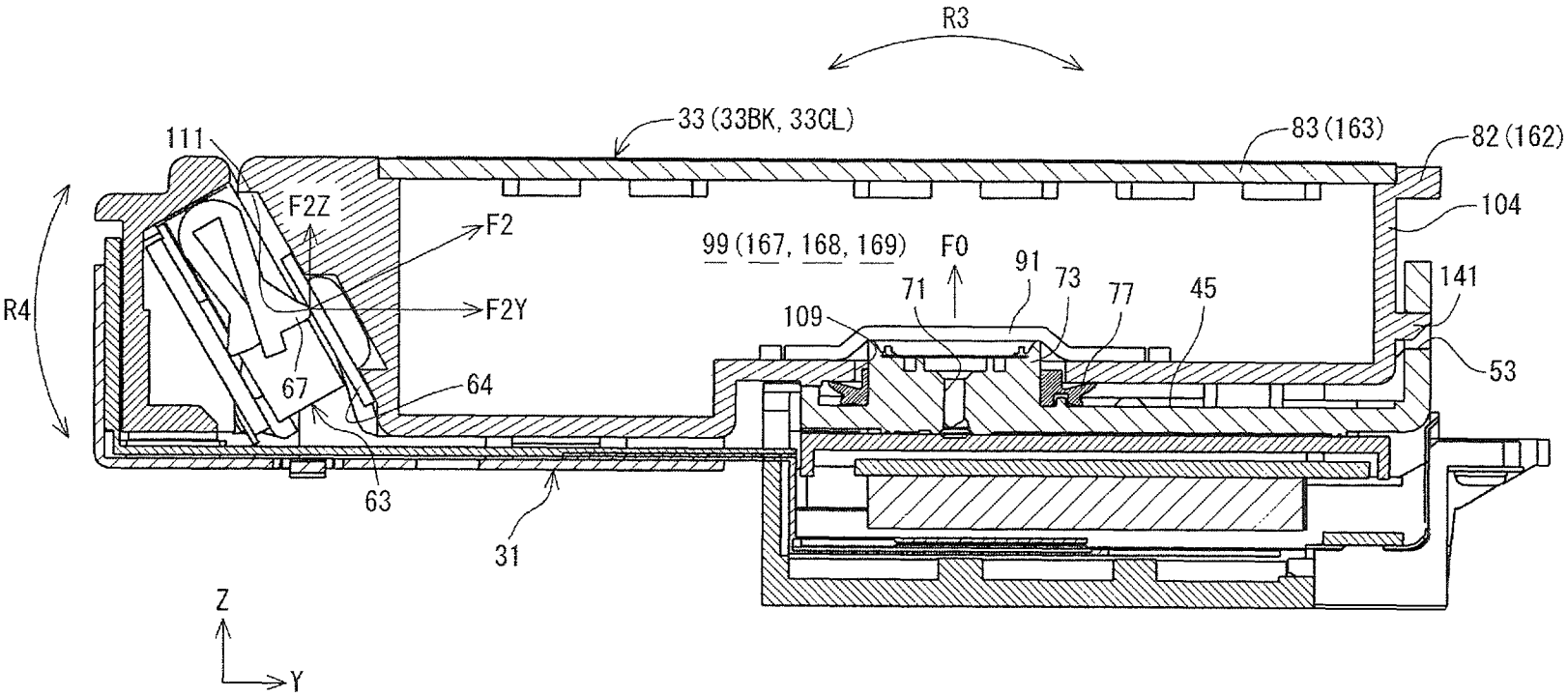
FIG. 40 illustrates the connection between the circuit substrate and the contact mechanism according to the embodiment.

When the cartridge 33 is turned from the state shown in FIG. 35 with the second engaging portions 141 as the fulcrum, and changes to the state shown in FIG. 36, the terminals 67 bends further due to the force from the electrodes 111, as shown in FIG. 40. The turning position of the cartridge 33 relative to the holder 31 shown in FIG. 40 corresponds to the turning position of the cartridge 33 relative to the holder 31 (position at which mounting is completed) shown in FIG. 36.

When mounting of the cartridge 33 to the holder 31 is completed, the terminals 67 reach to the contact portions 131 (FIG. 16). In the process of changing from the state shown in FIG. 39 to the state shown in FIG. 40, the terminals 67 rub against the electrodes 111 and bend. In other words, the terminals 67 rub against the electrodes 111 and bend, from when the electrodes 111 come in contact with the terminals 67 until when mounting of the cartridge 33 in the holder 31 is completed. When mounting of the cartridge 33 in the holder 31 is completed, the electrical connection between the plurality of electrodes 111 and the plurality of terminals 67 is maintained. Various information can thereby be transmitted between the electrical circuit provided on the circuit substrate 64 of the cartridge 33 and the control circuit of the printer 1.

Figure 41:
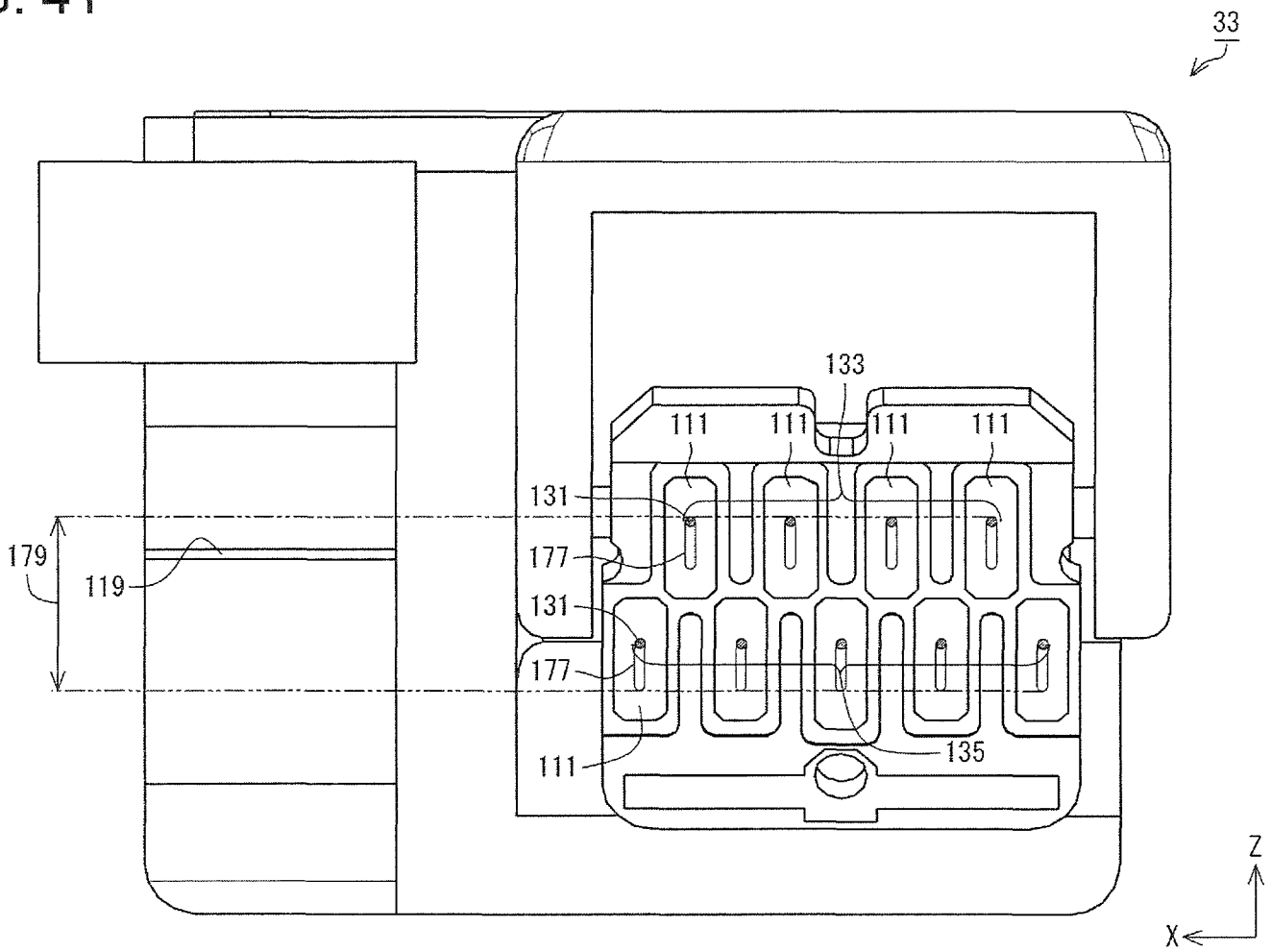
FIG. 41 is a front view showing the cartridge according to the embodiment.

The trajectory with which the terminals 67 contact with the electrodes 111, from when the electrodes 111 come in contact with the terminals 67 until when mounting of the cartridge 33 in the holder 31 is completed, is defined as a friction area 177, as shown in FIG. 41. The friction area 177 is an area rubbed by the terminals 67 in the inclination direction K (FIG. 17), when the cartridge 33 is mounted in the holder 31. In the present embodiment, the position of the engaging portion 119 relative to the plurality of electrodes 111 in the mounting direction (Z-axis direction) is within a range 179 of the plurality of friction areas 177 in the first array 133 and the plurality of friction areas 177 in the second array 135, as shown in FIG. 41.

When mounting of the cartridge 33 in the holder 31 is completed, the reaction force F1 from the lever 115 acts on the cartridge 33, as shown in FIG. 36. The reaction force F1 is a force acting in the positive Y-axis direction. Also, when mounting of the cartridge 33 to the holder 31 is completed, a reaction force F2 from the terminals 67 acts on the circuit substrate 64, as shown in FIG. 40. The reaction force F2 is represented as the resultant force of a force component F2Y that is the component in the positive Y-axis direction and a force component F2Z that is the component in the positive Z-axis direction. As mentioned above, in the present embodiment, the engaging portion 119 is located between the first array 133 and the second array 135 in the mounting direction (FIG. 16). This enables the position on which the reaction force F1 from the lever 115 acts and the position on which the reaction force F2Y acts to be brought close to each other in the Z-axis direction.

Hypothetically, when the position of the engaging portion 119 in the mounting direction is outside the range between the first array 133 and the second array 135, the position on which the reaction force F1 acts and the position on which the reaction force F2Y acts move away from each other in the Z-axis direction. When the position on which the reaction force F1 acts and the position on which the reaction force F2Y acts move away from each other in the Z-axis direction, a moment with the second engaging portions 141 as the fulcrum tends to occur in the cartridge 33, due to the difference in strength between the reaction force F1 and the reaction force F2Y. This moment tends to induce rocking of the cartridge 33 in an R4 direction shown in FIG. 40.

In contrast, in the present embodiment, the position on which the reaction force F1 from the lever 115 acts and the position on which the reaction force F2Y acts can be brought close to each other in the Z-axis direction, allowing rocking of the cartridge 33 to be more readily suppressed. Error in the position of the contact portions 131 relative to the terminals 67 can thereby be reduced. Also, the engaging portion 119 is located between the first array 133 and the second array 135 in the mounting direction, enabling the distance between the plurality of contact portions 131 and the engaging portion 119 to be shortened. Error in the position of the contact portions 131 relative to the terminals 67 can thus be reduced. The reliability of the electrical connection between the terminals 67 and the electrodes ills is thereby more readily secured. Also, the position of the engaging portion 119 relative to the plurality of electrodes 111 falls between the first array 133 and the second array 135 in the mounting direction, enabling the distance between the plurality of contact portions 131 and the engaging portion 119 to be shortened. The cartridge 33 is thus more readily miniaturized in the mounting direction. As a result, according to the present embodiment, the cartridge 33 is more readily made thinner in the mounting direction, while securing the reliability of the electrical connection between the terminals 67 and the electrodes 111.

In the present embodiment, the second engaging portions 141 are provided at approximately the same height as the engaging portion 119 (FIG. 19). The position of the reaction force F1 that acts on the cartridge 33 can be made approximately the same as the height of the second engaging portions 141 which act as the turning fulcrum of the cartridge 33. In other words, in the cartridge 33, the height at which the reaction force F1 acts and the height of the turning fulcrum are more readily aligned with each other. Hypothetically, when the height at which the reaction force F1 acts and the height of the turning fulcrum are not aligned with each other, a moment tends to occur in the R4 direction shown in FIG. 40. This moment tends to induce rocking of the cartridge 33 in the R4 direction. In contrast, in the present embodiment, the height at which the reaction force F1 acts and the height of the turning fulcrum are approximately the same as each other, allowing the occurrence of a moment to be more readily suppressed. Rocking of the cartridge 33 is thereby more readily suppressed. As a result, error in the position of the contact portions 131 relative to the terminals 67 can be reduced.

In the present embodiment, all the contact portions 131 are located within a range from one quarter to three quarters of the height of the cartridge 33 in the Z-axis direction (FIG. 16). The plurality of contact portions 131 are thereby located toward the middle of the height of the cartridge 33 in the Z-axis direction, allowing the occurrence of a moment in the R4 direction shown in FIG. 40 to be more readily suppressed. Rocking of the cartridge 33 is thereby more readily suppressed. As a result, error in the position of the contact portions 131 relative to the terminals 67 can be reduced.

In the present embodiment, the position of the engaging portion 119 in the mounting direction (Z-axis direction) is within the range of the plurality of friction areas 177 in the first array 133 and the plurality of friction areas 177 in the second array 135 (FIG. 41). Generally, when the cartridge 33 is mounted in the holder 31, the terminals 67 shift a predetermined distance while rubbing against the surface of the electrodes 111. Dust and the like adhering to the surface of the electrodes 111 can thereby be removed. As a result, excellent contact with the electrodes 111 can be secured. Here, when the friction area 177 is too large, the terminals 67 may wear down portions other than electrodes 111. Dust produced as a result could also possibly lead to a faulty connection. Thus, it is important to dispose the engaging portion 119 so that error also does not occur in the friction area 177 of the electrodes 111. At this time, error of the friction area 177 relative to the position where the engaging portion 119 engages the engagement portion 61 can be reduced, the closer the position where the engaging portion 119 engages the engagement portion 61 is to the friction area 177. The precision of the range of the friction area 177 can thereby be enhanced.

Figure 42:
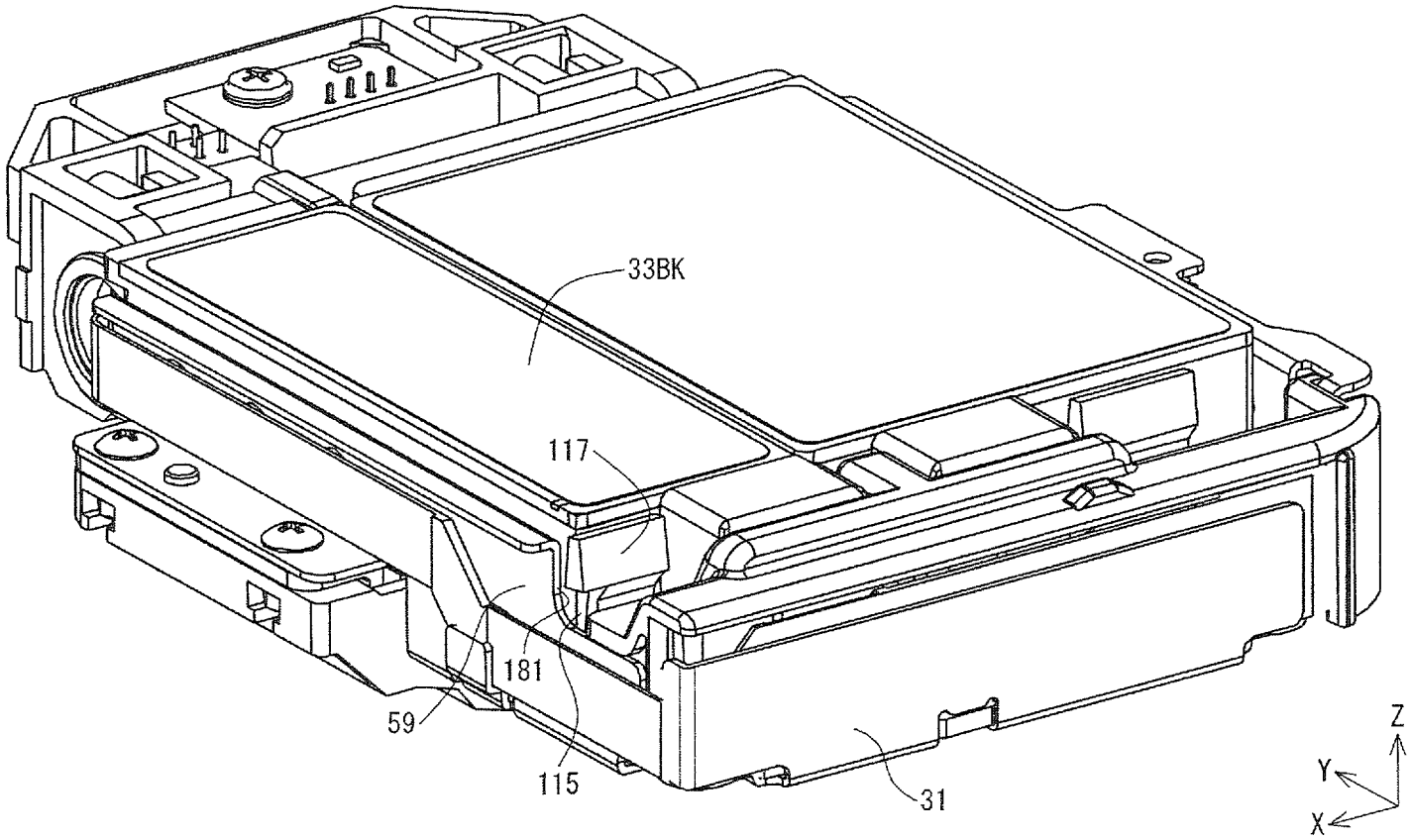
FIG. 42 is a perspective view showing a holder and cartridges according to the embodiment.

In the present embodiment, a notch portion 181 is provided in the side wall 59 of the holder 31, as shown in FIG. 42. The notch portion 181 is provided in an area overlapping with the gripping portion 117 of the lever 115, in a state where the cartridge 33BK is mounted in the holder 31. This notch portion 181 allows the operator to more readily reach the gripping portion 117 of the lever 115 with his or her fingers. The operability of the lever 115 is thereby enhanced. Also, the notch portion 181 allows interference between the gripping portion 117 and the holder 31 to be more readily avoided. Furthermore, the gripping portion 117 can be positioned inside the notch portion 181, enabling the holder 31 to be more readily miniaturized. In other words, in the present embodiment, the holder 31 is more readily miniaturized, while maintaining the operability of the lever 115. As a result, miniaturization of the printer 1 is more readily achieved.

Note that, in the present embodiment, a configuration in which the supply hole 109 is provided in the first wall 101 of the cartridge 33 is employed. However, the location of the supply hole 109 is not limited to the first wall 101, and any of the second wall 102 to the seventh wall 107 can be employed. The second casing 83 and the second casing 163 can also be employed as the location of the supply hole 109.

In the present embodiment, a configuration in which the lever 115 has the engaging portion 119 and is provided on the cartridge 33 and the engagement portion 61 is provided on the holder 31 is employed. However, the configuration of the lever 115 and the holder 31 is not limited thereto. A configuration in which the engagement portion 61 is provided on the cartridge 33 and the lever 115 has the engaging portion 119 and is provided on the holder 31 can also be employed as the configuration of the lever 115 and the holder 31.

Although, in the present embodiment, a configuration in which the lever 115 is formed integrally with the first casing 82 (first casing 162) is employed, the configuration of the lever 115 is not limited thereto. A configuration in which the lever 115 is formed separately to the first casing 82 (first casing 162) can also be employed as the configuration of the lever 115. In this case, the lever 115 can be constituted integrally with the first casing 82 (first casing 162) by the lever 115 being connected thereto, joined by crimping, fitting together or the like, or joined with screws or the like. Also, various materials, including a metal or a synthetic resin such as a plastic, can be employed as the material of the lever 115. Also, the lever 115 may be spring-like in shape, as long as a configuration is employed in which the engaging portion 119 engages with and disengages from the engagement portion 61 through elastic deformation.

Figure 43:
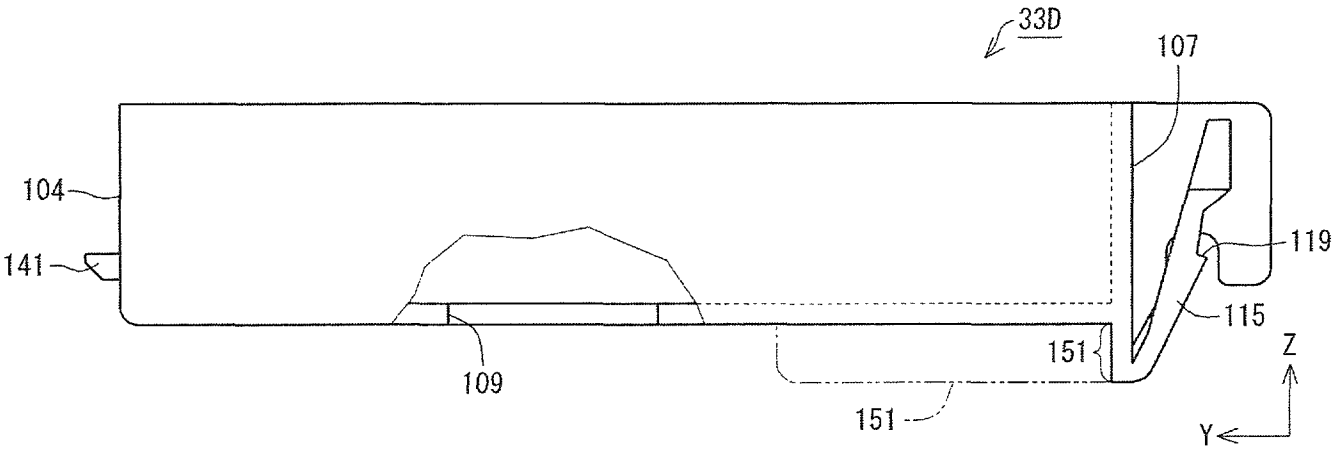
FIG. 43 is a side view showing a cartridge of a variation 1.

Variations regarding the cartridge 33 will now be described. Note that, in the following variations, similar constituent elements to the above embodiment will be given the same reference numerals as the above embodiment, and a detailed description thereof will be omitted. Also, the following variations are each applicable to both the cartridge 33BK and the cartridge 33CL. In a cartridge 33D of variation 1, a projecting region 151 has, as shown in FIG. 43, been reduced in comparison with the projecting region 151 of the cartridge 33 (shown by a two-dot chain line). In the example shown in FIG. 43, the projecting region 151 has been reduced to a position equivalent in the thickness of the seventh wall 107. Similar effects to the cartridge 33 are also obtained with this cartridge 33D.

Figure 44:
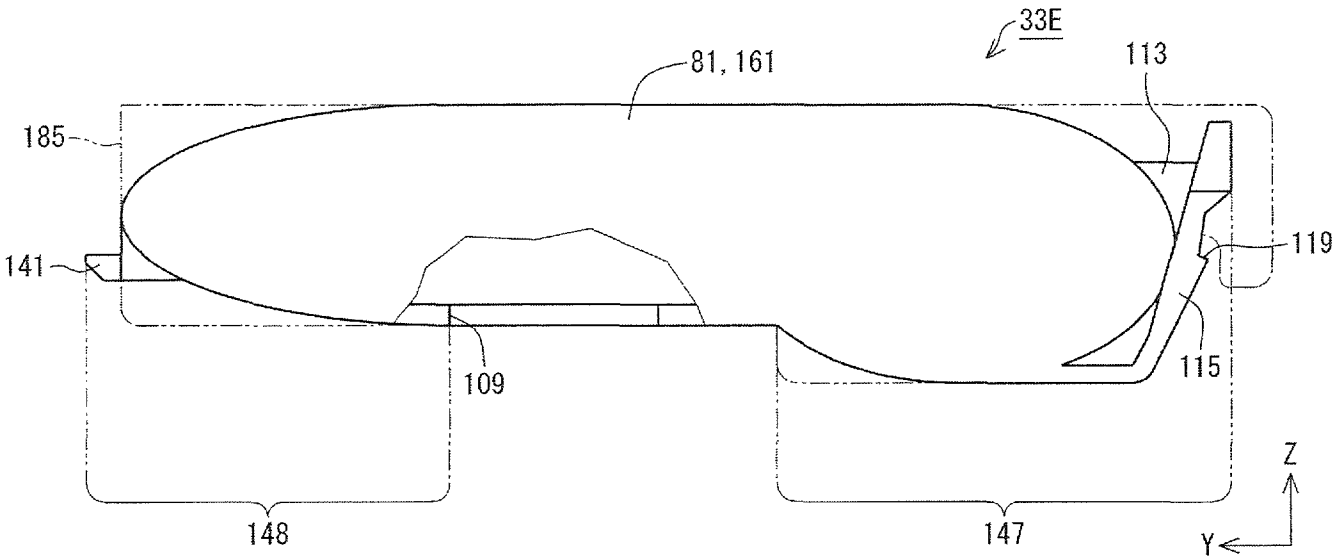
FIG. 44 is a side view showing a cartridge of variation 2.

In a cartridge 33E of variation 2, a casing 81 (casing 161) constituting an outer shell is constituted by a surface that includes a curved surface, as shown in FIG. 44. Similar effects to the cartridge 33 are also obtained with the cartridge 33E. In FIG. 44, an outline area 185 representing an outline of the cartridge 33 is shown with a two-dot chain line. Various outline forms, including curved surfaces and planar surfaces, can thus be employed, provided they are within the range of the outline area 185.

Figure 45:
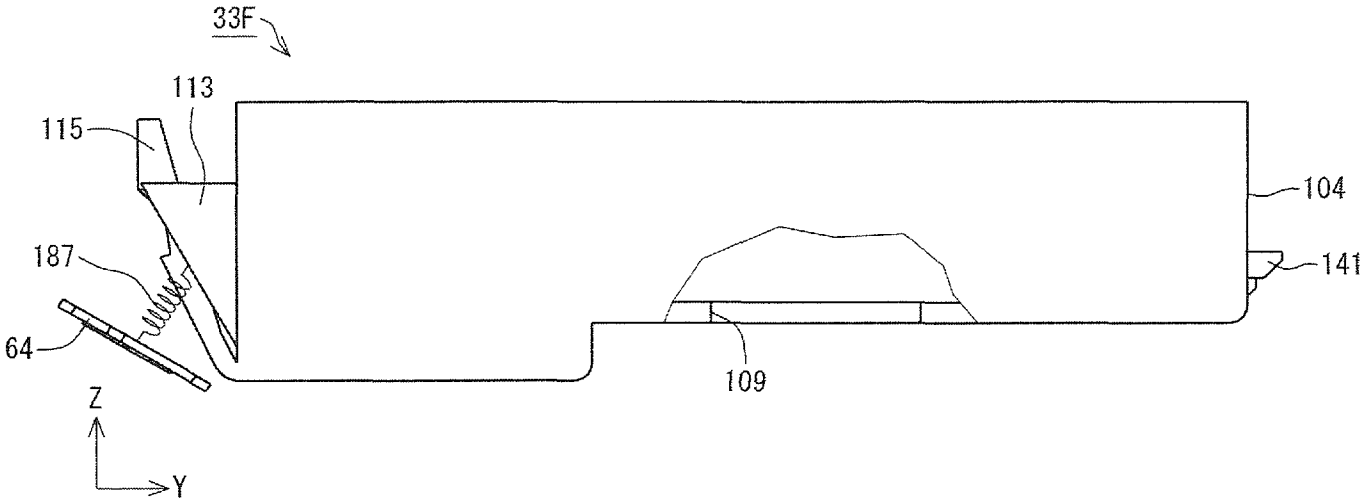
FIG. 45 is a side view showing a cartridge of variation 3.
Figure 46:
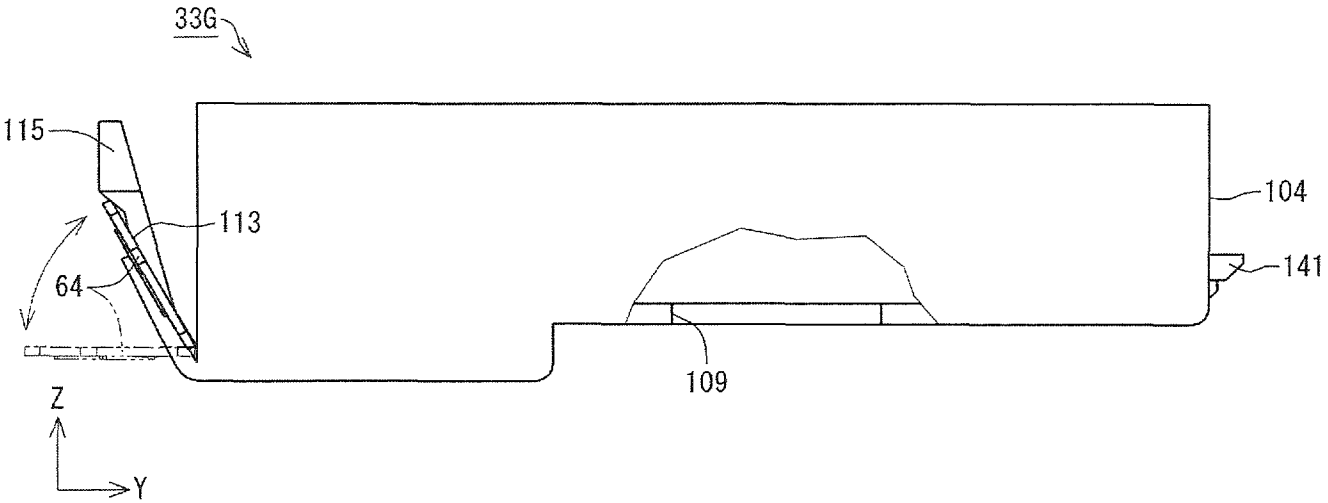
FIG. 46 is a side view showing a cartridge of variation 4.

In a cartridge 33F of variation 3, a circuit substrate 64 is attached to a substrate installation portion 113 via a spring 187, as shown in FIG. 45. In a cartridge 33G of variation 4, a substrate installation portion 113 is, as shown in FIG. 46, movable in the arrow direction in the diagram. Similar effects to the cartridge are also obtained with the cartridge 33F and the cartridge 33G.

Figure 47:
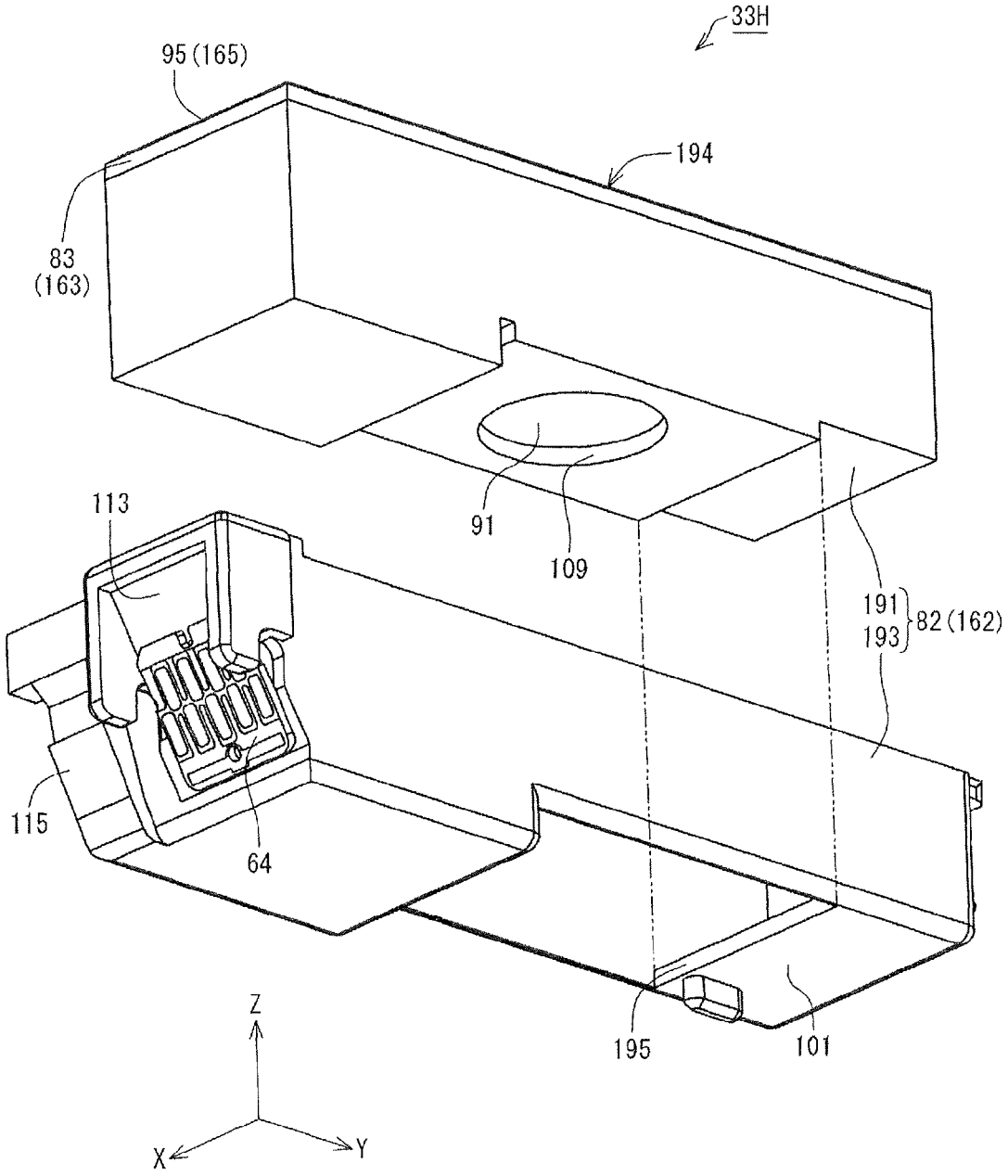
FIG. 47 is a perspective view showing a cartridge of variation 5.

In a cartridge 33H of variation 5, a first casing 82 (first casing 162) has a first member 191 and a second member 193, as shown in FIG. 47. The first member 191 and the second member 193 are constituted separately to each other. A recessed portion 99 (recessed portions 167 to 169) (not shown) in which ink is housed is provided in the first member 191. Furthermore, a supply hole 109 is provided in the first member 191. A filter 91 and a holding member 93 (not shown) are housed in the first member 191. Ink is housed inside the first member 191. A second casing 83 (second casing 163) is provided in the first member 191. Furthermore, a sheet member 95 (sheet member 165) is provided in the second casing 83 (second casing 163). A supply unit 194 is thereby constituted. The supply unit 194 has a configuration in which the second casing 83 (second casing 163) and the sheet member 95 (sheet member 165) are provided in the first member 191 in which the filter 91 and the holding member 93 are housed.

Figure 48:
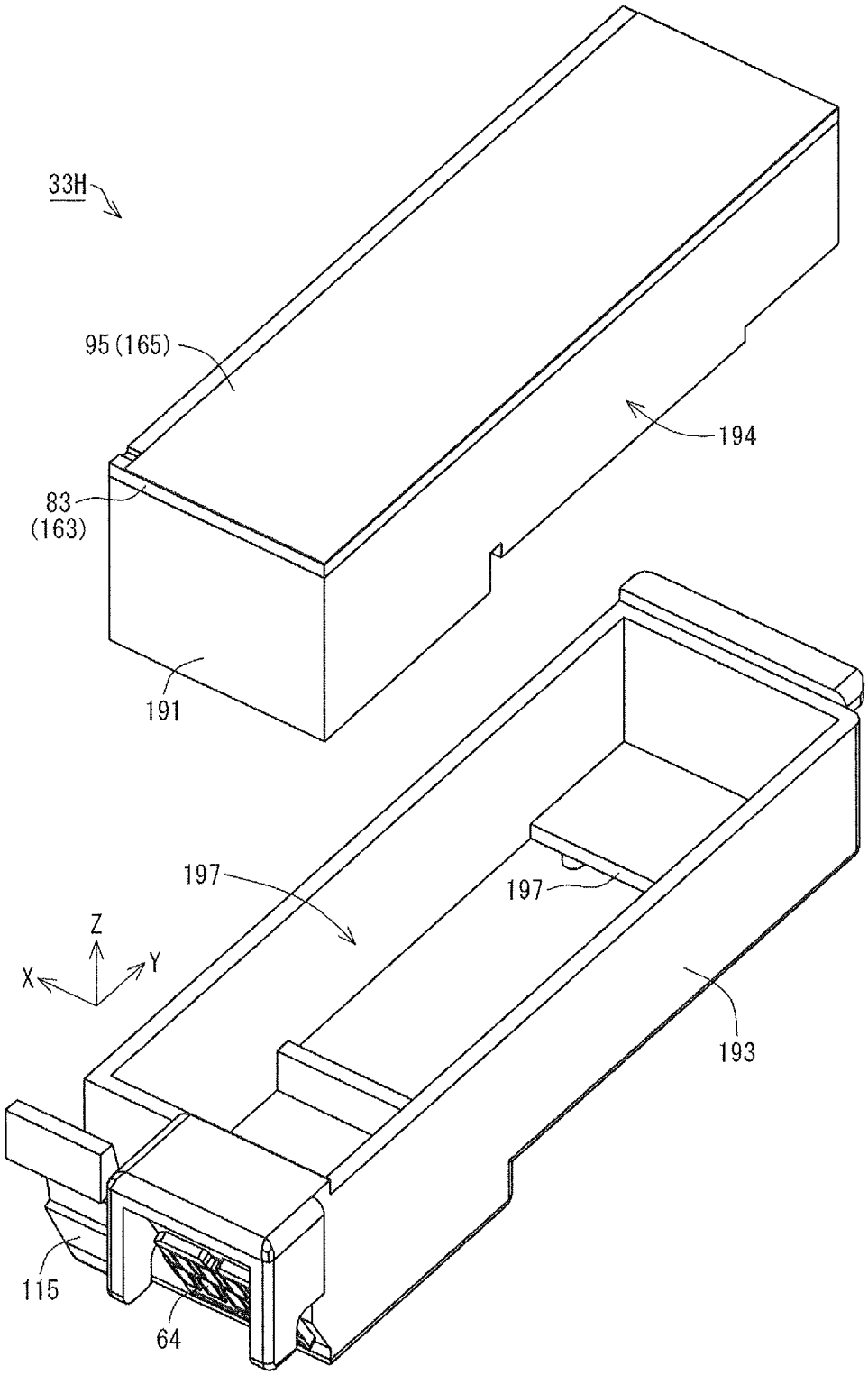
FIG. 48 is a perspective view showing the cartridge of variation 5.

A circuit substrate 64, a substrate installation portion 113, and a lever 115 are provided on the second member 193. A second engaging portion 141 (not shown) is also provided on the second member 193. An opening 195 is provided in a first wall 101 of the second member 193. A recessed portion 197 is provided in the second member 193, as shown in FIG. 48. The first member 191 is configured to be housed inside the recessed portion 197. The opening 195 is provided in an area overlapping with the supply hole 109 (FIG. 47) of the first member 191. The supply hole 109 of the first member 191 is exposed through the opening 195 of the second member 193, in a state where the first member 191 is housed in the recessed portion 197 of the second member 193.

With the above configuration, the second member 193 can be mounted in the holder 31. Also, the inlet portion 47 (inlet portions 49) (FIG. 5) can be connected to the supply hole 109 of the first member 191, in a state where the second member 193 is mounted in the holder 31. Similar effects to the cartridge 33 are also obtained with the cartridge 33H. Furthermore, with the cartridge 33H, the operator is able to replace the first member 191 with a new first member 191 when the cartridge 33H runs out of ink. Ink housed in the new first member 191 can thereby be used. The operator is also able to replenish the first member 191 with new ink when the cartridge 33H runs out of ink. The new ink with which the first member 191 is replenished can thereby be used. With the cartridge 33H, the second member 193 can thus be repeatedly used.

Figure 49:
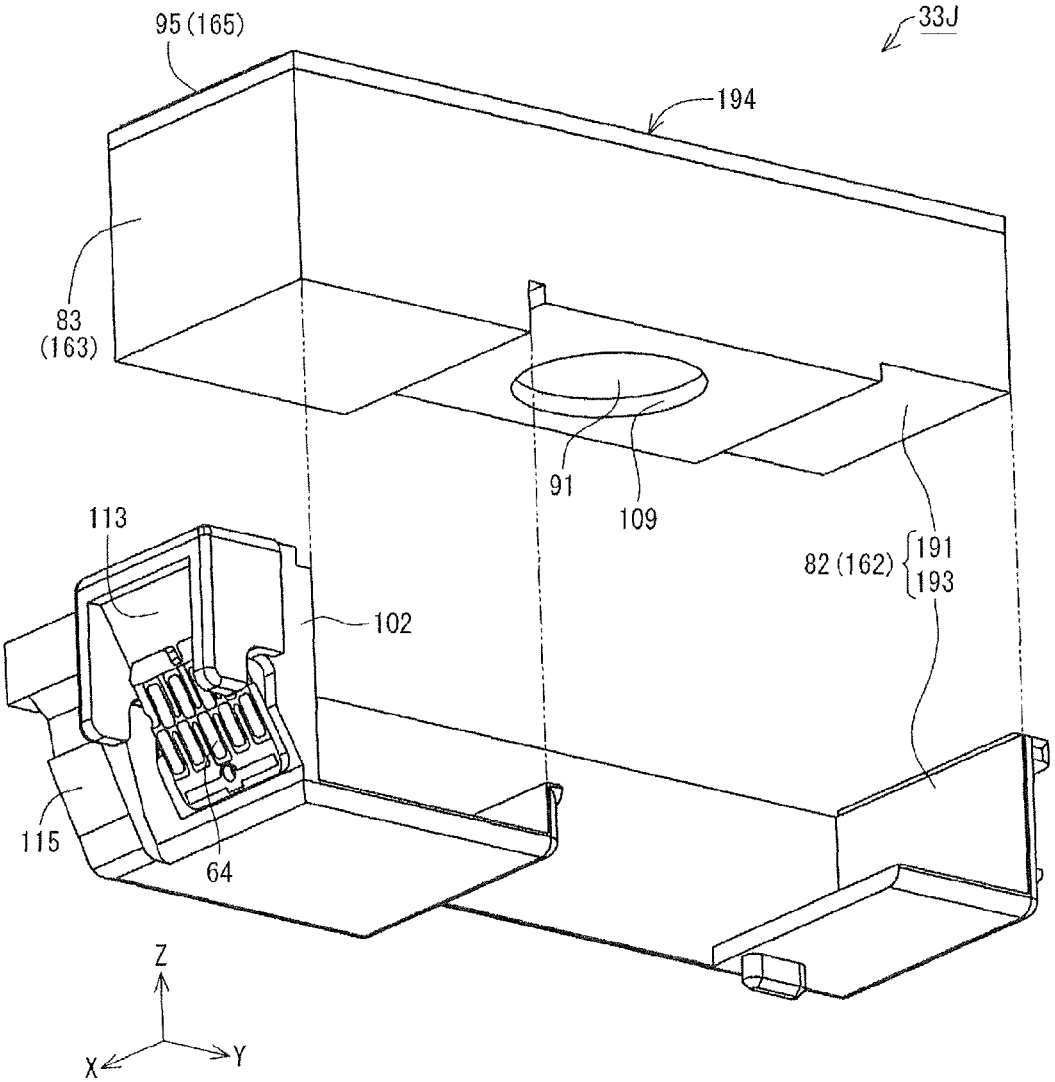
FIG. 49 is a perspective view showing a cartridge of variation 6.

In a cartridge 33J of variation 6, part of a second wall 102 of a second member 193 has been removed, as shown in FIG. 49, and the first member 191 extends to the area removed from the second wall 102. Apart from these points, the cartridge 33J has a similar configuration to the cartridge 33H. Hereinafter, the same reference numerals as the cartridge 33H are thus given to constituent elements that are similar to the cartridge 33H, and a detailed description will be omitted. Similar effects to the cartridge 33 and the cartridge 33H are also obtained with the cartridge 33J. Furthermore, with the cartridge 33J, the first member 191 can be extended by the amount removed from the second wall 102, compared with the cartridge 33H. As a result, the cartridge 33J enlarges the ink capacity of the supply unit 194, compared with the cartridge 33H.

Figure 50:
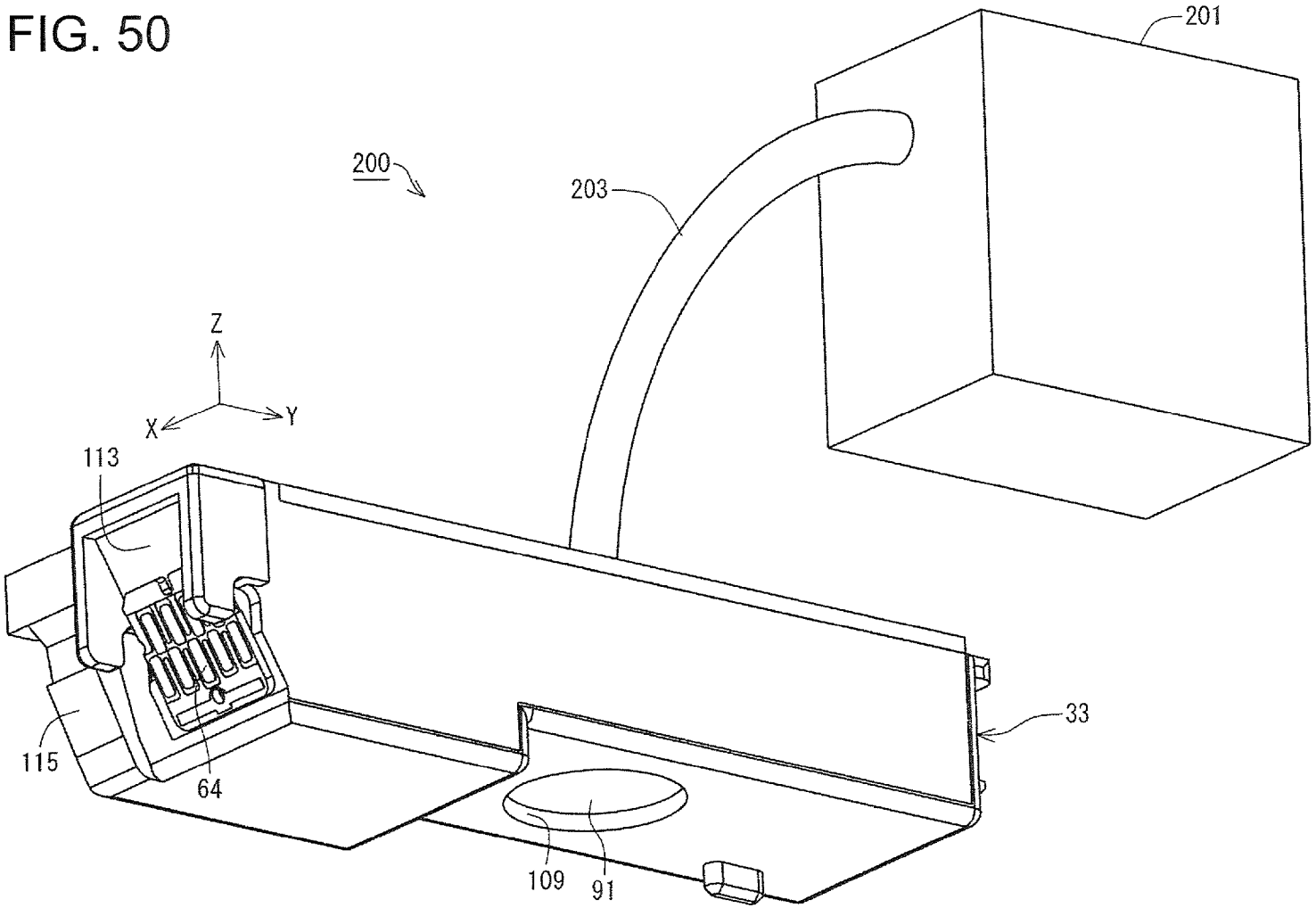
FIG. 50 is a perspective view showing an ink supply system of variation 7.

An ink supply system 200 of variation 7 has a cartridge 33, a tank 201 and a tube 203, as shown in FIG. 50. Ink is housed in the tank 201. With the ink supply system 200, more ink than the volume of ink that can be housed in the cartridge 33 can be housed in the tank 201. The tank 201 is provided independently to the carriage 25 (FIG. 5). Provided the installation position of the tank 201 is independent of the carriage 25, both the outside and the inside of the casing 3 (FIG. 1) of the printer 1 can be employed as the installation position. The tube 203 connects between the tank 201 and the cartridge 33. The inside of the tank 201 and the cartridge 33 communicate through the tube 203.

Ink in the tank 201 is supplied into the cartridge 33 through the tube 203. The tube 203 is flexible. Displacement of the carriage 25 is thus not obstructed even if the tank 201 is provided independently of the carriage 25. With this ink supply system 200, more ink than the volume of ink that is capable of being housed in the cartridge 33 can be continuously supplied to the print head 41. The frequency with which the cartridge 33 is replaced can thus be reduced. Note that, in the case where ink in the tank 201 is low or has run out, the operator is able to replace the tank 201 with a new tank 201. Ink housed in the new tank 201 can thereby be used. The operator is also able to replenish the tank 201 with new ink, in the case where ink in the tank 201 is low or has run out. The new ink with which the tank 201 is replenished can thereby be used.

Figure 51:
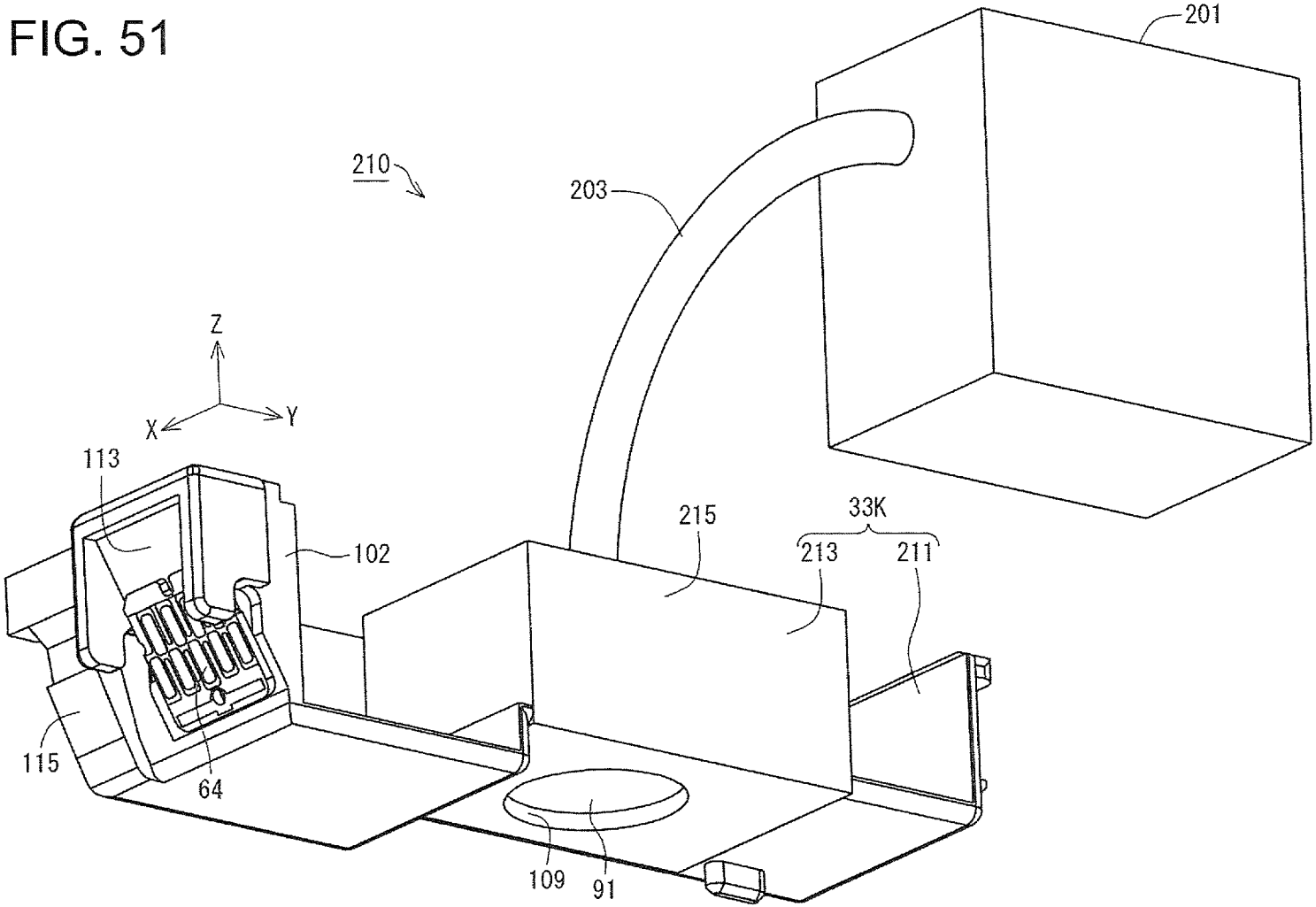
FIG. 51 is a perspective view showing an ink supply system of variation 8.

An ink supply system 210 of variation 8 has a cartridge 33K, a tank 201 and a tube 203, as shown in FIG. 51. A detailed description of the tank 201 and the tube 203, which are respectively the same as the tank 201 and the tube 203 in the ink supply system 200 (variation 7), will be omitted. The cartridge 33K has an adapter 211 and a relay unit 213. A detailed description of the adapter 211, which is similar to the second member 193 in the cartridge 33J of variation 6, will be omitted. Note that the second member 193 in the cartridge 33H of variation 5 can also be employed as the adapter 211. The adapter 211 and the relay unit 213 are constituted separately to each other.

The relay unit 213 has a container 215. A housing portion (not shown) for housing ink is provided in the container 215. Furthermore, a supply hole 109 that passes through the housing portion is provided in the container 215. A filter 91 and a holding member 93 (not shown) are provided in the housing portion of the container 215. The tube 203 connects the tank 201 to the relay unit 213. The inside of the tank 201 communicates with the inside of the container 215 through the tube 203. Ink in the tank 201 is supplied to inside the relay unit 213 through the tube 203. Note that the supply unit 194 of the cartridge 33J or the cartridge 33H can also be employed as the relay unit 213.

Similar effects to ink supply system 200 are also obtained with this ink supply system 210. Furthermore, this ink supply system 210 enables the operator to replace the tank 201 and the relay unit 213 with a new tank and relay unit without disconnecting the tube 203, in the case where ink in the tank 201 is low or has run out. Leaking or dripping of ink during replacement is more readily avoided in comparison with the casing where only the tank 201 is replaced or where the tank 201 and the tube 203 are replaced.

Figure 52:
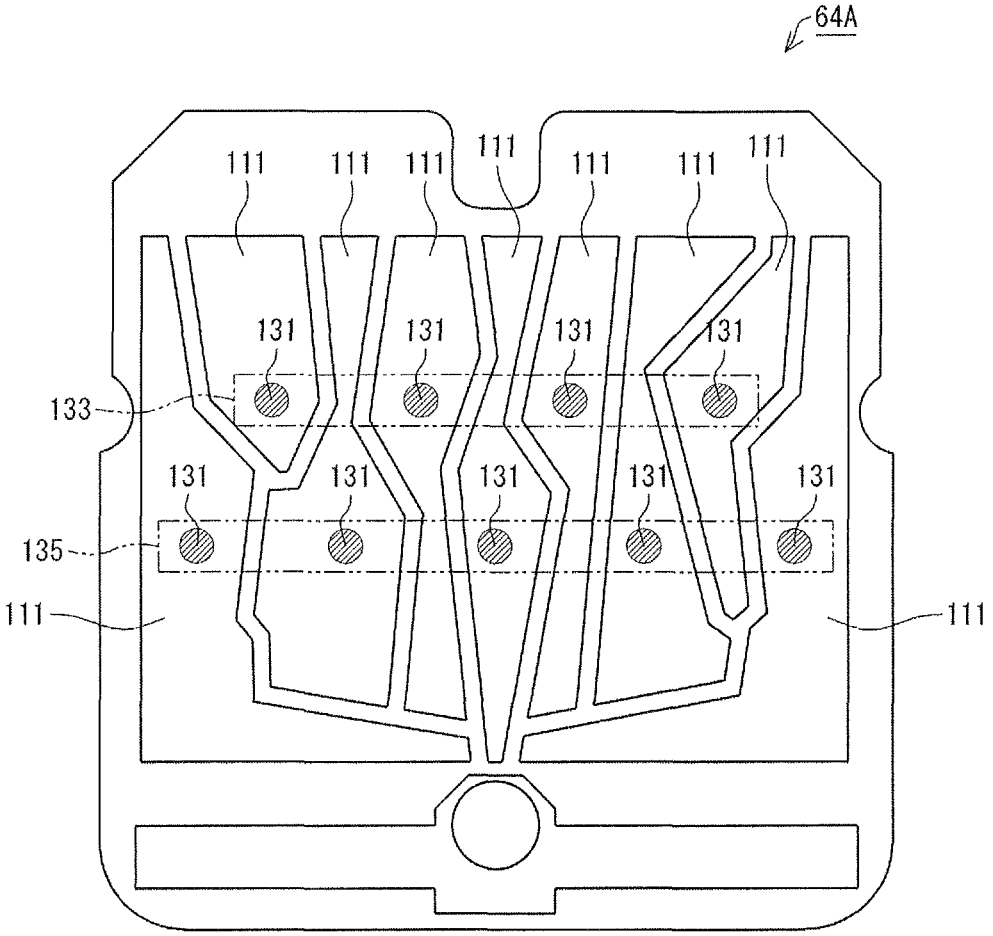
FIG. 52 shows a circuit substrate of variation 9.

A circuit substrate 64A of variation 9 has a plurality of electrodes ill with irregular shapes, that is, variant shapes, as shown in FIG. 52. In the circuit substrate 64A, the first electrode sequence 125 and the second electrode sequence 127 (FIG. 16) of the circuit substrate 64 are indistinguishable. In other words, in the circuit substrate 64A, there is no distinction between the first electrode sequence 125 and the second electrode sequence 127. However, a first array 133 and a second array 135 are distinguishable among a plurality of contact portions 131. In other words, the plurality of contact portions 131 are disposed in the same manner in the circuit substrate 64A and the circuit substrate 64. Thus, with the circuit substrate 64A, electrical circuits of the circuit substrate 64A can be similarly electrically connected to a control circuit (not shown) of the printer 1 through a contact mechanism 63.

Figure 53:
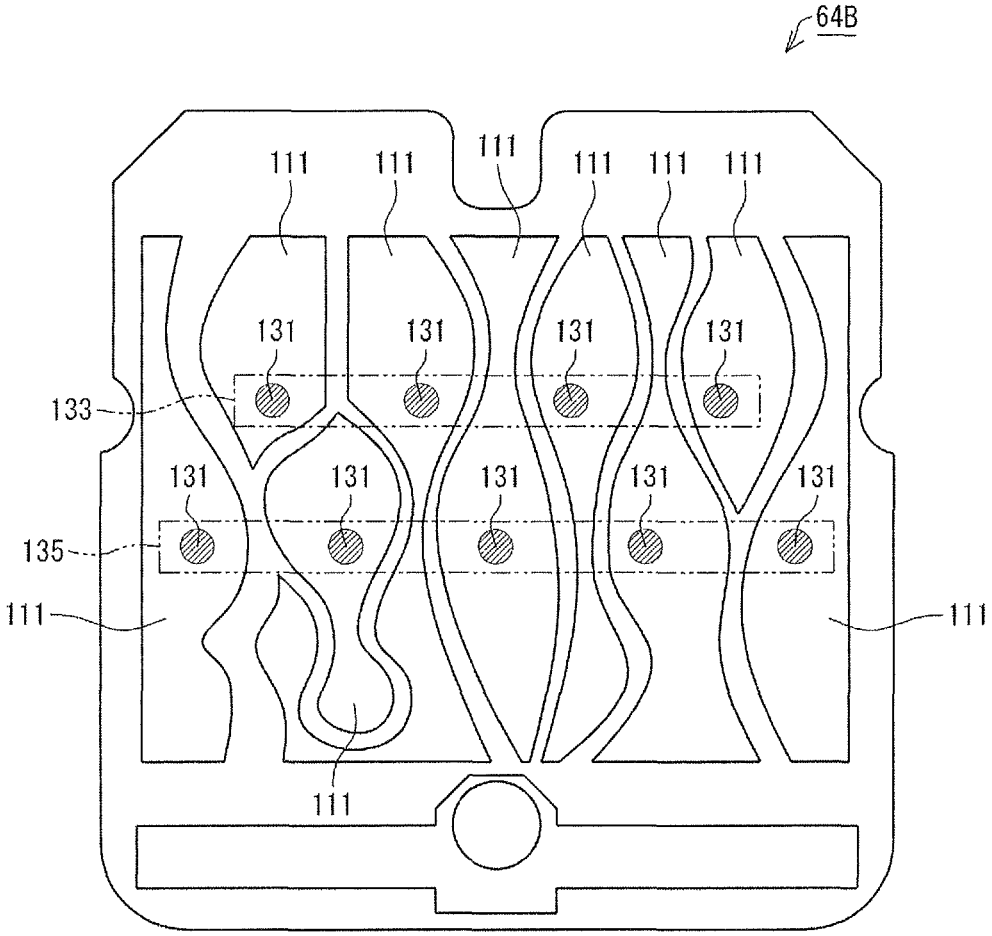
FIG. 53 shows a circuit substrate of variation 10.

A circuit substrate 64B of variation 10 has a plurality of electrodes ill with irregular shapes, that is, variant shapes, as shown in FIG. 53. In the circuit substrate 64B, curves are incorporated into the outlines of the electrodes 111. The circuit substrate 64B differs from the circuit substrate 64A in this respect. Apart from this point, the circuit substrate 64B has a similar configuration to the circuit substrate 64A. With the circuit substrate 64B, electrical circuits of the circuit substrate 64B can be similarly electrically connected to a control circuit (not shown) of the printer 1 through a contact mechanism 63.

Figure 54:
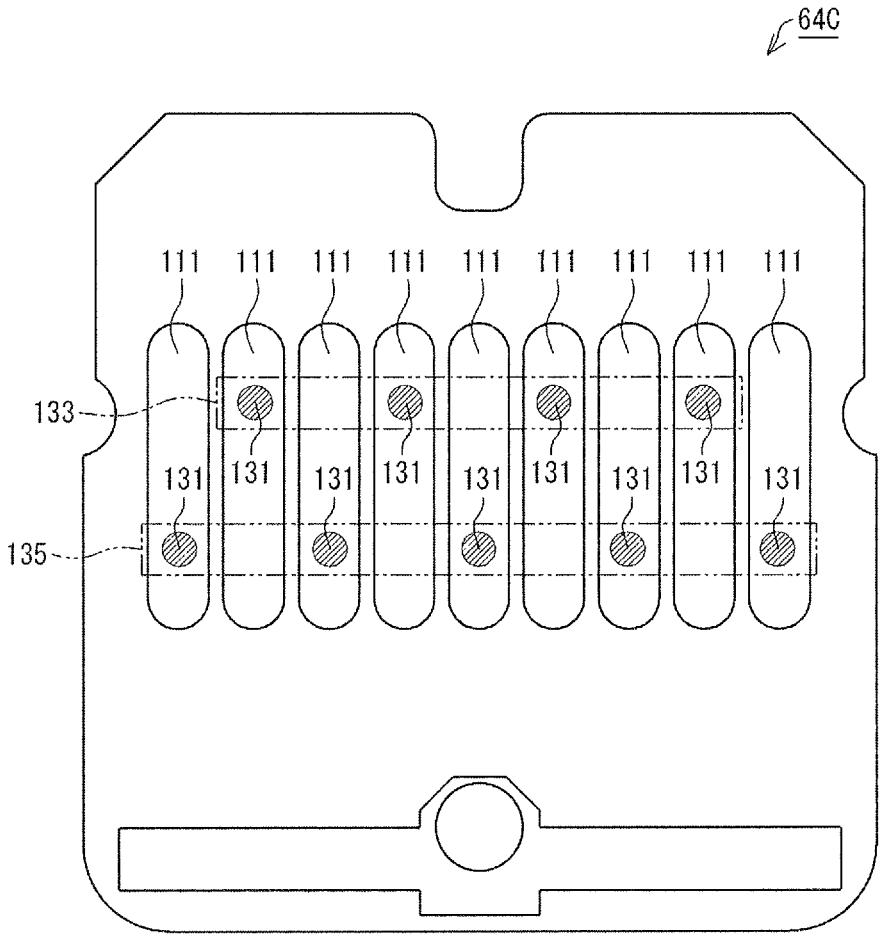
FIG. 54 shows a circuit substrate of variation 11.

A circuit substrate 64C of variation 11 has a plurality of electrodes 111 that are all aligned in the X-axis direction, as shown in FIG. 54. In the circuit substrate 64C, the first electrode sequence 125 and the second electrode sequence 127 (FIG. 16) of the circuit substrate 64 are thus indistinguishable. In other words, in the circuit substrate 64C, there is no distinction between the first electrode sequence 125 and the second electrode sequence 127. However, a first array 133 and a second array 135 are distinguishable among a plurality of contact portions 131. In other words, the plurality of contact portions 131 are disposed in the same manner in the circuit substrate 64C and the circuit substrate 64. Thus, with the circuit substrate 64C, electrical circuits of the circuit substrate 64C can be similarly electrically connected to a control circuit (not shown) of the printer 1 through a contact mechanism 63.

The invention is not only applicable to an ink jet printer and an ink cartridge thereof but also to any printing apparatus (liquid ejection apparatus) that injects (ejects) a liquid other than ink and a cartridge thereof. For example, the invention is applicable to the following types of printing apparatuses and cartridges thereof:

(1) Image recording apparatuses such as facsimile machines.
(2) Printing apparatuses that inject colored material and are used in the manufacture of color filters for image display apparatuses such as liquid crystal displays.
(3) Printing apparatuses that inject electrode material and are used in the electrode formation of organic electro-luminescence (EL) displays, field emission displays (FEDs) and the like.
(4) Printing apparatuses that inject liquids containing bioorganic substances and are used in biochip manufacture.
(5) Sample printing apparatuses used as precision pipettes.
(6) Printing apparatuses that use lubricant.
(7) Printing apparatuses that use resin liquid.
(8) Printing apparatuses that inject lubricant with pinpoint accuracy with respect to precision instruments such as clocks and cameras.
(9) Printing apparatuses that inject transparent resin liquid such as ultraviolet curable resin liquid onto substrates in order to form devices such as hemispherical microlenses (optical lenses) that are used in optical communication elements or the like.
(10) Printing apparatuses that inject acid or alkaline etching solutions in order to etch substrates or the like.
(11) Any other printing apparatuses that are provided with a liquid injection head (liquid ejection head) for ejecting minute droplets of a liquid.

Note that "droplets" denotes the state of the liquid ejected from the printing apparatus, and is deemed to include granular droplets, tear-shaped droplets, and threadlike droplets having a trailing end. Also, the "liquid" may be any material that can be injected by a printing apparatus. For example, the "liquid" may be any material in a liquid phase, examples of which include materials in a liquid state having high or low viscosity, sol, gel water, and other materials in a liquid state such as inorganic solvents, organic solvents, solutions, liquid resins, and liquid metals (metal melts). Examples of "liquids" include not only liquid as one state of a substance but also materials obtained by dissolving, dispersing or mixing particles of functional materials consisting of solids such pigments or metal particles in a solvent. Such "Liquids" can also be referred to as "liquid bodies". Typical examples of liquids or liquid bodies include liquid crystal and ink such as described in the above embodiments. Here, "ink" is deemed to encompass various liquid composites such as gel ink and hot melt ink as well as common water-based ink and oil-based ink.

What is claimed is:

1. A cartridge configured to be detachably mounted to a liquid ejection apparatus that has an electrical connection portion and an engagement portion, and having a housing portion configured to house a liquid for supplying to the liquid ejection apparatus, the cartridge comprising:

an engaging portion configured to be engaged with the engagement portion of the liquid ejection apparatus; and a plurality of electrodes configured to be electrically connected to the connection portion of the liquid ejection apparatus;

wherein the plurality of electrodes each have a contact portion configured to be contacted to the connection portion, a first group of a plurality of the contact portions constitute a first array in which the first group of the plurality of the contact portions are aligned in a first direction that intersects a mounting direction in which the cartridge is mounted to the liquid ejection apparatus, a second group of the plurality of the contact portions constitute a second array in which the second group of the plurality of the contact portions are aligned in the first direction, the first array and the second array are aligned in a second direction that intersects the first direction, and the engaging portion and an area between the first array and the second array are aligned in the first direction when the cartridge is mounted on the liquid ejection apparatus.

2. The cartridge according to claim 1, wherein the first array and the second array are located within a range from one quarter to three quarters of a height of the cartridge, when the cartridge is viewed from a side on which the engaging portion and the plurality of the contact portions are provided, and in a state where the mounting direction is aligned within a vertical direction.

3. The cartridge according to claim 1, further comprising:

a lever extending from an outer shell of the cartridge, and on which the engaging portion is provided, wherein the lever has an elastic force that biases the engaging portion.

4. The cartridge according to claim 3, wherein the plurality of the contact portions overlap the lever when viewed in the first direction.

5. The cartridge according to claim 3, further comprising:

a gripping portion that, where a side on which the lever joins the outer shell of the cartridge is given as one end of the lever, is provided further at the other end of the lever than the engaging portion, wherein the gripping portion projects further in the first direction than the cartridge, when the cartridge is viewed from a side on which the engaging portion and the electrodes are provided.

6. The cartridge according to claim 3, further comprising:

an outer wall that constitutes at least part of the outer shell of the cartridge, wherein a disposition portion on which the plurality of electrodes are provided and the lever project from the outer wall.

7. The cartridge according to claim 1, wherein the plurality of electrodes respectively incline toward an inside of the cartridge in the direction in which the cartridge is mounted to the liquid ejection apparatus.

8. The cartridge according to claim 1, wherein each of the plurality of electrodes has a friction area which is an area that the connection portion rubs against in the second direction when mounting the cartridge to the liquid ejection apparatus, and the engaging portion is located between the plurality of friction areas in the first array and the plurality of friction areas in the second array when viewed in the first direction.

9. The cartridge according to claim 1, further comprising:

a plurality of the housing portions constituted integrally and aligned in the first direction, wherein the plurality of housing portions are partitioned from each other, and each configured to independently house the liquid.

10. The cartridge according to claim 1, further comprising:

a second engaging portion provided on an opposite side to the engaging portion side across the housing portion, the second engaging portion being configured to be engaged to a second engagement portion of the liquid ejection apparatus.

11. The cartridge according to claim 1, further comprising:

a first member to which the housing portion is provided; and a second member to which the engaging portion and the plurality of electrodes are provided, wherein the first member and the second member are constituted separately from each other.

12. A liquid supply system configured to supply a liquid to a liquid ejection apparatus that has an electrical connection portion and an engagement portion, the liquid supply system comprising:

an external tank configured to house the liquid;

a tube configured to supply the liquid from the external tank to the liquid ejection apparatus; and an adapter provided with a plurality of electrodes to be electrically connected to the connection portion and an engaging portion to engage the engagement portion, and configured to be detachably mounted to the liquid ejection apparatus, wherein the plurality of electrodes each have a contact portion configured to be contacted to the connection portion of the liquid ejection apparatus, a first group of a plurality of the contact portions constitute a first array in which the first group of the plurality of the contact portions are aligned in a first direction that intersects a mounting direction in which the adapter is mounted to the liquid ejection apparatus, a second group of the plurality of the contact portions constitute a second array in which the contact portions are aligned in the first direction, the first array and the second array are aligned in a second direction that intersects the first direction, the engaging portion and an area between the first array and the second array are aligned in the first direction when the adapter is mounted on the liquid ejection apparatus.

13. A liquid ejection apparatus configured to eject a liquid, the liquid ejection apparatus comprising:

a holder configured to have a cartridge detachably mounted thereto, the cartridge having a housing portion configured to house the liquid for supplying the liquid ejection apparatus;

an electrical connection portion provided to the holder; and an engagement portion provided to the holder, wherein the cartridge includes:

a lever extending from an outer shell of the cartridge;

an engaging portion provided on the lever, the engaging portion being configured to be engaged to the engagement portion of the holder;

a plurality of electrodes configured to be electrically connected to the connection portion of the holder; and a gripping portion that, where a side on which the lever joins the outer shell of the cartridge is given as one end of the lever, is provided further at the other end of the lever than the engaging portion, the plurality of electrodes each have a contact portion to contact the connection portion, a first group of a plurality of the contact portions constitute a first array in which the first group of the plurality of the contact portions are aligned in a first direction that intersects a mounting direction in which the cartridge is mounted to the holder, a second group of the plurality of the contact portions constitute a second array in which the second group of the plurality of the contact portions are aligned in the first direction, the first array and the second array are aligned in a second direction that intersects the first direction, the engaging portion and an area between the first array and the second array are aligned in the first direction, the lever has an elastic force that biases the engaging portion, the gripping portion projects further in the first direction than the cartridge, when the cartridge is viewed from a side on which the engaging portion and the electrodes are provided, the holder has a wallboard that opposes a side of the cartridge in the first direction, and the wallboard is provided with a notch portion where a part of the wallboard is cut away, the part of the wallboard including an area that overlaps with the gripping portion when viewed in the first direction.

* * * * *